US008576261B2

(12) United States Patent
Yoshida et al.

(10) Patent No.: US 8,576,261 B2
(45) Date of Patent: Nov. 5, 2013

(54) LIQUID CRYSTAL DISPLAY DEVICE

(75) Inventors: Yuichi Yoshida, Osaka (JP); Kazunari Tomizawa, Osaka (JP); Tomohiko Mori, Osaka (JP); Kozo Nakamura, Osaka (JP); Shun Ueki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 249 days.

(21) Appl. No.: 13/133,714

(22) PCT Filed: Dec. 8, 2009

(86) PCT No.: PCT/JP2009/006689

§ 371 (c)(1),
(2), (4) Date: Jun. 9, 2011

(87) PCT Pub. No.: WO2010/067581

PCT Pub. Date: Jun. 17, 2010

(65) Prior Publication Data

US 2011/0242149 A1 Oct. 6, 2011

(30) Foreign Application Priority Data

Dec. 10, 2008 (JP) ..... 2008-315067
Apr. 10, 2009 (JP) ..... 2009-096522

(51) Int. Cl.
*G09G 5/10* (2006.01)
*G09G 3/36* (2006.01)

(52) U.S. Cl.
USPC ..... 345/690; 345/88

(58) Field of Classification Search
None
See application file for complete search history.

(56) References Cited

U.S. PATENT DOCUMENTS

| | | | |
|---|---|---|---|
| 4,800,375 | A | 1/1989 | Silverstein et al. |
| 6,661,488 | B1 | 12/2003 | Takeda et al. |
| 6,958,791 | B2 | 10/2005 | Shimoshikiryo |
| 7,034,789 | B2 | 4/2006 | Takeuchi et al. |
| 7,268,757 | B2 | 9/2007 | Ben-David et al. |
| 2003/0146893 | A1 | 8/2003 | Sawabe |
| 2004/0174389 | A1 | 9/2004 | Ben-David et al. |
| 2005/0122294 | A1 | 6/2005 | Ben-David et al. |

(Continued)

FOREIGN PATENT DOCUMENTS

| | | | |
|---|---|---|---|
| JP | 09-251160 | A | 9/1997 |
| JP | 11-242225 | A | 9/1999 |

(Continued)

OTHER PUBLICATIONS

Official Communication issued in International Patent Application No. PCT/JP2009/006689, mailed on Jan. 19, 2010.

(Continued)

*Primary Examiner* — Joseph Feild
*Assistant Examiner* — Nicholas Lee
(74) *Attorney, Agent, or Firm* — Keating & Bennett, LLP

(57) ABSTRACT

A liquid crystal display device (100A) of the present invention includes an active matrix substrate (220); a counter substrate (240); and a vertical alignment type liquid crystal layer (260). The liquid crystal display device (100) has a plurality of pixels, each of the pixels including a plurality of subpixels. The plurality of subpixels include a red subpixel (R), a green subpixel (G), and a blue subpixel (B). When each of adjacent two of the plurality of pixels represents an achromatic color at a certain grayscale level, a luminance of a blue subpixel (B) included in one of the two adjacent pixels is different from a luminance of a blue subpixel (B) included in the other of the two adjacent pixels.

10 Claims, 39 Drawing Sheets

(56) References Cited

U.S. PATENT DOCUMENTS

| | | | |
|---|---|---|---|
| 2005/0253797 | A1 | 11/2005 | Kamada et al. |
| 2007/0040780 | A1 | 2/2007 | Gass et al. |
| 2009/0135213 | A1 | 5/2009 | Tomizawa et al. |

FOREIGN PATENT DOCUMENTS

| | | | |
|---|---|---|---|
| JP | 2001-209047 | A | 8/2001 |
| JP | 2001-306023 | A | 11/2001 |
| JP | 2001-312254 | A | 11/2001 |
| JP | 2003-295160 | A | 10/2003 |
| JP | 2004-062146 | A | 2/2004 |
| JP | 2004-078157 | A | 3/2004 |
| JP | 2004-529396 | A | 9/2004 |
| JP | 2005-523465 | A | 8/2005 |
| JP | 2005-316211 | A | 11/2005 |
| JP | 2006-292973 | A | 10/2006 |
| JP | 2007-017988 | A | 1/2007 |
| JP | 2008-225295 | A | 9/2008 |
| WO | 2007/032133 | A1 | 3/2007 |
| WO | WO 2007052381 | A1 * | 5/2007 |
| WO | WO 2008090845 | A1 * | 7/2008 |

OTHER PUBLICATIONS

Yang et al.; "31.1: Development of Six Primary-Color LCD"; Society for Information Display, 2005 International Symposium Digest of Technical Papers; vol. XXXVI; Book II; May 25-27, 2005; pp. 1210-1213.

Chino et al.; "25.1: Invited Paper: Development of Wide-Color-Gamut Mobile Displays With Four-Primary-Color LCDS"; Society for Information Display, 2006 International Symposium Digest of Technical Papers; vol. XXXVII, Book II; Jun. 7-9, 2006; pp. 1221-1224.

Ben-Chorin; "Improving LCD TV Color Using Multi-Primary Technology"; FPD International 2005 Forum; Oct. 19, 2005; 66 pages.

English translation of Official Communication issued in corresponding International Application PCT/JP2009/006689, mailed on Jul. 14, 2011.

* cited by examiner (a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

LIQUID CRYSTAL DISPLAY DEVICE

TECHNICAL FIELD

The present invention relates to a liquid crystal display device.

BACKGROUND ART

Liquid crystal displays (LCDs) have been used in not only TV sets with a big screen but also small display devices such as the monitor screen of a cellphone. TN (twisted nematic) mode LCDs, which would often be used in the past, achieved relatively narrow viewing angles, but LCDs of various other modes with wider viewing angles have recently been developed one after another. Examples of those wider viewing angle modes include IPS (in-plane switching) mode and VA (vertical alignment) mode. Among those wide viewing angle modes, the VA mode is adopted in a lot of LCDs because the VA mode would achieve a sufficiently high contrast ratio.

However, in the case of a VA mode LCD, grayscale inversion may occur when the display is viewed from an oblique viewing direction. To prevent such grayscale inversion, an MVA (Multi-domain Vertical Alignment) mode in which multiple liquid crystal domains are formed within a single pixel region has been employed. In an MVA mode LCD, an alignment control structure is provided for at least one of the two substrates, which face each other with a vertical alignment liquid crystal layer interposed between them, so that the alignment control structure contacts with the liquid crystal layer. As the alignment control structure, a linear slit (opening) or a rib (projection) of an electrode may be used, thereby applying alignment control force to the liquid crystal layer from one or both sides thereof. In this manner, multiple (typically four) liquid crystal domains with multiple different alignment directions are defined, thereby attempting to prevent grayscale inversion.

Also known as another kind of VA mode LCD is a CPA (continuous pinwheel alignment) mode LCD. In a normal CPA mode LCD, its pixel electrodes have a highly symmetric shape and either an opening or a projection (which is sometimes called a "rivet") is arranged on the surface of the counter substrate in contact with the liquid crystal layer so as to be aligned with the center of a liquid crystal domain. When a voltage is applied, an oblique electric field is generated by the counter electrode and the highly symmetric pixel electrode and induces radially tilting alignments of liquid crystal molecules. Also, with a rivet provided, the alignment control force produced on the slope of the rivet stabilizes the tilted alignments of the liquid crystal molecules. As the liquid crystal molecules are radially aligned within a single pixel in this manner, grayscale inversion can be prevented.

Common liquid crystal display devices usually represent colors by additive color mixture of RGB primary colors (i.e., red, green and blue). In general, pixels of a color display panel each include red, green and blue sub-pixels in correspondence with the RGB colors. Such a display is referred to also as a "three primary color display device". To a display panel of the three primary color display device, YCrCb (YCC) signals which can be converted into RGB signals are input, and based on the YCrCb signals, the luminance values of the red, green and blue sub-pixels are changed. Thus, various colors are represented. In the following description, the luminance value (luminance level) of a sub-pixel corresponding to the minimum gray scale level (for example, gray scale level 0) is represented as "0", and the luminance value of a sub-pixel corresponding to the maximum gray scale level (for example, gray scale level 255) is represented as "1". The luminance values of the red, green and blue sub-pixels are each controlled in the range of "0" to "1".

When the luminance values of all the sub-pixels, i.e., the red, green and blue sub-pixels are "0", the color displayed by the pixel is black. By contrast, when the luminance values of all the sub-pixels are "1", the color displayed by the pixel is white. Many of recent TVs allow even a user to adjust the color temperature. In such a TV, the color temperature is adjusted by fine-tuning the luminance value of each sub-pixel. Here, the luminance value of a sub-pixel after the color temperature is adjusted to a desired level is represented as "1".

Here, change of the luminance of respective subpixels in a common three primary color display device, which occurs when the color displayed by a pixel changes from black to white while it remains achromatic, is described. In an initial state, the color displayed by the pixel is black, and the luminances of the red, green and blue subpixels are "0". The luminances of the red, green and blue subpixels start to increase. The luminances of the red, green and blue subpixels increase at equal rates. As the luminances of the red, green and blue subpixels increase, the lightness of the color displayed by the pixel increases. When the increasing luminances of the red, green and blue subpixels reach "1", the color displayed by the pixel is white. In this way, the lightness of the achromatic color can be changed by changing the luminances of the red, green and blue subpixels at equal rates.

However, strictly speaking, when the lightness of an achromatic color is changed, the color displayed by the pixel may sometimes change (see, for example, Patent Document 1). Patent Document 1 discloses performing a gamma correction such that the value of the blue subpixel is higher than those of the red and green subpixels in the process of changing the lightness of an achromatic color. In the liquid crystal display device of Patent Document 1, the sRGB color solid is converted to a color solid of a liquid crystal display panel via a PCS (profile connection space) before a gamma correction is performed with the utilization of a gamma curve in which the value of the blue subpixel is higher than those of the red and green subpixels at middle grayscale levels. Thereby, the change in achromatic color which would occur according to the change of lightness can be prevented. A process of this kind is also called an independent gamma correction process.

In recent years, unlike the above-described three primary color display device, a display device which is designed for additive color mixture of multiple (four or more) primary colors has been proposed (see, for example, Patent Documents 2 to 4). Such a display device which uses four or more primary colors for display is also called a multi-primary color display device. Patent Documents 2 and 3 disclose a multi-primary color display device which has pixels that include red, green, blue, yellow, cyan and magenta subpixels. Patent Document 4 discloses a multi-primary color display device which has another red subpixel in place of a magenta subpixel.

Citation List

Patent Literature

Patent Document 1: Japanese Laid-Open Patent Publication No. 2001-312254

Patent Document 2: Japanese PCT National Phase Laid-Open Publication No. 2004-529396

Patent Document 3: Japanese PCT National Phase Laid-Open Publication No. 2005-523465

Patent Document 4: WO 2007/032133

SUMMARY OF INVENTION

Technical Problem

The present inventors found that, in a VA mode liquid crystal display device, an achromatic color at middle grayscale levels, which is normally perceived when viewed from a front viewing direction, may be perceived as having some hue when viewed from an oblique viewing direction, so that the display quality can deteriorate.

The present invention was conceived in view of the above circumstances. One of the objects of the present invention is to provide a liquid crystal display device in which deterioration of the display quality for an oblique viewing direction is prevented.

Solution to Problem

A liquid crystal display device of the present invention includes: an active matrix substrate; a counter substrate; and a vertical alignment type liquid crystal layer interposed between the active matrix substrate and the counter substrate, wherein the display device has a plurality of pixels, each of the pixels including a plurality of subpixels, the plurality of subpixels include a red subpixel, a green subpixel, and a blue subpixel, and when, in an input signal, each of adjacent two of the plurality of pixels represents an achromatic color at a certain grayscale level, a luminance of the blue subpixel included in one of the two adjacent pixels is different from a luminance of the blue subpixel included in the other of the two adjacent pixels.

In one embodiment, when in an input signal each of the two adjacent pixels represents an achromatic color at the certain grayscale level, the red subpixels included in the two adjacent pixels have equal luminances, and the green subpixels included in the two adjacent pixels have equal luminances.

In one embodiment, when at least one of the red subpixels and the green subpixels of the two adjacent pixels is unlit while at least one of the blue subpixels of the two adjacent pixels is lit, the blue subpixels included in the two adjacent pixels have equal luminances.

In one embodiment, the input signal or a signal converted from the input signal represents a grayscale level of the plurality of subpixels included in each of the plurality of pixels, and a grayscale level of the blue subpixels included in the two adjacent pixels which is represented by the input signal or the signal converted from the input signal is corrected according to a saturation of the two adjacent pixels which is represented by the input signal.

In one embodiment, the input signal or a signal converted from the input signal represents a grayscale level of the plurality of subpixels included in each of the plurality of pixels, and a grayscale level of the blue subpixels included in the two adjacent pixels which is represented by the input signal or the signal converted from the input signal is corrected according to a saturation of the two adjacent pixels which is represented by the input signal and a difference in grayscale level between the blue subpixels included in the two adjacent pixels which is represented by the input signal.

In one embodiment, when in an input signal one of the two adjacent pixels represents a first achromatic color and the other of the two adjacent pixels represents the first achromatic color or a second achromatic color which has a different lightness from that of the first achromatic color, a luminance of each of the blue subpixels included in the two adjacent pixels is different from a luminance which corresponds to a grayscale level represented by the input signal or a signal converted from the input signal, and when in an input signal one of the two adjacent pixels represents the first achromatic color and the other of the two adjacent pixels represents a third achromatic color, a difference in lightness between third achromatic color and the first achromatic color being greater than a difference in lightness between the second achromatic color and the first achromatic color, a luminance of each of the blue subpixels included in the two adjacent pixels is generally equal to a luminance which corresponds to a grayscale level represented by the input signal or a signal converted from the input signal.

A liquid crystal display device of the present invention includes: an active matrix substrate; a counter substrate; and a vertical alignment type liquid crystal layer interposed between the active matrix substrate and the counter substrate, wherein the display device has a pixel which includes a plurality of subpixels, the plurality of subpixels include a red subpixel, a green subpixel, and a blue subpixel, and when in an input signal the pixel represents an achromatic color at a certain grayscale level over multiple frames, a luminance of the blue subpixel in one of the frames is different from a luminance of the blue subpixel in an immediately preceding frame.

In one embodiment, when the pixel displays the achromatic color at the certain grayscale level over multiple frames, a luminance of the red subpixel in the one of the frames is equal to a luminance of the red subpixel in the immediately preceding frame, and a luminance of the green subpixel in the one of the frames is equal to a luminance of the green subpixel in the immediately preceding frame.

In one embodiment, when at least one of the red subpixels and the green subpixels of the pixel in the one frame and the immediately preceding frame is unlit while the blue subpixel of the pixel is lit in at least one of the one frame and the immediately preceding frame, a luminance of the blue subpixel in the one frame is equal to a luminance of the blue subpixel in the immediately preceding frame.

A liquid crystal display device of the present invention includes: an active matrix substrate; a counter substrate; and a vertical alignment type liquid crystal layer interposed between the active matrix substrate and the counter substrate, wherein the display device has a pixel which includes a plurality of subpixels, the plurality of subpixels include a red subpixel, a green subpixel, a first blue subpixel, and a second blue subpixel, and when the pixel displays an achromatic color at a certain grayscale level, a luminance of the first blue subpixel is different from a luminance of the second blue subpixel.

In one embodiment, when at least one of the red subpixel and the green subpixel of the pixel is unlit while at least one of the first blue subpixel and the second blue subpixel of the pixel is lit, a luminance of the first blue subpixel is equal to a luminance of the second blue subpixel.

In one embodiment, the plurality of subpixels further include a yellow subpixel.

In one embodiment, the plurality of subpixels further include a cyan subpixel.

In one embodiment, the plurality of subpixels further include a magenta subpixel.

In one embodiment, the plurality of subpixels further include another red subpixel which is different from the aforesaid red subpixel.

Advantageous Effects of Invention

The present invention enables providing a liquid crystal display device in which deterioration of the display quality for an oblique viewing direction is prevented.

DESCRIPTION OF EMBODIMENTS

Hereinafter, embodiments of a liquid crystal display device of the present invention will be described with reference to the drawings. It should be noted, however, that the present invention is not limited to the embodiments described below.

Embodiment 1

Figure 1:
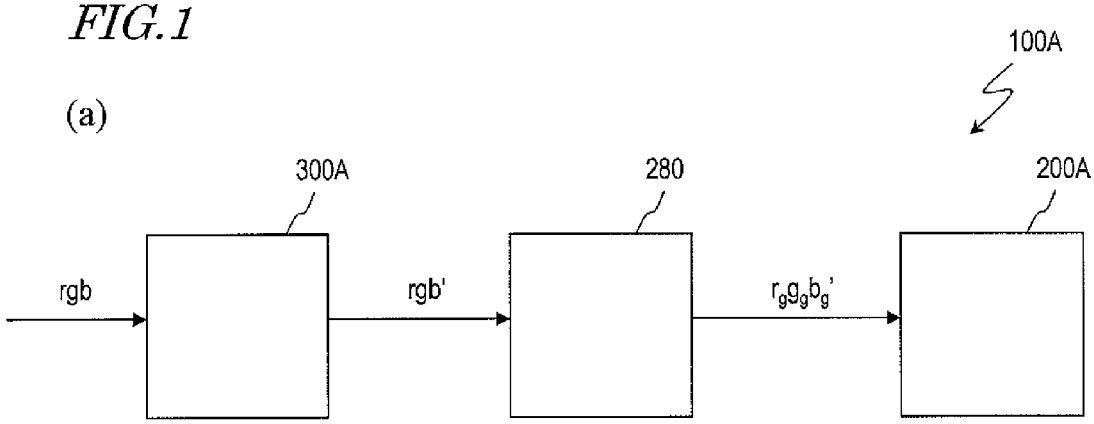
FIG. 1(*a*) is a schematic diagram showing the first embodiment of a liquid crystal display device of the present invention. (*b*) is a schematic diagram showing a liquid crystal display panel of a liquid crystal display device shown in (*a*).
Figure 1:
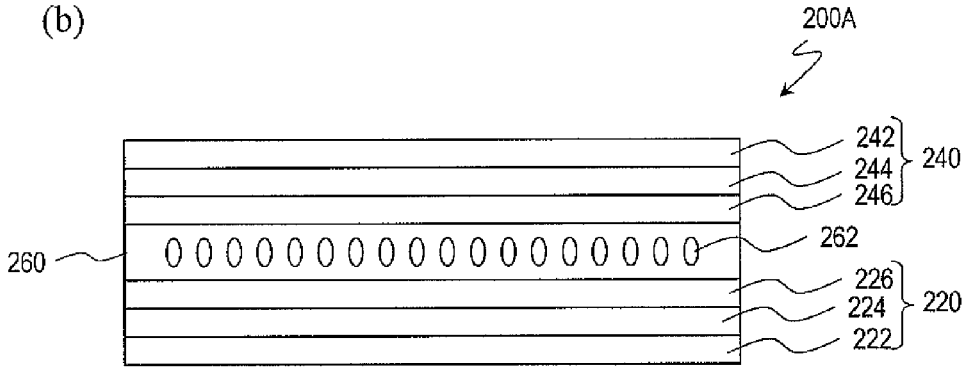

Hereinafter, the first embodiment of the liquid crystal display device of the present invention is described. FIG. 1(*a*) is a schematic diagram of a liquid crystal display device 100A of the present embodiment. The liquid crystal display device 100A includes a liquid crystal display panel 200A, an independent gamma correction processing section 280, and a correction section 300A. The liquid crystal display panel 200A includes a plurality of pixels arranged in a matrix of multiple rows and multiple columns. Here, the pixels of the liquid crystal display panel 200A have red, green and blue subpixels. In the description provided below in this specification, a liquid crystal display device is sometimes simply referred to as "display device".

The independent gamma correction processing section 280 performs an independent gamma correction process. Without the independent gamma correction process, when the color represented by an input signal changes from black to white while it remains achromatic, the chromaticity of the achromatic color which is detected when the liquid crystal display panel 200A is viewed from a front viewing direction may sometimes vary due to the inherent characteristics of the liquid crystal display panel 200A. Such a variation in chromaticity can be reduced by the independent gamma correction process. At least under predetermined conditions, the correction section 300A makes a correction to the grayscale level or corresponding luminance level of at least a blue subpixel among the respective subpixels represented by the input signal.

The input signal is conformable to, for example, a cathode ray tube (CRT) of gamma value 2.2 and is compliant with the NTSC (National Television Standards Committee) standards. The input signal represents the grayscale levels of the red, green and blue subpixels, r, g and b. Usually, the grayscale levels r, g and b are in a 8-bit representation. Alternatively, the input signal may have a value convertible to the grayscale levels r, g and b of the red, green and blue subpixels. This value is in a three-dimensional representation. In FIG. 1, the grayscale levels r, g and b of the input signal are represented by a single symbol, rgb. When the input signal is compliant with the BT.709 standards, the grayscale levels r, g and b represented by the input signal are each within the range from the lowest grayscale level (e.g., grayscale level 0) to the highest grayscale level (e.g., grayscale level 255). The luminances of the red, green and blue subpixels are within the range from "0" to "1". The input signal is, for example, a YCrCb signal. The grayscale levels rgb represented by the input signal are converted to the luminance levels in the liquid crystal display panel 200A, to which the input signal is input via the correction section 300A and the independent gamma correction processing section 280. A voltage corresponding to the luminance levels is applied across a liquid crystal layer 260 (FIG. 1(*b*)) of the liquid crystal display panel 200A.

As described above, in the three primary color display device, when the grayscale levels or luminance levels of the red, green and blue subpixels are zero, the pixel displays the black color. When the grayscale levels or luminance levels of the red, green and blue subpixels are 1, the pixel displays the white color. In a liquid crystal display device in which the independent gamma correction process is not performed, where the highest luminance of the red, green and blue subpixels which have been adjusted to desired color temperatures in a TV set is assumed as "1", the grayscale levels of the red, green and blue subpixels or the ratios of luminance levels of these subpixels to the highest luminance are equal to one another when an achromatic color is displayed. Thus, when the color displayed by the pixel changes from black to white while it remains achromatic, the grayscale levels of the red, green and blue subpixels or the ratios of luminance levels of these subpixels to the highest luminance increase while they remain equal to one another. Note that, in the description below, when the luminance of each subpixel in a liquid crystal display panel corresponds to the lowest luminance, the subpixel is referred to "unlit" subpixel. When the luminance of each subpixel in a liquid crystal display panel is higher than the lowest luminance, the subpixel is referred to "lit" subpixel.

FIG. 1(*b*) is a schematic view of the liquid crystal display panel 200A. The liquid crystal display panel 200A includes an active matrix substrate 220 which has pixel electrodes 224 and an alignment film 226 over an insulative substrate 222, a counter substrate 240 which has a counter electrode 244 and an alignment film 246 over an insulative substrate 242, and a liquid crystal layer 260 interposed between the active matrix substrate 220 and the counter substrate 240. The active matrix substrate 220 and the counter substrate 240 have unshown polarizers. The transmission axes of the polarizers are in a crossed Nicols arrangement. The active matrix substrate 220 also has unshown lines, insulation layers, etc. The counter substrate 240 also has an unshown color filter layer, etc. The thickness of the liquid crystal layer 260 is generally uniform. The liquid crystal display panel 200A has a plurality of pixels in a matrix arrangement of multiple rows and multiple columns. The pixels are defined by the pixel electrodes 224, and the red, green and blue subpixels are defined by subpixel electrodes obtained by dividing the pixel electrodes 224. Note that, as will be described later, in the liquid crystal display panel 200A, the subpixel electrode is further divided into a plurality of electrodes.

The liquid crystal display panel 200A operates in a VA mode. The alignment films 226, 246 are vertical alignment films. The liquid crystal layer 260 is a vertical alignment type liquid crystal layer. Here, the "vertical alignment type liquid crystal layer" refers to a liquid crystal layer in which the liquid crystal molecule axes (or "axial orientations") are oriented with an angle of about 85° or greater relative to the surfaces of the vertical alignment films 226, 246. The liquid crystal layer 260 contains a nematic liquid crystal material of negative dielectric anisotropy and is combined with the polarizers in a crossed Nicols arrangement for display in a normally black mode. When a voltage is not applied across the liquid crystal layer 260, liquid crystal molecules 262 of the liquid crystal layer 260 are oriented generally parallel to the normal to the principal surfaces of the alignment films 226, 246. When a voltage higher than a predetermined voltage is applied across the liquid crystal layer 260, the liquid crystal molecules 262 of the liquid crystal layer 260 are oriented generally parallel to the principal surfaces of the alignment films 226, 246. When a high voltage is applied across the liquid crystal layer 260, the liquid crystal molecules 262 are symmetrically aligned in a subpixel or in a specific area of a subpixel, so that the viewing angle characteristics are improved. It should be noted that, herein, the active matrix substrate 220 and the counter substrate 240 have the alignment films 226, 246, respectively, although at least one of the active matrix substrate 220 and the counter substrate 240 may have a corresponding one of the alignment films 226, 246. From the viewpoint of alignment stability, it is preferred that both the active matrix substrate 220 and the counter substrate 240 have the alignment films 226, 246, respectively.

Figure 2:
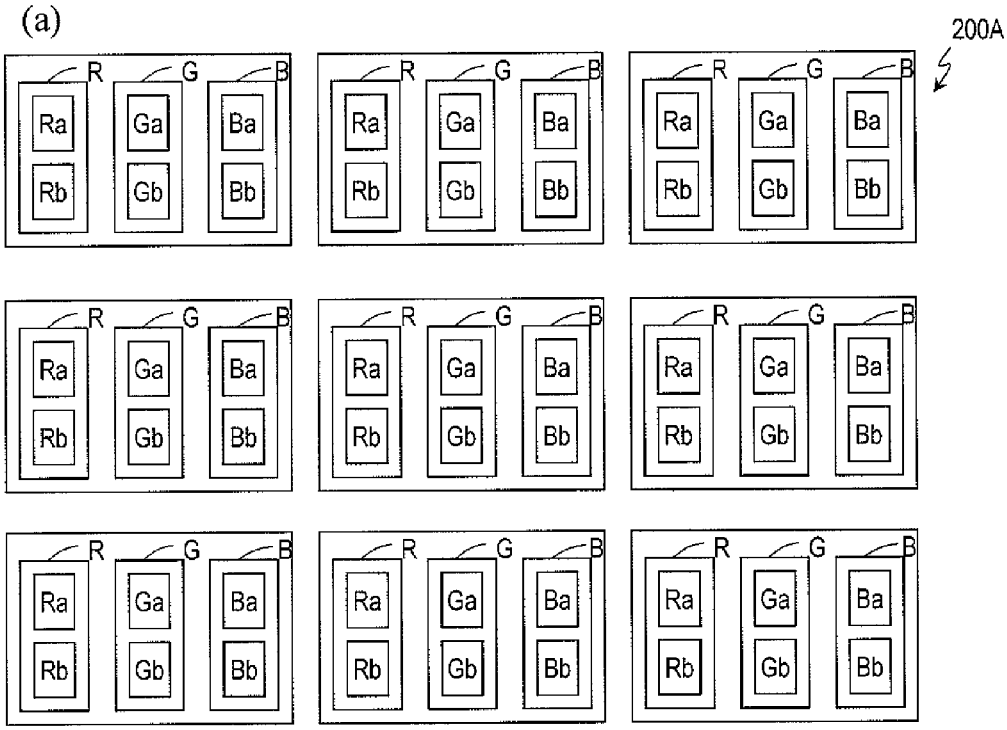
FIG. 2(*a*) is a schematic diagram showing an arrangement of pixels provided in the liquid crystal display device shown in FIG. 1. (*b*) is a schematic diagram showing the structure of a blue subpixel of the liquid crystal display panel.
Figure 2:
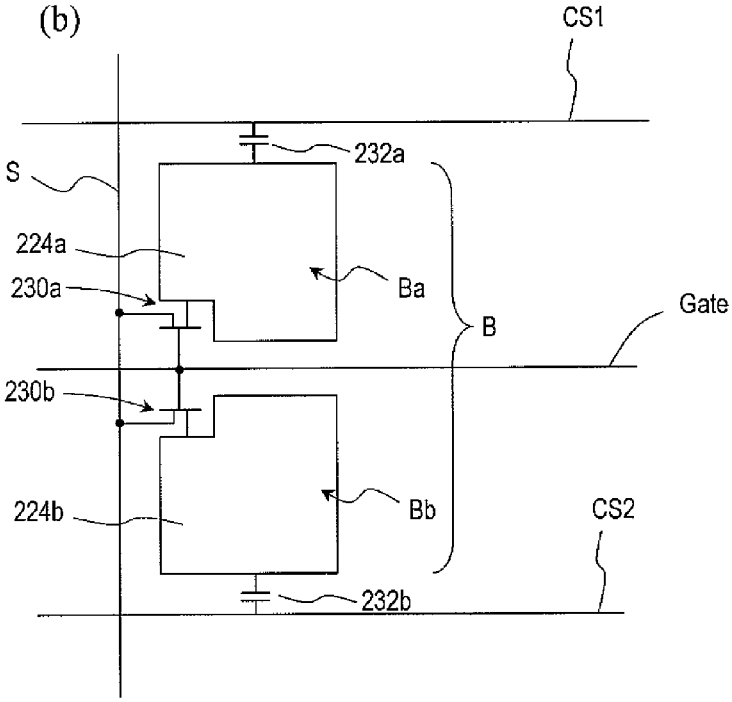

FIG. 2(*a*) shows an arrangement of the pixels provided in the liquid crystal display panel 200A and the subpixels included in the pixels. FIG. 2(*a*) shows the pixels arranged in three rows and three columns as an example. Each of the pixels includes three subpixels, i.e., a red subpixel R, a green subpixel G, and a blue subpixel B. In the liquid crystal display panel 200A, one color is expressed by one pixel that includes the red subpixel R, the green subpixel G, and the blue subpixel B. The luminance of each of the subpixels can be independently controlled. Note that the color filter arrangement of the liquid crystal display panel 200A corresponds to the arrangement shown in FIG. 2(*a*).

In the liquid crystal display device 100A, each of the three subpixels R, G and B has two divisional regions. Specifically, the red subpixel R has a first region Ra and a second region Rb. Likewise, the green subpixel G has a first region Ga and a second region Gb, and the blue subpixel B has a first region Ba and a second region Bb.

The divisional regions in each of the subpixels R, G, B can be controlled so as to have different luminance values, and therefore, it is possible to reduce such a viewing angle dependence of the gamma characteristic that the gamma characteristic obtained when the display screen is viewed from the front viewing direction and the gamma characteristic obtained when the display screen is viewed from an oblique viewing direction are different. The reduction of the viewing angle dependence of the gamma characteristic is disclosed in Japanese Laid-Open Patent Publication No. 2004-62146 and Japanese Laid-Open Patent Publication No. 2004-78157. Controlling the divisional regions of each of the subpixels R, G, B so as to have different luminances achieves the effect of reducing the viewing angle dependence of the gamma characteristic as in the disclosures of Japanese Laid-Open Patent Publication No. 2004-62146 and Japanese Laid-Open Patent Publication No. 2004-78157. Note that such a structure of the red, green and blue subpixels R, G and B is also referred to as "division configuration". In the description below in this specification, one of the first and second divisional regions which has the higher luminance is also referred to as "brighter region", and the other divisional region which has the lower luminance is also referred to as "darker region".

In the description below, for the sake of convenience, the luminance level of a subpixel corresponding to the lowest grayscale level (e.g., grayscale level 0) is represented by "0", and the luminance level of a subpixel corresponding to the highest grayscale level (e.g., grayscale level 255) is represented by "1". Even when the red, green and blue subpixels have equal luminance levels, the actual luminances of these subpixels may be different. The luminance level represents the ratio of the luminance of each subpixel to the highest luminance. For example, when the color of a pixel represents black in the input signal, all the grayscale levels r, g and b represented by the input signal are the lowest grayscale levels (e.g., grayscale level 0). When the color of a pixel represents white in the input signal, all the grayscale levels r, g and b represented by the input signal are the highest grayscale levels (e.g., grayscale level 255). In the description below, the grayscale level may sometimes be normalized with the highest grayscale level, whereby the grayscale level is expressed by a value in the range of "0" to "1".

FIG. 2(*b*) shows the structure of the blue subpixel B of the liquid crystal display device 100A. Although not shown in FIG. 2(*b*), the red subpixel R and the green subpixel G also have the same structure.

The blue subpixel B has two regions Ba and Bb. Separate electrodes 224*a*, 224*b* corresponding to the regions Ba, Bb are coupled to TFTs 230*a*, 230*b* and storage capacitors 232*a*, 232*b*, respectively. The gate electrodes of the TFT 230*a* and the TFT 230*b* are coupled to a gate line Gate, and the source electrodes are coupled to a common (identical) source line S. The storage capacitors 232*a*, 232*b* are coupled to a storage capacitor line CS1 and a storage capacitor line CS2, respectively. The storage capacitors 232*a* and 232*b* are formed by storage capacitor electrodes which are electrically coupled to the separate electrodes 224*a* and 224*b*, respectively, storage capacitor counter electrodes which are electrically coupled to the storage capacitor lines CS1 and CS2, respectively, and unshown insulating layers interposed therebetween. The storage capacitor counter electrodes of the storage capacitors 232*a* and 232*b* are independent of each other and can be supplied with different storage capacitor counter voltages from the storage capacitor lines CS1 and CS2, respectively. After the voltage is supplied to the separate electrodes 224*a*, 224*b* via the source line S when the TFT 230*a*, 230*b* are conducting, the TFT 230*a*, 230*b* become non-conducting. When the potentials of the storage capacitor lines CS1 and CS2 vary differently, the effective voltage of the separate electrode 224*a* is different from the effective voltage of the separate electrode 224*b*, and as a result, the luminance of the first region Ba is different from the luminance of the second region Bb.

Figure 3:
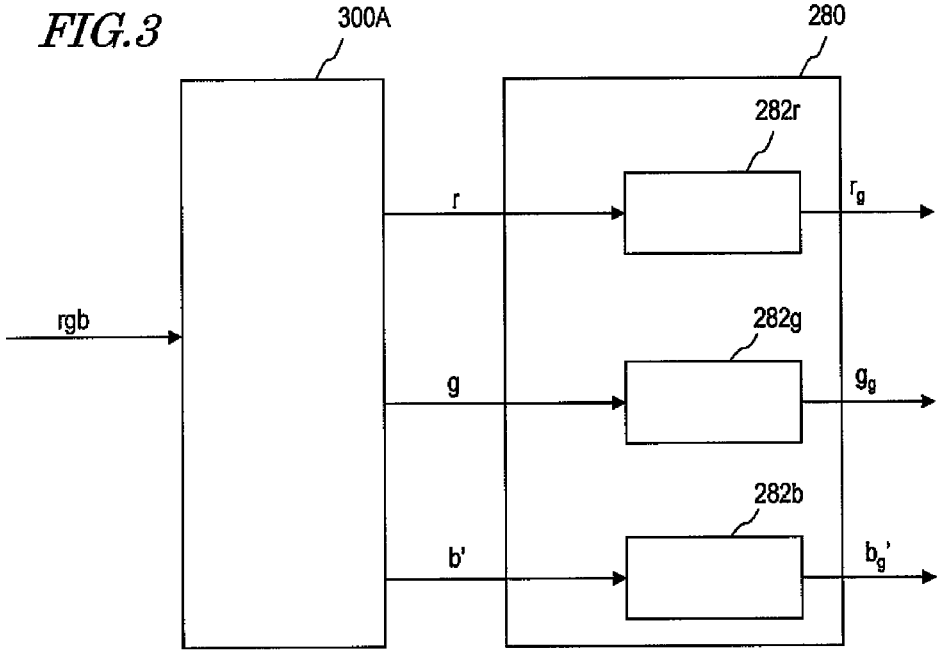
FIG. 3 A schematic diagram showing a structure of a correction section and an independent gamma correction processing section in the liquid crystal display device shown in FIG. 1.

Hereinafter, the components of the correction section 300A and the independent gamma correction processing section 280 and their operations in the liquid crystal display device 100A are described with reference to FIG. 3.

The grayscale levels rgb represented by the input signal are corrected in the correction section 300A at least under certain conditions. For example, the correction section 300A does not correct the grayscale levels r and g represented by the input signal but corrects the grayscale level b into the grayscale level b'. The details of this correction will be described later. The grayscale levels rgb' obtained by the correction in the correction section 300A are input to the independent gamma correction processing section 280.

The independent gamma correction processing section 280 includes a red processing section 282*r*, a green processing section 282*g*, and a blue processing section 282*b* which perform an independent gamma correction process on respective ones of the grayscale levels r, g, b'. The independent gamma correction process of the processing sections 282*r*, 282*g*, 282*b* converts the grayscale levels r, g, b' to the grayscale levels $r_g$, $g_g$, $b_g'$.

As described above, the variation in chromaticity of an achromatic color which occurs according to the change in lightness can be reduced by the independent gamma correction processing section 280. However, only with the independent gamma correction processing section 280, the variation in chromaticity of an achromatic color displayed by a pixel which would occur when viewed from the front viewing direction can be reduced, but when viewed from the oblique viewing direction, the chromaticity of the achromatic color varies so that the achromatic color may sometimes be perceived as having some hue. To overcome this problem, the liquid crystal display device 100A includes the correction section 300A for reducing the variation in chromaticity of an achromatic color for the oblique viewing direction.

Hereinafter, the advantages of the liquid crystal display device 100A of the present embodiment are described in comparison with liquid crystal display devices of Comparative Examples 1 and 2. The liquid crystal display device of Comparative Example 1 is first described. In the liquid crystal display device of Comparative Example 1, each subpixel is not divided into a plurality of regions, and each subpixel is formed by a single region. The liquid crystal display device of Comparative Example 1 does not include a component equivalent to the correction section 300A. It is assumed herein that an input signal input to the liquid crystal display device instructs that all the pixels arranged over the entire screen should display achromatic colors. As the lightness of an achromatic color changes from black to white, the grayscale levels of the respective subpixels in the input signal increase at equal rates. In the initial state, the achromatic color represented by the input signal is black, and the luminance of the red, green and blue subpixels is "0". As the grayscale levels of the red, green and blue subpixels increase at equal rates and the luminance of the red, green and blue subpixels increases, the lightness of the achromatic color increases. When the increasing luminance of the red, green and blue subpixels reaches "1", the achromatic color is white.

Figure 4:
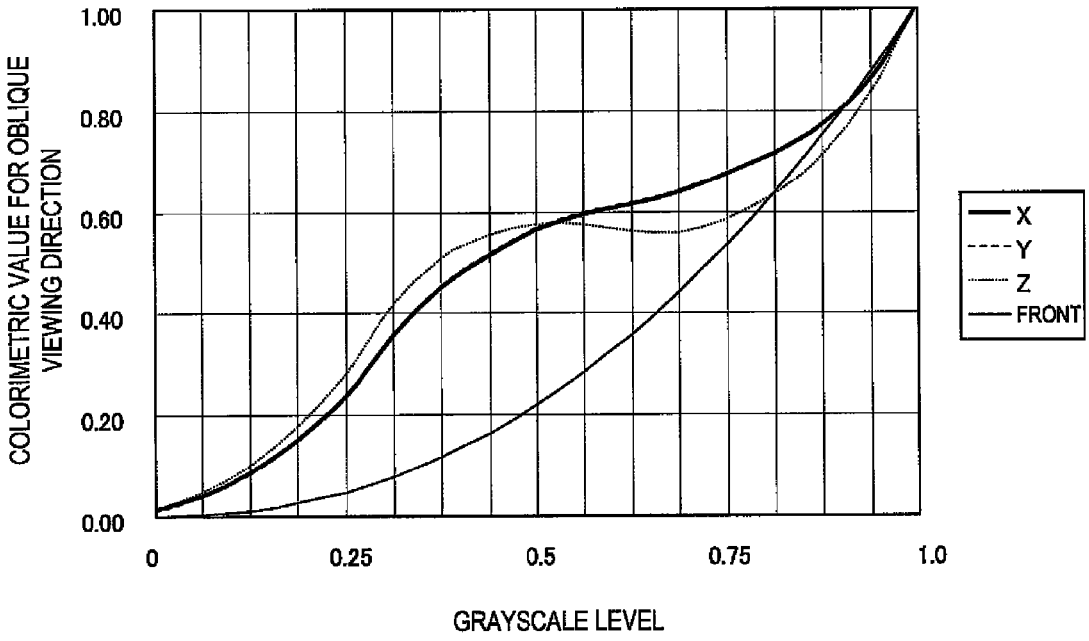
FIG. 4 A graph showing colorimetric values for the oblique viewing direction in a liquid crystal display device of Comparative Example 1.

FIG. 4 shows the measurement results of the colorimetric values of the X value, the Y value and the Z value for the oblique viewing direction with varying lightness of the achromatic color in a liquid crystal display device of Comparative Example 1. In FIG. 4, curves X, Y and Z respectively represent the change of the colorimetric values of the X value, the Y value and the Z value for the oblique viewing direction with respect to the variation of the grayscale level. In the liquid crystal display device of Comparative Example 1, the X value, the Y value and the Z value for the front viewing direction equally change, and therefore, in FIG. 4, the X value, the Y value and the Z value for the front viewing direction are collectively represented by a single curve labeled "front". The liquid crystal display device of Comparative Example 1 used herein is a VA-mode liquid crystal display device. The "oblique viewing direction" refers to a direction that is inclined from the normal to the screen by 60°. The grayscale levels of the respective subpixels vary at equal increase rates.

In the liquid crystal display device of Comparative Example 1, due to the independent gamma correction process, the X value, the Y value and the Z value for the front viewing direction change as designed, according to gamma value 2.2, with respect to the variation of the grayscale level. In this case, when normalized with the assumption that the luminance corresponding to the highest grayscale level (here, grayscale level 255) is 1, the luminance corresponding to a half grayscale level of the highest grayscale level (here, grayscale level 0.5) is 0.21, and the luminance corresponding to a quarter (¼) grayscale level of the highest grayscale level (here, grayscale level 0.25) is 0.05.

On the other hand, the change of the X value, the Y value and the Z value for the oblique viewing direction with respect to the variation of the grayscale level occurs in a different fashion from the change of the X value, the Y value and the Z value for the front viewing direction with respect to the variation of the grayscale level. Specifically, in the liquid crystal display device of Comparative Example 1, at middle grayscale levels, the X value, the Y value and the Z value for the oblique viewing direction are respectively higher than those for the front viewing direction, so that whitening occurs. The "whitening" phenomenon refers to a phenomenon that a displayed image looks more whitish as a whole when viewed from the oblique viewing direction than when viewed from the front viewing direction. For example, in the case where a human face is displayed, even though the expression of the human face can be visually perceived without an unnatural impression when viewed from the front viewing direction, the displayed human face looks whitish as a whole when viewed from the oblique viewing direction. Comparing the changes of the X value, the Y value and the Z value, the X value and the Y value change generally similarly, while the Z value is higher than the X value and the Y value in a low-middle grayscale level range but is lower than the X value and the Y value in a middle-high grayscale level range.

Next, a liquid crystal display device of Comparative Example 2 is described. The liquid crystal display device of Comparative Example 2 has basically the same configuration as that of the liquid crystal display device 100A of the present embodiment except that it does not include a component equivalent to the correction section 300A. In the liquid crystal display panel of the liquid crystal display device of Comparative Example 2, each of the subpixels includes a plurality of regions which can provide different luminances.

In the liquid crystal display device of Comparative Example 2, when the lightness of an achromatic color changes from black to white, the grayscale levels of the respective subpixels in the input signal increase at equal rates. Specifically, in the initial state, the color displayed by the pixel is black, and the luminances of the red, green and blue subpixels are "0". As the grayscale levels of the red, green and blue subpixels start to increase, the luminance of one of the divisional regions of each subpixel (which is to be a brighter region) starts to increase. Then, when the luminance of the brighter region increases to a predetermined value, the luminance of the other region (which is to be a darker region) starts to increase. In the liquid crystal display device of Comparative Example 2, as the grayscale levels of the red, green and blue subpixels increase at equal rates, the lightness of the achromatic color displayed by the pixel increases. When the increasing luminances of the red, green and blue subpixels reach "1", the color displayed by the pixel is white.

Figure 5:
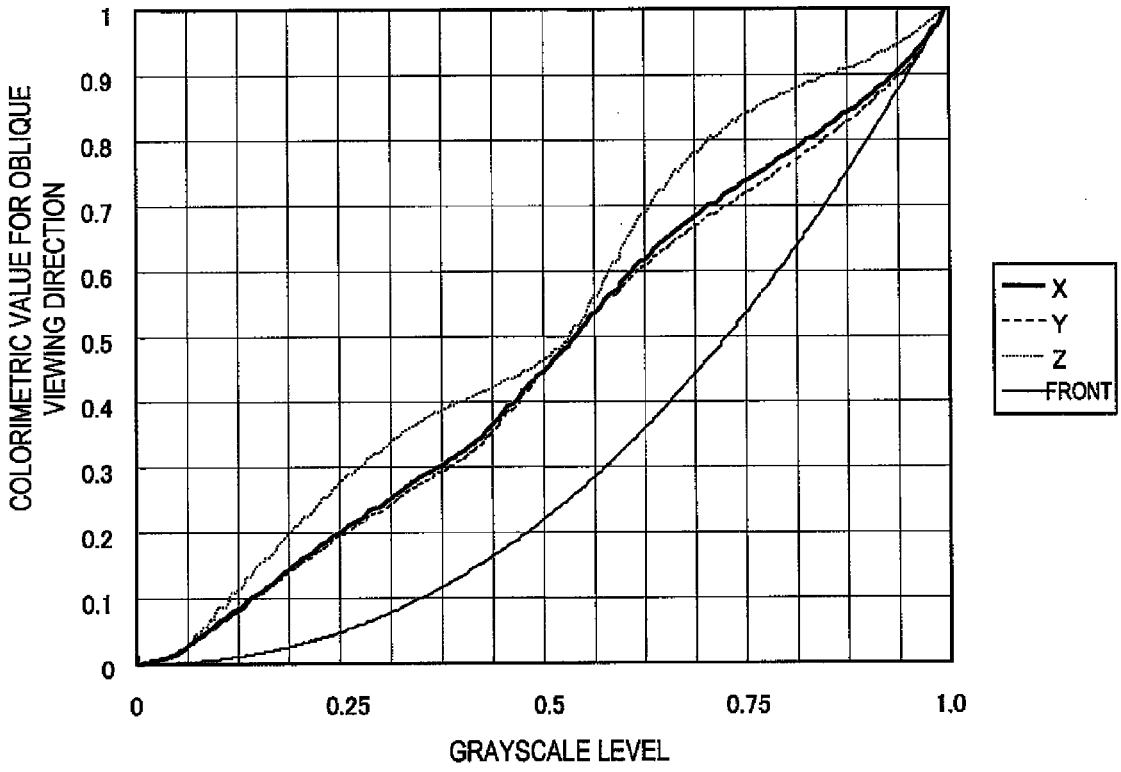
FIG. 5 A graph showing colorimetric values for the oblique viewing direction in a liquid crystal display device of Comparative Example 2.

In the liquid crystal display device of Comparative Example 2 which has such a configuration, when the color displayed by the pixel changes while it remains achromatic, the achromatic color looks yellowish at middle grayscale levels when viewed from the oblique viewing direction. FIG. 5 shows the results of measurement of the colorimetric values of the X value, the Y value and the Z value for the oblique viewing direction with varying lightness of the achromatic color in the liquid crystal display device of Comparative Example 2.

In FIG. 5, curves X, Y and Z respectively represent the change of the colorimetric values of the X value, the Y value and the Z value for the oblique viewing direction with respect to the variation of the grayscale level. In the liquid crystal display device of Comparative Example 2, the X value, the Y value and the Z value for the front viewing direction equally change, and therefore, in FIG. 5, the X value, the Y value and the Z value for the front viewing direction are collectively represented by a single curve labeled "front". The liquid crystal display device of Comparative Example 2 used herein is a common multi-pixel driving type liquid crystal display device. The "oblique viewing direction" refers to a direction that is inclined from the normal to the screen by 60°. The grayscale levels of the respective subpixels change at equal increase rates.

In the liquid crystal display device of Comparative Example 2, each subpixel has two divisional regions, so that the degree of whitening is low as compared with the liquid crystal display device of Comparative Example 1. With such a divisional subpixel configuration, the whitening phenomenon can be prevented. From the viewpoint of further preventing the whitening phenomenon, it is preferred that the X value, the Y value and the Z value for the oblique viewing direction are all as low as those for the front viewing direction over the range from low grayscale levels to high grayscale levels. Comparing the changes of the X value, the Y value and the Z value, the X value and the Y value change generally similarly, while the Z value is higher than the X value and the Y value in a low-middle grayscale level range but is generally equal to the X value and the Y value at middle grayscale levels, and the Z value is also higher than the X value and the Y value in a middle-high grayscale level range.

Thus, when the lightness is changed while the color is kept achromatic in the liquid crystal display device of Comparative Example 2, the Z value is higher than the X value and the Y value in a low-middle grayscale level range and in a middle-high grayscale level range, and the Z value is generally equal to the X value and the Y value at around middle grayscale levels. Therefore, comparing the color perceived when viewed from the oblique viewing direction with the color perceived when viewed from the front viewing direction, the color perceived when viewed from the oblique viewing direction looks to have a shift toward blue in a low-middle grayscale level range and in a middle-high grayscale level range, whereas the color shift is relatively small at around middle grayscale levels as compared with the color perceived when viewed from the front viewing direction.

On the other hand, when the grayscale level is changed while the viewing direction is fixed at the oblique viewing direction and the color is kept achromatic, the color perceived at middle grayscale levels relatively looks yellowish as compared with the color perceived at low and high grayscale levels. Thus, when the liquid crystal display device of Comparative Example 2 is viewed from the oblique viewing direction, an achromatic color at middle grayscale levels relatively looks to have a shift toward yellow. In the description below, a visual state where the achromatic color looks yellowish is referred to as "yellow shift".

To decrease such a "yellow shift", another correction is necessary in addition to the independent gamma correction process. A possible technique for decreasing the "yellow shift" is, for example, to appropriately control only the Z value for the oblique viewing direction without changing the X value or the Y value.

Specifically, a correction may be made by decreasing the Z value in a low-middle grayscale level range and in a middle-high grayscale level range such that the decreased Z value is equal to the X value and the Y value. By making a correction in this way, the chromaticity coordinates x, y for the oblique viewing direction become equal to the chromaticity coordinates x, y for the front viewing direction, so that the blue shift which is detected in a comparison between the color perceived when viewed from the oblique viewing direction and the color perceived when viewed from the front viewing direction can be decreased.

An alternative correction technique for decreasing the "yellow shift" is to increase the Z value at middle grayscale levels such that the Z value has similarity to the X value and the Y value. When making such a correction, the variation in chromaticity of the achromatic color which is perceived when viewed from the oblique viewing direction can be decreased, although the blue shift which is detected in a comparison between the color perceived when viewed from the oblique viewing direction and the color perceived when viewed from the front viewing direction cannot be decreased. No matter which technique is employed, it is necessary to appropriately control the Z value without changing the X value or the Y value.

Figure 6:
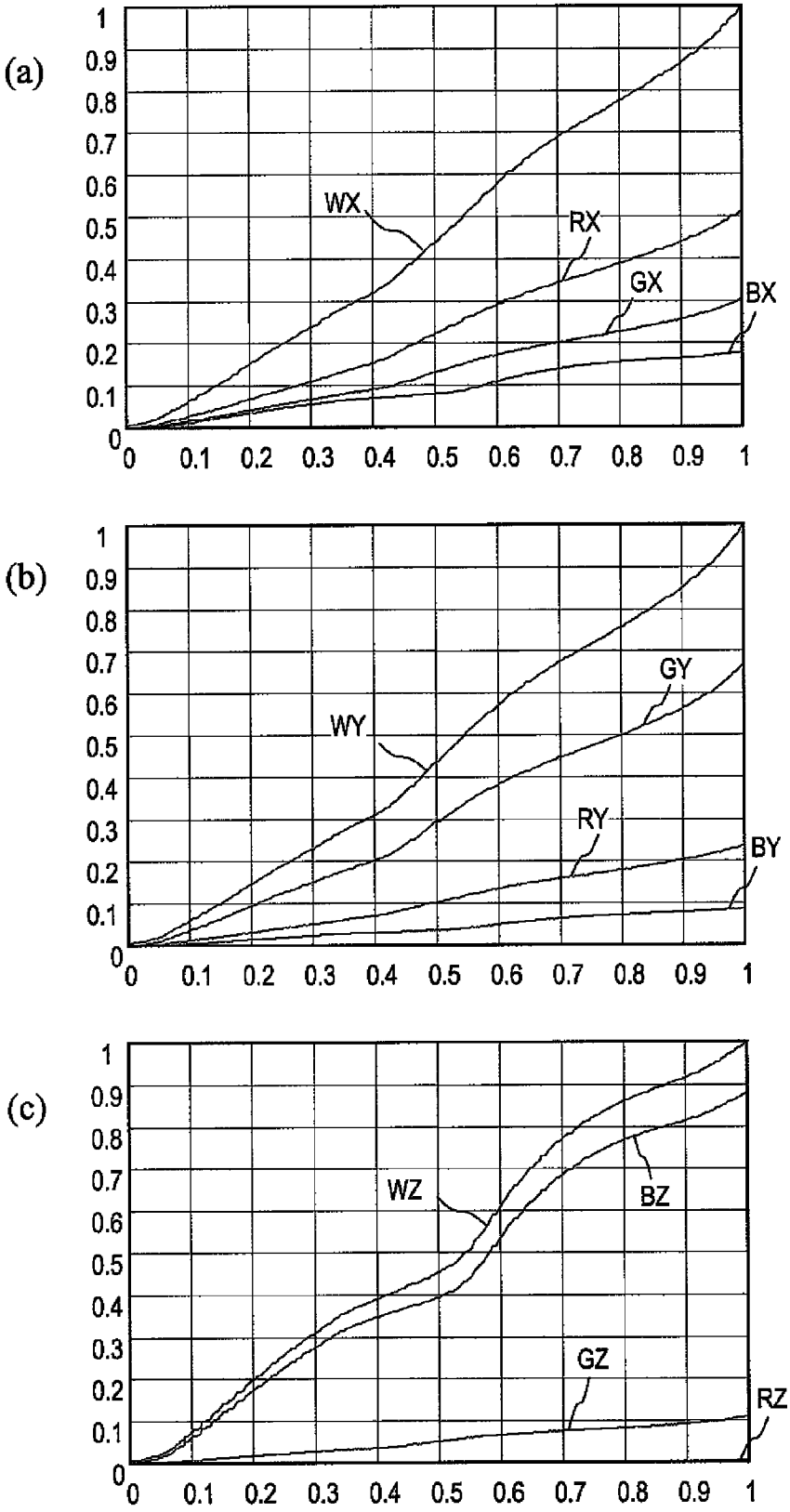
FIGS. 6(*a*) to (*c*) are graphs showing the change of the respective X to Z colorimetric values at respective grayscale levels in the liquid crystal display device of Comparative Example 2.

Here, the components of the X value, the Y value and the Z value corresponding to the respective pixels are discussed. Hereinafter, the variation of the components of the respective subpixels of the X value, the Y value and the Z value corresponding to the grayscale level of the achromatic color in the input signal is described with reference to FIG. 6. In FIGS. 6(*a*) to 6(*c*), WX, WY and WZ represent the variations of the colorimetric values X, Y and Z when an achromatic color after a color temperature adjustment is viewed from the oblique viewing direction. RX, RY and RZ represent the colorimetric values X, Y and Z obtained when only one red subpixel is lit, which are respectively normalized with the values of WX, WY and WZ at the highest grayscale level. GX, GY and GZ represent the equivalent colorimetric values X, Y and Z for the green subpixel. BX, BY and BZ represent the equivalent colorimetric values X, Y and Z for the blue subpixel. Note that WX is the sum of RX, GX and BX, WY is the sum of RY, GY and BY, and WZ is the sum of RZ, GZ and BZ.

As seen from FIG. 6(*c*), the major component of WZ is BZ. As seen from FIGS. 6(*a*) and 6(*b*), the proportions of BX and BY in WX and WY are small. Therefore, adjustment of the luminance of the blue subpixel greatly affects the Z value but scarcely affects the X value and the Y value. It is thus understood that, by adjusting the luminance of the blue subpixel, the Z value can be efficiently adjusted without substantially affecting the X value or the Y value. The present inventor found based on the above knowledge that, to making the change of the Z value agreeable to the change of the X value and the Y value, correcting the grayscale level of the blue subpixel is efficient, and that by performing an adjustment of the luminance of the blue subpixels by the unit of multiple blue subpixels whose luminance can be independently controlled, the Z value for the oblique viewing direction can be changed without changing the Z value for the front viewing direction.

In the liquid crystal display device 100A of the present embodiment, the correction section 300A shown in FIG. 1(*a*) performs, at least under certain conditions, an adjustment of the luminance of the blue subpixels by the unit of blue subpixels included in two adjacent pixels. For example, even when the blue subpixels included in two adjacent pixels are at equal grayscale levels in the input signal, the correction section 300A makes a grayscale level correction such that the two blue subpixels have different luminances in the liquid crystal display panel 200A. Note that, in the description below, one of the two blue subpixels which has the higher luminance is referred to as "brighter blue subpixel", and the other blue subpixel which has the lower luminance is referred to as "darker blue subpixel". The sum of the luminances of the blue subpixels included in the two adjacent pixels in the liquid crystal display panel 200A is equivalent to the sum of the luminance levels which correspond to the grayscale levels of the two adjacent blue subpixels represented by the input signal. For example, the correction section 300A makes a correction to the grayscale levels of the blue subpixels included in two adjacent pixels that are placed side by side along the row direction.

Here, it is assumed that all the pixels in the input signal represent an achromatic color at the same grayscale level, and this grayscale level is referred to as the reference grayscale level. When without the independent gamma correction process, in the liquid crystal display device of Comparative Example 1, the luminance of each blue subpixel is equal to a luminance which corresponds to the reference grayscale level. In the liquid crystal display device of Comparative Example 2, the divisional regions of the blue subpixel have different luminances, but the whole area of each blue subpixel has an equal luminance to the luminance which corresponds to the reference grayscale level.

On the other hand, in the liquid crystal display device 100A of the present embodiment, the correction section 300A increases the luminance of one of the blue subpixels included in two adjacent pixels by shift amount $\Delta S\alpha$ and decrease the luminance of the other blue subpixel by shift amount $\Delta S\beta$. Therefore, the blue subpixels included in the adjacent pixels have different luminances, the luminance of the brighter blue subpixel is higher than the luminance which corresponds to the reference grayscale level, and the luminance of the darker blue subpixel is lower than the luminance which corresponds to the reference grayscale level. For example, the difference between the luminance of the brighter blue subpixel and the luminance which corresponds to the reference grayscale level is generally equal to the difference between the luminance which corresponds to the reference grayscale level and the luminance of the darker blue subpixel. Ideally, $\Delta S\alpha=\Delta S\beta$. As described above, each of the subpixels of the liquid crystal display panel 200A has multiple divisional regions. The brighter blue subpixel includes a brighter region and a darker region, and the darker blue subpixel includes a brighter region and a darker region. The luminance of the brighter region of the brighter blue subpixel is higher than that of the brighter region of the darker blue subpixel. The luminance of the darker region of the darker blue subpixel is lower than that of the darker region of the brighter blue subpixel.

Figure 7:
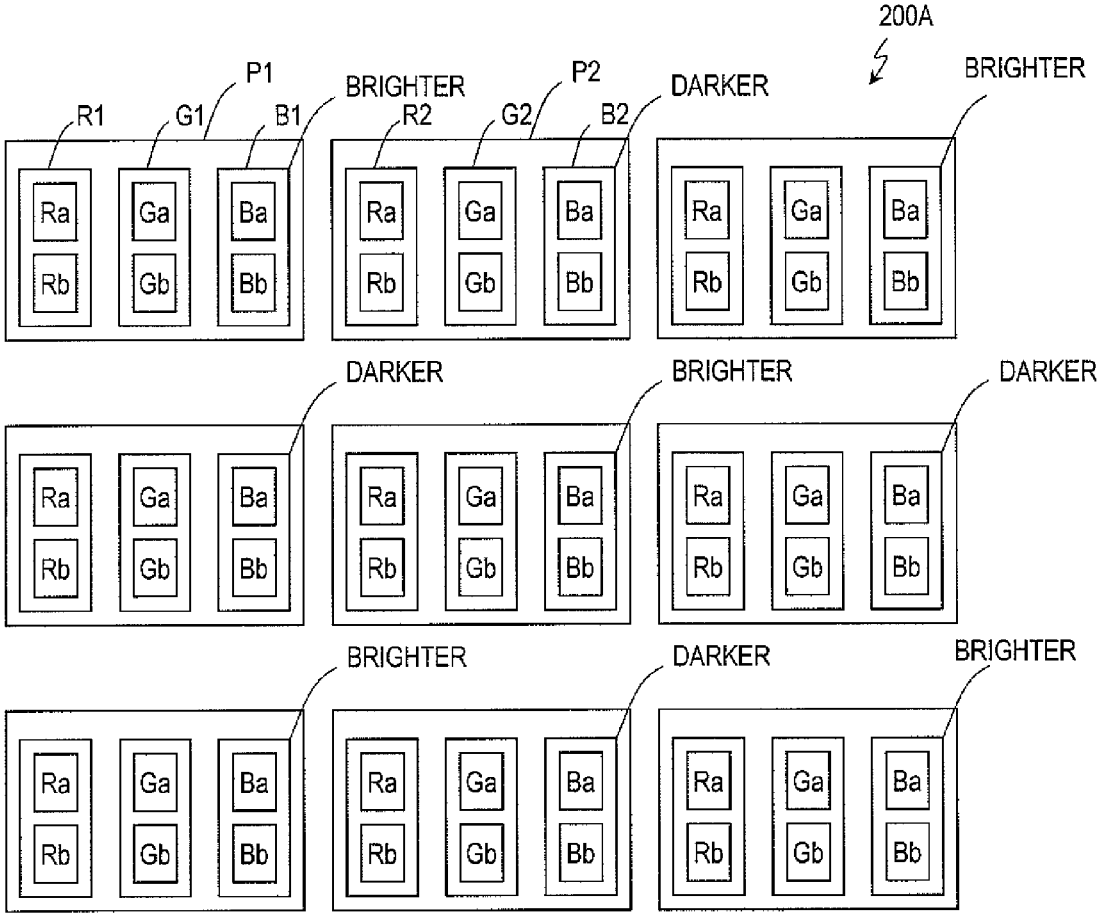
FIG. 7 A schematic diagram showing blue subpixels of the liquid crystal display panel of the liquid crystal display device shown in FIG. 1.

FIG. 7 shows the liquid crystal display panel 200A of the liquid crystal display device 100A. In FIG. 7, two adjacent pixels that are placed side by side along the row direction are now discussed, one of which is labeled "P1", and the other labeled "P2". The red, green and blue subpixels included in the pixel P1 are labeled "R1", "G1" and "B1". The red, green and blue subpixels included in the pixel P2 are labeled "R2", "G2" and "B2".

For example, when the color displayed by all the pixels in the input signal is an achromatic color at a middle grayscale level, the luminances of the red and green subpixels R1, G1, which are included in one of the two adjacent pixels, pixel P1, are respectively equal to the luminances of the red and green subpixels R2, G2, which are included in the other one of the two adjacent pixels, pixel P2, in the liquid crystal display panel 200A. However, in the liquid crystal display panel 200A, the luminance of the blue subpixel B1 included in the pixel P1 that is one of the two adjacent pixels is different from the luminance of the blue subpixel B2 included in the other pixel P2. Note that, in FIG. 7, the blue subpixels included in adjacent pixels that are placed side by side along the row direction have opposite brightness levels. As for the blue subpixels included in the pixels of a certain row, blue subpixels which have higher luminances than the luminance which corresponds to the reference grayscale level and blue subpixels which have lower luminances than the luminance which corresponds to the reference grayscale level are alternately arranged. Also, the blue subpixels included in adjacent pixels that are placed side by side along the column direction have opposite brightness levels.

Figure 8:
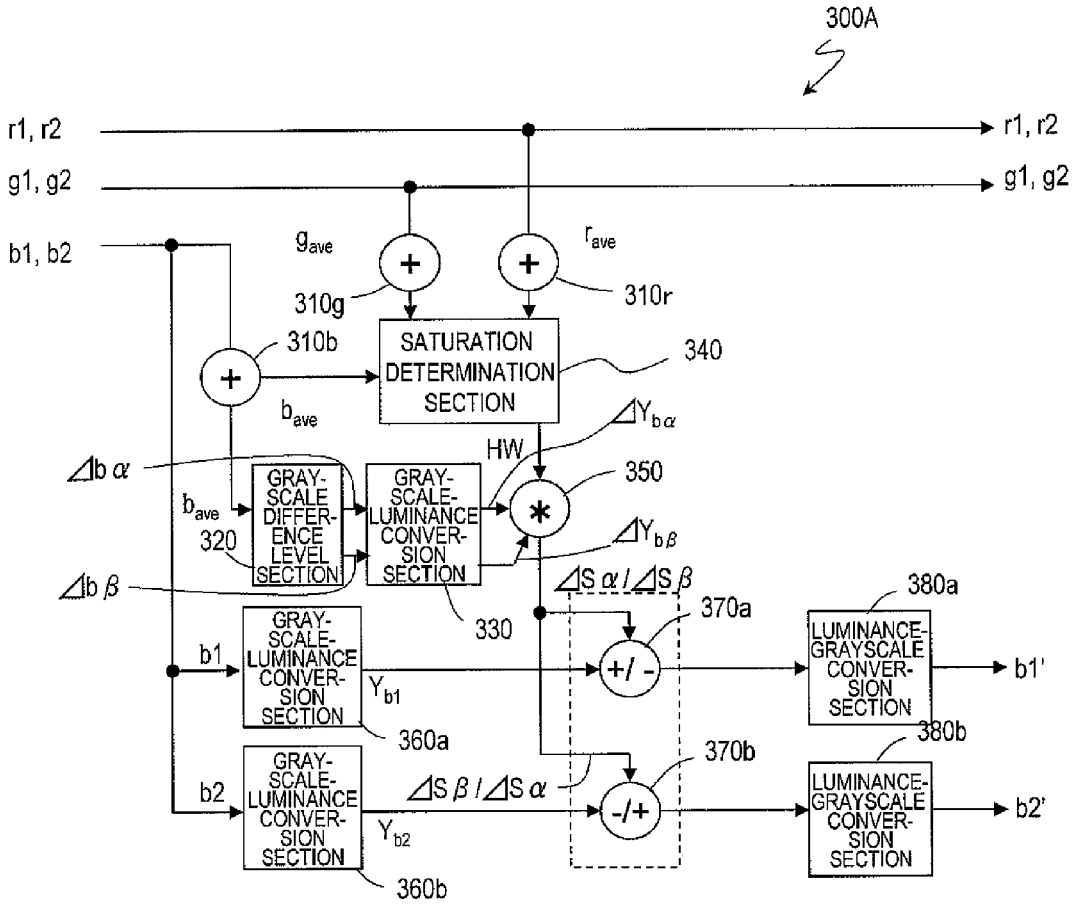
FIG. 8 A schematic diagram showing a configuration of a correction section of the liquid crystal display device shown in FIG. 1.

Hereinafter, a specific configuration of the correction section 300A is described with reference to FIG. 8. In FIG. 8, the grayscale levels r1, g1 and b1 represented by the input signal are equivalent to the grayscale levels of the subpixels R1, G1 and B1 included in the pixel P1. The grayscale levels r2, g2 and b2 represented by the input signal are equivalent to the grayscale levels of the subpixels R2, G2 and B2 included in the pixel P2.

The correction section 300A makes a correction to the grayscale level of the blue subpixel such that the change of the Z value is identical with, or has similarity to, the change of the X value and the Y value. The grayscale levels r1, r2, g1 and g2 are not corrected in the correction section 300A, whereas the grayscale levels b1 and b2 are corrected as described below. The correction section 300A calculates the shift amounts ΔSα, ΔSβ of the luminance levels of the blue subpixels B1, B2. As previously described, when an achromatic color is displayed, a yellow shift may mainly occur at middle grayscale levels but would not occur at low and high grayscale levels. Therefore, the shift amounts ΔSα, ΔSβ are zero or small at low and high grayscale levels, but they are large at middle grayscale levels.

First, an addition section 310*b* is used to obtain the average of the grayscale level b1 and the grayscale level b2. In the description below, the average of the grayscale levels b1 and b2 is referred to as "average grayscale level $b_{ave}$".

A grayscale difference level section 320 generates two grayscale difference levels Δbα, Δbβ from one average grayscale level $b_{ave}$. The grayscale difference level Δbα corresponds to the brighter blue subpixel, and the grayscale difference level Δbβ corresponds to the darker blue subpixel.

In this way, the grayscale difference level section 320 generates two grayscale difference levels Δbα, Δbβ from the average grayscale level $b_{ave}$. The average grayscale level $b_{ave}$ and the grayscale difference levels Δbα, Δbβ have, for example, a predetermined relationship shown in FIG. 9(*a*). When the average grayscale level $b_{ave}$ is a low grayscale level or a high grayscale level, the grayscale difference level Δbα and the grayscale difference level Δbβ are approximately zero. When the average grayscale level $b_{ave}$ is a middle grayscale level, the grayscale difference level Δbα and the grayscale difference level Δbβ are relatively large. The grayscale difference level section 320 may refer to a lookup table for the average grayscale level $b_{ave}$ to determine the grayscale difference levels Δbα, Δbβ. Alternatively, the grayscale difference level section 320 may perform a predetermined operation to determine the grayscale difference levels Δbα, Δbβ based on the average grayscale level $b_{ave}$.

Next, a grayscale-luminance conversion section 330 converts the grayscale difference level Δbα to the luminance difference level $\Delta Y_b\alpha$, and the grayscale difference level Δbβ to the luminance difference level $\Delta Y_b\beta$. As the luminance difference levels $\Delta Y_b\alpha$, $\Delta Y_b\beta$ increase, the shift amounts ΔSα, ΔSβ also increase.

A yellow shift is less perceivable as the saturation of the color of a pixel which is represented by the input signal increases. On the contrary, a yellow shift is more conspicuous as the color of a pixel which is represented by the input signal is closer to an achromatic color. Thus, the degree of a yellow shift varies depending on the color of a pixel which is represented by the input signal. The color of a pixel which is represented by the input signal is reflected in the shift amounts ΔSα, Δsβ as described below.

An addition section 310*r* is used to obtain the average of the grayscale level r1 and the grayscale level r2. Meanwhile, an addition section 310*g* is used to obtain the average of the grayscale level g1 and the grayscale level g2. In the description below, the average of the grayscale levels r1 and r2 is referred to as "average grayscale level $r_{ave}$", and the average of the grayscale levels g1 and g2 is referred to as "average grayscale level $g_{ave}$".

A saturation determination section 340 determines the saturation of a pixel which is represented by the input signal. The saturation determination section 340 utilizes the average grayscale levels $r_{ave}$, $g_{ave}$, $b_{ave}$ to determine saturation factor HW. The saturation factor HW is a function which decreases as the saturation increases. In the description below, where MAX=MAX ($r_{ave}$, $g_{ave}$, $b_{ave}$) and MIN=MIN ($r_{ave}$, $g_{ave}$, $b_{ave}$) the saturation factor HW is expressed as, for example, HW=MIN/MAX. It should be noted, however, that when $b_{ave}=0$, the saturation factor HW is 0. Alternatively, only the saturation for blue may be considered. For example, when $b_{ave} \geq r_{ave}$, $b_{ave} \geq g_{ave}$ and $b_{ave}>0$, the saturation factor is expressed as HW=MIN/MAX. When at least one of $b_{ave}<r_{ave}$ and $b_{ave}<g_{ave}$ is met, the saturation factor may be HW=1.

Next, the shift amounts ΔSα, ΔSβ are calculated. The shift amount ΔSα is represented by the product of $\Delta Y_b\alpha$ and the saturation factor HW, and the shift amount Δsβ is represented by the product of $\Delta Y_b\beta$ and the saturation factor HW. A multiplication section 350 multiplies the luminance difference levels $\Delta Y_b\alpha$, $\Delta Y_b\beta$ by the saturation factor HW to obtain the shift amounts ΔSα, Δsβ.

A grayscale-luminance conversion section 360*a* performs a grayscale-luminance conversion on the grayscale level b1 to obtain luminance level $Y_{b1}$. The luminance level $Y_{b1}$ is obtained according to, for example, the following formula:

$$Y_{b1}=b1^{2.2} \text{ (where } 0 \leq b1 \leq 1).$$

Likewise, a grayscale-luminance conversion section 360*b* performs a grayscale-luminance conversion on the grayscale level b2 to obtain luminance level $Y_{b2}$.

Then, in an addition/subtraction section 370*a*, the luminance level $Y_{b1}$ and the shift amount ΔSα are added together, and a luminance-grayscale conversion section 380*a* performs a luminance-grayscale conversion to obtain corrected grayscale level b1'. Meanwhile, in an addition/subtraction section 370*b*, the shift amount Δsβ is subtracted from the luminance level $Y_{b2}$, and then, a luminance-grayscale conversion section 380*b* performs a luminance-grayscale conversion to obtain corrected grayscale level b2'. Thereafter, in the independent gamma correction processing section 280 shown in FIG. 1, a independent gamma correction process is performed on the grayscale levels r1, r2, g1, g2, b1' and b2', and the corrected grayscale levels are input to the liquid crystal display panel 200A.

Figure 9:
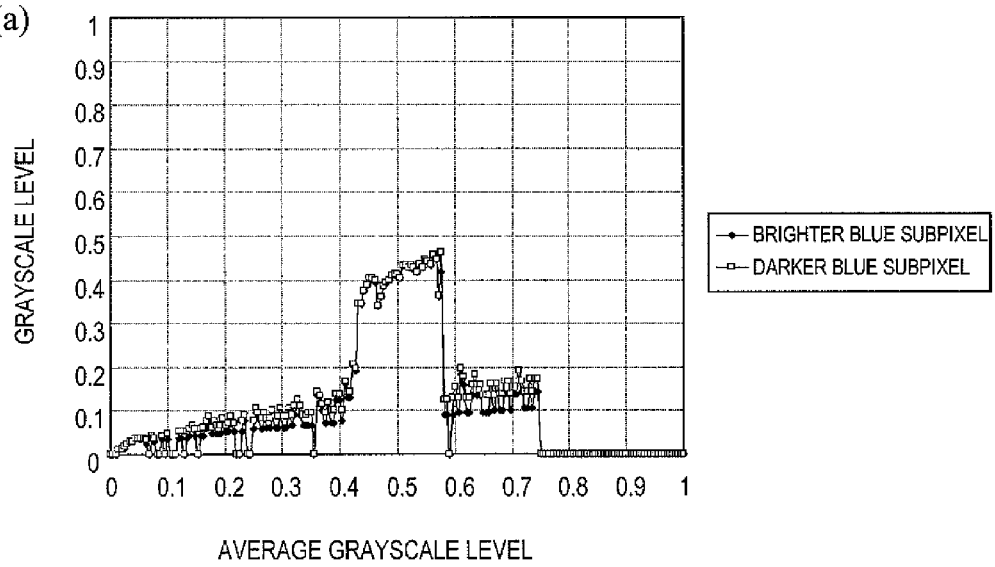
FIG. 9(*a*) is a graph showing the grayscale difference level in the liquid crystal display device shown in FIG. 1. (*b*) is a graph showing the grayscale level which is input to the liquid crystal display panel.
Figure 9:
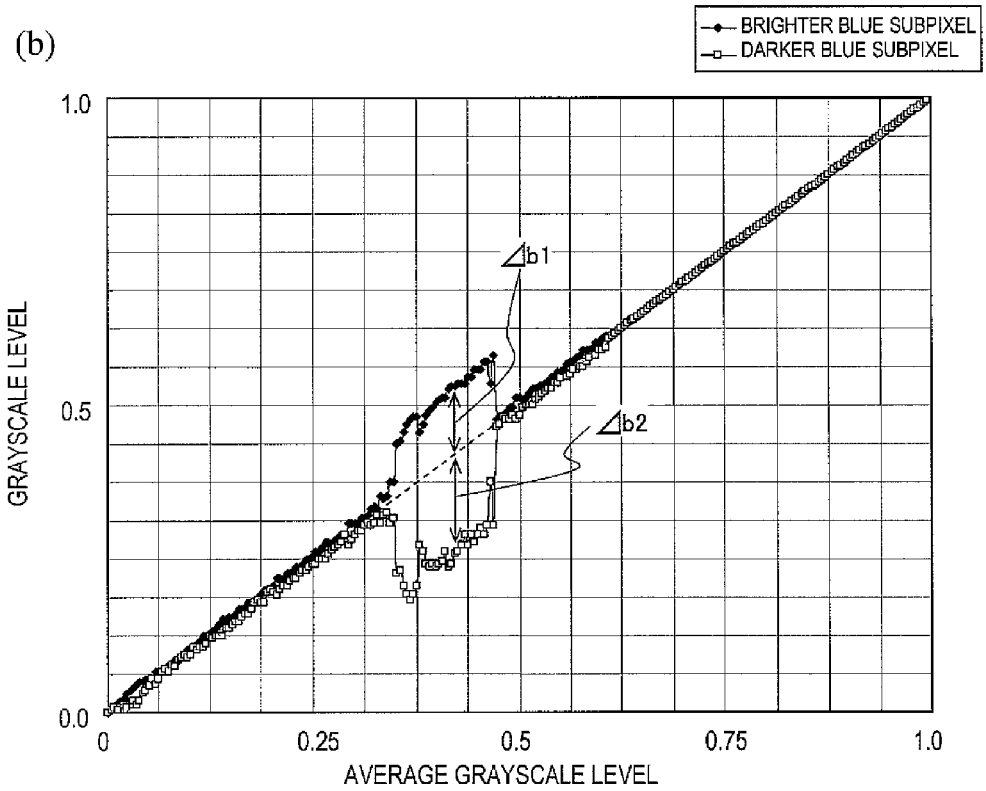

FIG. 9(*b*) shows the grayscale level of the blue subpixel which is to be input to the liquid crystal display panel 200A. Here, the color represented by the input signal is an achromatic color, and the saturation factor HW is 1. When the independent gamma correction process is neglected, the grayscale level b1' is b1+Δb1 and the grayscale level b2' is b2−Δb2 because of the grayscale difference levels Δbα, Δbβ generated in the grayscale difference level section 320. Based on the thus-obtained grayscale levels b1', b2', the blue subpixel B1 exhibits a luminance which is equivalent to the sum of the luminance level $Y_{b1}$ and the shift amount ΔSα, and the blue subpixel B2 exhibits a luminance which is equivalent to the difference between the luminance level $Y_{b2}$ and the shift amount ΔSβ.

Now, refer to FIG. 8. As an example, it is assumed that the grayscale levels b1, b2 in the input signal are grayscale level 0.5, and that the grayscale levels r1, r2, g1 and g2 in the input signal are grayscale level 0.5. In this case, due to the grayscale-luminance conversion in the grayscale-luminance conversion sections 360*a*, 360*b*, the luminance levels $Y_{b1}$, $Y_{b2}$ are each 0.218 ($=0.5^{2.2}$). Here, $\Delta Y_b\alpha$, $\Delta Y_b\beta$ are each 0.133 ($=0.4^{2.2}$), and the saturation factor HW is 1. Therefore, the shift amounts ΔSα, ΔSβ are each 0.133. In this case, where the highest grayscale level is numbered "255", the grayscale level b1' obtained in the luminance-grayscale conversion section 380*a* is grayscale level 158 (=$(0.218+0.133)^{1/2.2}\times255$). The grayscale level b2' obtained in the luminance-grayscale conversion section 380*b* is 82 (=$(0.218-0.133)^{1/2.2}\times255$) where the highest grayscale level is numbered "255". Note that, in the liquid crystal display panel 200A of the liquid crystal display device 100A, as previously described, each of the blue subpixels includes divisional regions which can have different luminances, the average luminance of the brighter region and the darker region of the brighter blue subpixel is equivalent to grayscale level 158, and the average luminance of the brighter region and the darker region of the darker blue subpixel is equivalent to grayscale level 82. From the above, the results of addition and subtraction of the shift amounts $\Delta S\alpha$ and $\Delta S\beta$ which are equivalent to equal luminance difference levels $\Delta Y_b\alpha$ and $\Delta Y_b\beta$ are converted to grayscale levels, and the resultant grayscale levels are compared with the grayscale levels obtained before the correction, resulting in $\Delta b1=30(=158-128)$ and $\Delta b2=46(=128-82)$. Thus, $\Delta b1$ and $\Delta b2$ do not have equal values.

In the correction section 300A, the shift amounts $\Delta S\alpha$, $\Delta S\beta$ are expressed as a function which includes the saturation factor HW as a parameter. For example, when ($r_{ave}$, $g_{ave}$, $b_{ave}$) is (128, 128, 128) where the highest grayscale level is numbered "255", the shift amounts $\Delta S\alpha$, $\Delta S\beta$ are 0.133 because the saturation factor HW is 1. On the other hand, when ($r_{ave}$, $g_{ave}$, $b_{ave}$) is (0, 0, 128), i.e., when there are unlit subpixels, the saturation factor HW is 0, and the shift amounts $\Delta S\alpha$, $\Delta S\beta$ are 0. When ($r_{ave}$, $g_{ave}$, $b_{ave}$) is (64, 64, 128) which is in the middle of the above example values, HW=0.5. The shift amounts $\Delta S\alpha$, $\Delta S\beta$ are $0.133\times0.5$ (which is a half of the shift amount for HW 1.0). In this way, a correction to the blue subpixel included in a pixel which is represented by the input signal is carried out according to the saturation of the pixel represented by the input signal. The shift amounts $\Delta S\alpha$, $\Delta S\beta$ continuously change according to the saturation of the pixel in the input signal, so that an abrupt change in the display characteristics can be prevented. FIG. 9(*b*) is a graph which shows the results obtained when the saturation factor HW is 1. When the saturation factor HW is 0 (for example, a blue color which has a high saturation is represented by the input signal), the grayscale level b1(=b2) represented by the input signal and the grayscale levels b1', b2' have equal values. In this way, by using the saturation factor HW, a grayscale level which is equivalent to the grayscale level of the blue subpixel in the input signal is output when there is an unlit subpixel, so that the deterioration of the blue resolution would not occur. On the other hand, when the grayscale levels of the respective subpixels are equal in the input signal, strictly speaking, a deterioration of the blue resolution occurs. However, in the actuality, the deterioration of the blue resolution in an achromatic color, or a color which is close to the achromatic color, is negligibly small for the human visual properties. Since the saturation factor HW is a function which continuously changes between a situation where there is an unlit subpixel and a situation where the color displayed is an achromatic color, abrupt change in display can be avoided.

As previously described, in the liquid crystal display panel 200A, a pixel includes multiple divisional regions. The grayscale level b1' of the blue subpixel B1 is realized by a brighter region and a darker region. The grayscale level b2' of the blue subpixel B2 is realized by a brighter region and a darker region. Note that, when multi-pixel driving is performed, the distribution of the luminance levels $Y_{b1}$, $Y_{b2}$ among the regions Ba, Bb of the blue subpixels B1 and B2 depends on the configuration of the liquid crystal display panel 200A and its design values, although the details thereof are not described herein. Specific design values are determined such that the average of the luminances of the regions Ba and Bb of the blue subpixel B1 is equal to the luminance which corresponds to the grayscale level b1' or b2' of the blue subpixel. Although the multi-pixel driving is performed in the above description, the present invention is not limited to the multi-pixel driving so long as the distribution of the luminance among the regions Ba, Bb is determined depending on the configuration of the liquid crystal display panel 200A as described above.

Figure 10:
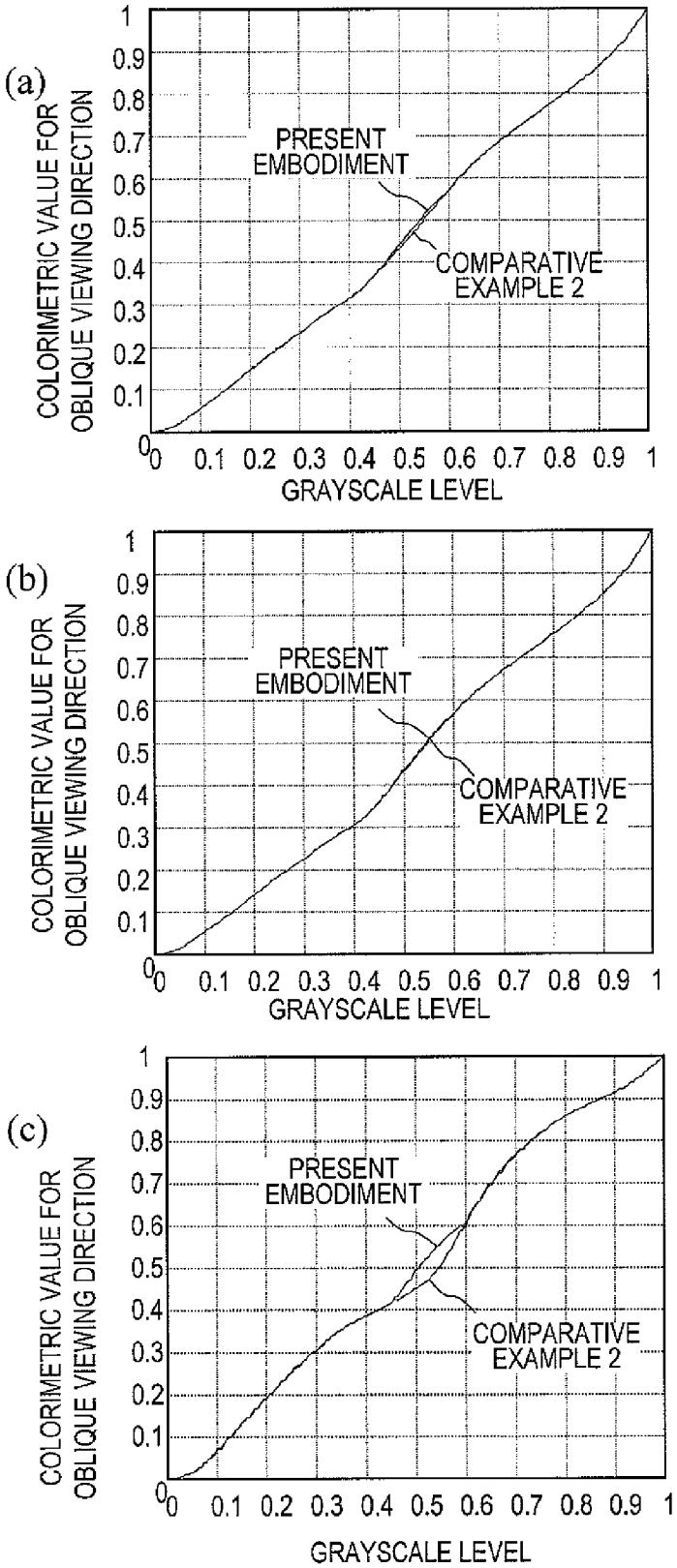
FIGS. 10(*a*) to (*c*) are graphs showing the change of the respective X to Z colorimetric values at respective grayscale levels in the liquid crystal display device shown in FIG. 1.

FIGS. 10(*a*) to 10(*c*) are the graphs of the colorimetric values X to Z with respect to the grayscale level of an achromatic color in the liquid crystal display device 100A. In FIGS. 10(*a*) to 10(*c*), the results of the liquid crystal display device of Comparative Example 2, which are represented by curves WX, WY, WZ in FIGS. 6(*a*) to 6(*c*), are also shown for the sake of comparison. It is understood from FIGS. 10(*a*) to 10(*c*) that, by making a correction to the grayscale level of the blue subpixel, the Z value greatly differs from that of Comparative Example 2 at middle grayscale levels, whereas the change of the X value and the Y value is basically the same as that in the liquid crystal display device of Comparative Example 2. Thus, the grayscale level of the blue subpixel can be corrected such that the change of the Z value has similarity to the change of the X value and the Y value.

Figure 11:
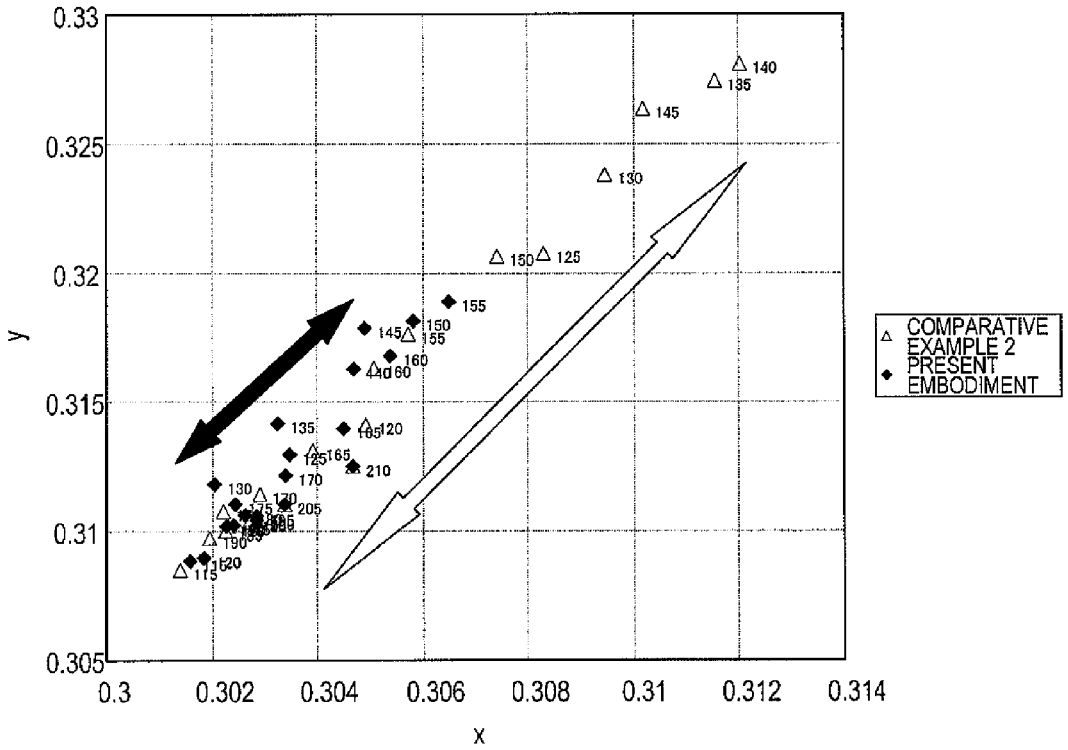
FIG. 11 A graph showing the xy chromaticity coordinates of an achromatic color at respective grayscale levels in the liquid crystal display device of Comparative Example 2 and the liquid crystal display device shown in FIG. 1.

FIG. 11 shows the chromaticity coordinates x and y of an achromatic color for the oblique viewing direction at middle grayscale levels (here, grayscale levels 115 to 210 where the highest grayscale level is numbered "255") of the liquid crystal display device 100A. In FIG. 11, the chromaticity coordinates x and y in the liquid crystal display device of Comparative Example 2 are also shown for the sake of comparison. Note that, herein, x (=X/(X+Y+Z)) and y (=Y/(X+Y+Z)) are shown, rather than the X value and the Y value. As seen from FIG. 11, in the liquid crystal display device of Comparative Example 2, the chromaticity of the achromatic color for the oblique viewing direction relatively greatly varies according to the variation of the grayscale level in the range of the middle grayscale levels. However, in the liquid crystal display device 100A of the present embodiment, the variation in chromaticity of the achromatic color is reduced irrespective of the variation of the grayscale level.

As described above, the liquid crystal display device 100A of the present embodiment includes the correction section 300A for making a correction to the grayscale levels b1, b2 to obtain corrected grayscale levels b1', b2', so that a deviation of the Z value relative to the X value and the Y value which would occur when viewed from the oblique viewing direction can be reduced, and the reduction of the yellow shift can be realized at low cost.

In the liquid crystal display device 100A, the blue subpixels of the two adjacent pixels have different grayscale-luminance characteristics (i.e., different gamma characteristics). In this case, strictly, the colors displayed by the two adjacent pixels are different. However, if the resolution of the display device 100A is sufficiently high, a human eye perceives the average color of the colors displayed by the two adjacent pixels. Thus, the X value, the Y value and the Z value for the front viewing direction exhibit equal grayscale-luminance characteristics, and also, the X value, the Y value and the Z value for the oblique viewing direction exhibit equal grayscale-luminance characteristics. Therefore, occurrence of a yellow shift can be prevented without substantially changing the display quality for the front viewing direction, so that the display quality for the oblique viewing direction can be improved.

In the example described herein, the yellow shift is reduced by adjusting the luminance of the blue subpixels although, theoretically, the yellow shift can be reduced by adjusting the luminance of other subpixels. However, the blue subpixel has a relatively small influence on the X value and the I value but a large influence on the Z value. Therefore, it is appreciated that the present invention is particularly effective for a liquid crystal display panel in which, for the oblique viewing direction, the change of the Z value greatly differs from the change of the X value and the Y value.

It is known that the resolution of the human eye for blue is lower than for the other colors. Particularly, in the case where respective subpixels included in a pixel are lit for displaying an achromatic color at a middle grayscale level, if a subpixel whose resolution nominally decreases is the blue subpixel, a substantial decrease in resolution is less perceivable. As seen from this fact, a correction to the grayscale level of the blue subpixel is more effective than a correction to the grayscale level of any other subpixel.

In the above description, the grayscale level b1 represented by the input signal is equal to the grayscale level b2, although the present invention is not limited to this example. The grayscale level b1 represented by the input signal may be different from the grayscale level b2. When the grayscale level b1 is different from the grayscale level b2, the luminance level $Y_{b1}$ that has undergone a grayscale-luminance conversion in the grayscale-luminance conversion section 360*a* shown in FIG. 8 is different from the luminance level $Y_{b2}$ that has undergone a grayscale-luminance conversion in the grayscale-luminance conversion section 360*b*. Especially when there is a large difference in grayscale level between adjacent pixels, such as when text data is displayed, the difference between the luminance level $Y_{b1}$ and the luminance level $Y_{b2}$ is significantly large.

Figure 12:
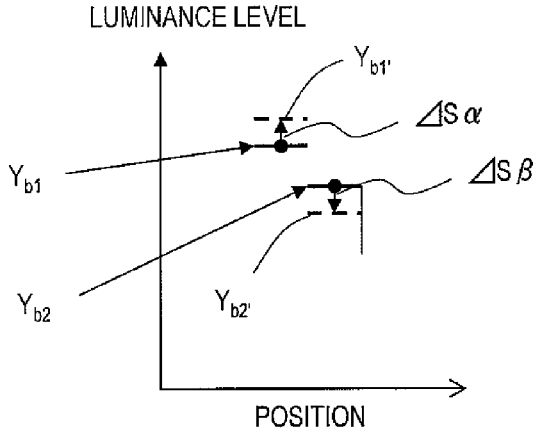
FIG. 12 A schematic diagram showing the change of the luminance level in the case where the blue subpixels included in adjacent pixels are at different grayscale levels in the liquid crystal display device shown in FIG. 1.

Specifically, when the grayscale level b1 is higher than the grayscale level b2, the sum of the luminance level $Y_{b1}$ and the shift amount $\Delta S\alpha$ undergoes a luminance-grayscale conversion in the luminance-grayscale conversion section 380*a*, and the difference between the luminance level $Y_{b2}$ and the shift amount $\Delta S\beta$ undergoes a luminance-grayscale conversion in the luminance-grayscale conversion section 380*b*. In this case, as illustrated in FIG. 12, the luminance level $Y_{b1'}$ corresponding to the grayscale level b1' is higher than the luminance level $Y_{b1}$ corresponding to the grayscale level b1 by the shift amount $\Delta S\alpha$, and the luminance level $Y_{b2'}$ corresponding to the grayscale level b2' is lower than the luminance level $Y_{b2}$ corresponding to the grayscale level b2 by the shift amount $\Delta S\beta$, so that the difference between the luminance corresponding to the grayscale level b1' and the luminance corresponding to the grayscale level b2' is greater than the difference between the luminance corresponding to the grayscale level b1 and the luminance corresponding to the grayscale level b2.

Now, four pixels P1 to P4 which are arranged in two rows and two columns are discussed. The pixels P1 to P4 are arranged at the left upper, right upper, left lower and right lower positions, respectively. The grayscale levels of the blue subpixels in the input signal corresponding to the pixels P1 to P4 are denoted by b1 to b4. As previously described with reference to FIG. 7, when the subpixels in the input signal represent the same color, i.e., when the grayscale levels b1 to b4 are equal to one another, the grayscale level b1' is higher than the grayscale level b2', and the grayscale level b4' is higher than the grayscale level b3'.

Also, it is assumed that, in the input signal, the pixels P1, P3 represent high grayscale levels, and the pixels P2, P4 represent low grayscale levels, so that there is a display boundary between the pixels P1, P3 and the pixels P2, P4. The grayscale levels b1, b2 meet b1>b2. The grayscale levels b3, b4 meet b3>b4. In this case, the difference between the luminance corresponding to the grayscale level b1' and the luminance corresponding to the grayscale level b2' is greater than the difference between the luminance corresponding to the grayscale level b1 and the luminance corresponding to the grayscale level b2. On the other hand, the difference between the luminance corresponding to the grayscale level b3' and the luminance corresponding to the grayscale level b4' is smaller than the difference between the luminance corresponding to the grayscale level b3 and the luminance corresponding to the grayscale level b4.

As previously described, when the color represented by the input signal is monochromatic (e.g., blue), the saturation factor HW is 0 or close to 0. Therefore, the shift amount decreases, and the input signal is output as it is, so that the resolution can be maintained. However, in the case of an achromatic color, the saturation factor HW is 1 or close to 1. Therefore, the luminance difference varies (increases or decreases) from pixel column to pixel column as compared with that obtained before the correction, so that the edges may look "jagged", and the resolution may be deteriorated. Note that, when the grayscale levels b1 and b2 are equal or close to each other, it is less perceivable for the human visual properties. However, this tendency grows as the difference between the grayscale level b1 and the grayscale level b2 increases.

Hereinafter, a specific description is given with reference to FIG. 13. Here, in the input signal, a straight line of one-pixel width in an achromatic color having a relatively high luminance (bright gray) is displayed on a background in an achromatic color having a relatively low luminance (dark gray). In this case, ideally, a viewer perceives a relatively bright gray straight line.

Figure 13:
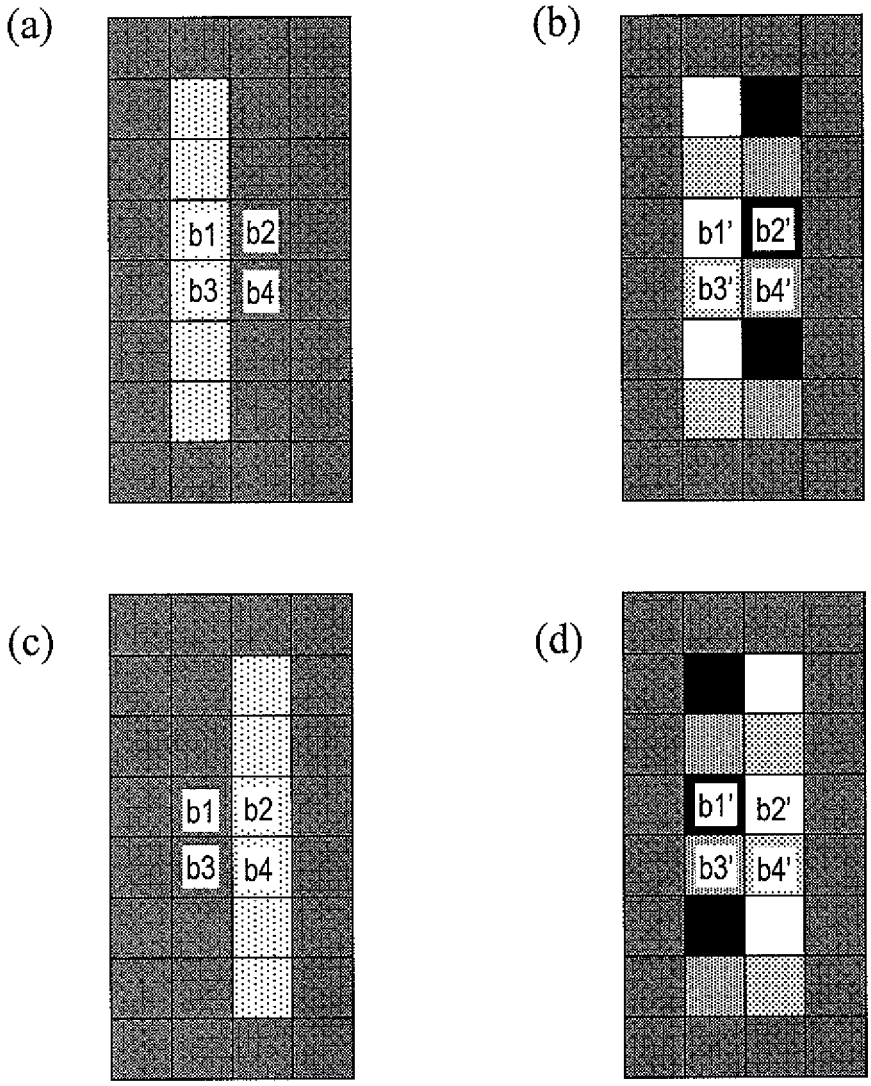
FIGS. 13(*a*) and (*c*) are schematic diagrams of the liquid crystal display device of Comparative Example 2. (*b*) and (*d*) are schematic diagrams of the liquid crystal display device of the present embodiment.

FIG. 13(*a*) shows the luminance of the blue subpixels in the liquid crystal display device of Comparative Example 2. Here, among the grayscale levels b1 to b4 of the blue subpixels of the four pixels P1 to P4 represented by the input signal, the grayscale levels b1, b2 have the relationship of b1>b2, and the grayscale levels b3, b4 have the relationship of b3>b4. In this case, in the liquid crystal display device of Comparative Example 2, the blue subpixels of the four pixels P1 to P4 provide the luminances corresponding to the grayscale levels b1 to b4 represented by the input signal. Note that, in the liquid crystal display device of Comparative Example 2, one subpixel includes two divisional regions. In FIG. 13(*a*), the luminance of the blue subpixel is the average of the luminances of the two divisional regions.

FIG. 13(*b*) shows the luminance of the blue subpixels in a liquid crystal display device 100. In FIG. 13(*b*), the luminance of the blue subpixel is the average of the luminances of the two divisional regions. In the liquid crystal display device 100, for example, the grayscale level b1' of the blue subpixel of the pixel P1 is higher than the grayscale level b1, and the grayscale level b2' of the blue subpixel of the pixel P2 is lower than the grayscale level b2. On the other hand, the grayscale level b3' of the blue subpixel of the pixel P3 is lower than the grayscale level b3, and the grayscale level b4' of the blue subpixel of the pixel P4 is higher than the grayscale level b4. In this way, the increase and decrease of the grayscale level (luminance) relative to the grayscale level corresponding to the input signal occur in opposition to one another among adjacent pixels that are placed side by side along the row direction and the column direction. Thus, as seen from the comparison of FIG. 13(*a*) and FIG. 13(*b*), in the liquid crystal display device 100, the difference between the grayscale level b1' and the grayscale level b2' is greater than the difference between the grayscale level b1 and the grayscale level b2 which are represented by the input signal. Also, the difference between the grayscale level b3' and grayscale level b4' is smaller than the difference between the grayscale level b3 and the grayscale level b4 which are represented by the input signal. As a result, in addition to a column which includes the pixels P1 and P3 corresponding to the grayscale levels b1, b3 which are relatively high in the input signal, the blue subpixel of the pixel P4 corresponding to the grayscale level b4 which is relatively low in the input signal provides a relatively high luminance. In this case, the input signal represents an image for displaying a relatively bright gray straight line. In the liquid crystal display device 100, the relatively bright gray straight line and a blue dotted line alongside the straight line are displayed, so that the display quality at the outline edges of the gray straight line significantly deteriorates.

When the grayscale levels b1 to b4 of the blue subpixels represented by the input signal have the relationships of b1<b2 and b3<b4, in the liquid crystal display device of Comparative Example 2, the blue subpixels of the four pixels P1 to P4 provide the luminances corresponding to the grayscale levels b1 to b4 represented by the input signal as shown in FIG. 13(*c*). On the other hand, in the liquid crystal display device 100, as shown in FIG. 13(*d*), the blue subpixels of the four pixels P1 to P4 provide different luminances from those of the liquid crystal display device of Comparative Example 2.

In the liquid crystal display device 100, as seen from the comparison of FIG. 13(*c*) and FIG. 13(*d*), the difference between the grayscale level b1' and the grayscale level b2' is greater than the difference between the grayscale level b1 and the grayscale level b2 which are represented by the input signal, and the difference between the grayscale level b3' and the grayscale level b4' is smaller than the difference between the grayscale level b3 and grayscale level b4 which are represented by the input signal. As a result, as well as a column which includes the pixels P2 and P4 corresponding to the grayscale levels b2, b4 which are relatively high in the input signal, the blue subpixel of the pixel P3 corresponding to the grayscale level b3 which is relatively low in the input signal provides a relatively high luminance. In this case also, the input signal represents an image for displaying a relatively bright gray straight line whereas, in the liquid crystal display device 100, the relatively bright gray straight line and a blue dotted line alongside the straight line are displayed, so that the display quality at the outline edges of the gray straight line significantly deteriorates.

In the above description, the shift amounts $\Delta S\alpha$, $\Delta S\beta$ are the products of the luminance difference levels $\Delta Y_b\alpha$, $\Delta Y_b\beta$ and the saturation factor HW. To avoid such a phenomenon, other parameters may be used in determining the shift amounts $\Delta S\alpha$, $\Delta S\beta$. Generally speaking, in a portion of an image, such as a text, corresponding to an edge extending between pixels of a straight line displaying portion which are arranged along the column direction and adjacent pixels corresponding to a background displaying portion, the difference in grayscale level between the blue subpixels included in adjacent pixels represented by the input signal is large. Therefore, when the saturation factor HW is close to 1, the difference in grayscale level between the blue subpixels included in the adjacent pixels greatly varies from row to row due to the correction, so that the image quality may deteriorate. Thus, as the parameter for the shift amounts $\Delta S\alpha$, $\Delta S\beta$, a continuity factor that is indicative of the continuity of color across adjacent pixels represented by the input signal may be added. When the difference between the grayscale level b1 and the grayscale level b2 is relatively large, the shift amounts $\Delta S\alpha$, $\Delta S\beta$ vary depending on the continuity factor so that the shift amounts $\Delta S\alpha$, $\Delta S\beta$ are zero or decrease, and the deterioration of the image quality can be prevented. For example, when the difference between the grayscale level b1 and the grayscale level b2 is relatively small, the continuity factor increases, and an adjustment of the luminance of the blue subpixels included in the adjacent pixels is performed. However, when the difference of the grayscale level b1 and the grayscale level b2 is relatively large at a border region of the image, the continuity factor is small, so that the adjustment of the luminance of the blue subpixels is unnecessary.

Figure 14:
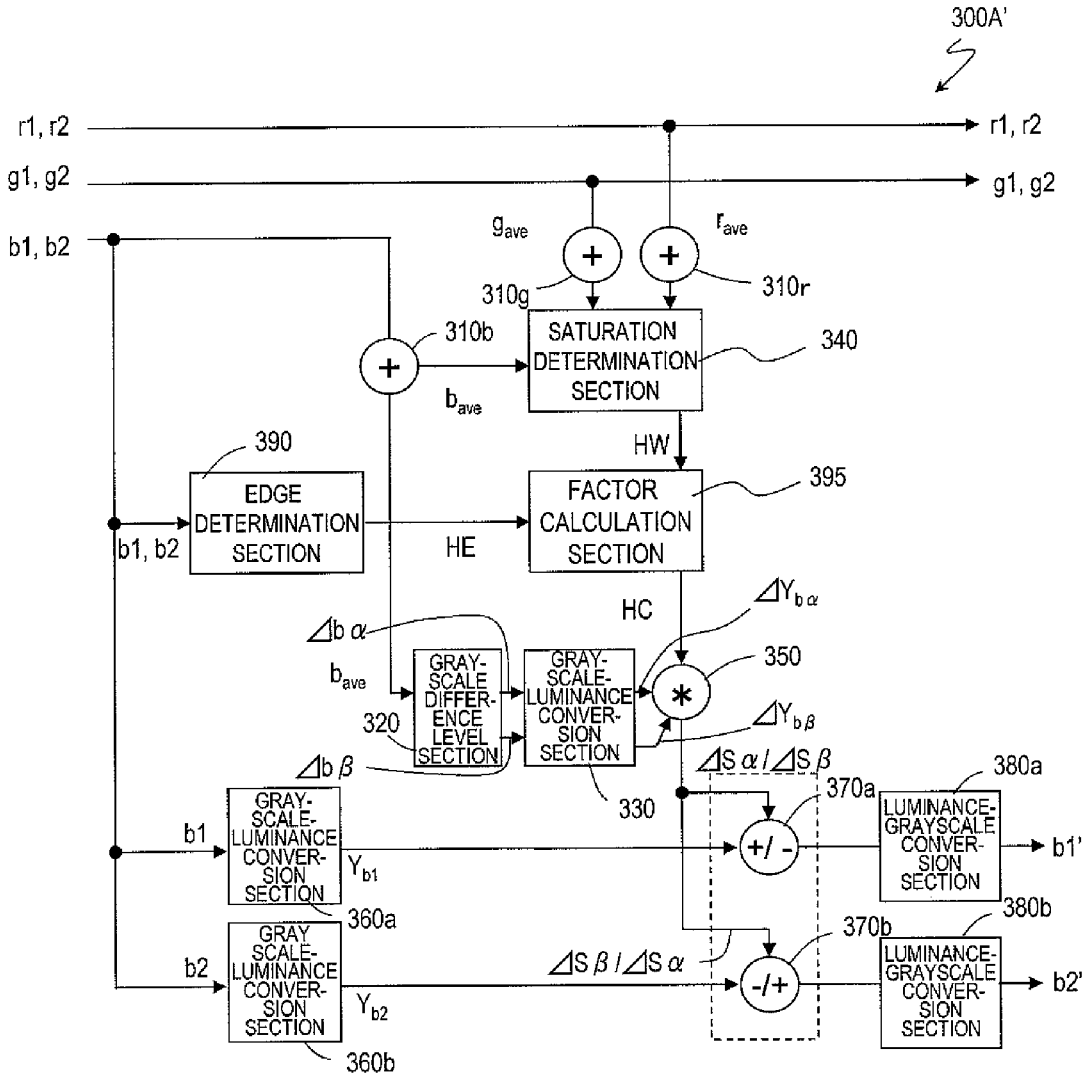
FIG. 14 A schematic diagram showing a configuration of a correction section in a variation of the liquid crystal display device of the first embodiment.

Hereinafter, a correction section 300A' for adjusting the luminance of the blue subpixels as described above is described with reference to FIG. 14. Note that, herein, the edge factor is used instead of the continuity factor. The correction section 300A' has the same configuration as that of the correction section 300A that has previously been described with reference to FIG. 8 except that it further includes an edge determination section 390 and a factor calculation section 395. To avoid redundancy, repetitive description is not given herein.

The edge determination section 390 determines the edge factor HE based on the grayscale levels b1, b2 represented by the input signal. The edge factor HE is a function which increases as the difference in grayscale level between the blue subpixels included in adjacent pixels increases. When the difference between the grayscale level b1 and the grayscale level b2 is relatively large, i.e., when the continuity of the grayscale level b1 and the grayscale level b2 is low, the edge factor HE is high. On the contrary, when the difference between the grayscale level b1 and the grayscale level b2 is relatively small, i.e., when the continuity of the grayscale level b1 and the grayscale level b2 is high, the edge factor HE is low. Thus, as the continuity of the grayscale levels of the blue subpixels included in adjacent pixels (or the aforementioned continuity factor) decreases, the edge factor HE increases. As the continuity of the grayscale levels (or the aforementioned continuity factor) increases, the edge factor HE decreases.

The edge factor HE continuously changes depending on the difference in grayscale level between the blue subpixels included in adjacent pixels. For example, in the input signal, the edge factor HE is expressed as $HE=|b1-b2|/MAX$, where $|b1-b2|$ is the absolute value of the difference in grayscale level between the blue subpixels of adjacent pixels and MAX=MAX (b1, b2). Note that, when MAX=0, HE=0.

Then, the factor calculation section 395 calculates a correction factor HC based on the saturation factor HW determined in the saturation determination section 340 and the edge factor HE determined in the edge determination section 390. The correction factor HC is expressed as, for example, HC=HW−HE. In the factor calculation section 395, clipping may be performed such that the correction factor HC falls within the range of 0 to 1. Then, the multiplication section 350 generates the shift amounts $\Delta S\alpha$, $\Delta S\beta$ by means of multiplication of the correction factor HC and the luminance difference levels $\Delta Y_B\alpha$, $\Delta Y_B\beta$.

Thus, in the correction section 300A', the shift amounts $\Delta S\alpha$, $\Delta S\beta$ are obtained by means of multiplication of the correction factor HC, which is obtained based on the saturation factor HW and the edge factor HE, and the luminance difference levels $\Delta Y_B\alpha$, $\Delta Y_3\beta$. Since, as previously described, the edge factor HE is a function which increases as the difference in grayscale level between the blue subpixels included in adjacent pixels represented by the input signal increases, the correction factor HC which dominates the luminance distribution decreases as the edge factor HE increases, so that the jaggedness of the edges can be reduced. Since the saturation factor HW is a function which continuously changes as previously described and the edge factor HE is also a function which continuously changes depending on the difference in grayscale level between the blue subpixels included in the adjacent pixels, the correction factor HC also continuously changes, so that abrupt change in display can be prevented.

When, in the correction section 300A', adjacent pixels in the input signal represent achromatic colors at the same grayscale level and the grayscale levels b1, b2 are equal to each other, the difference between the grayscale level b1' and the grayscale level b2' is large so that the viewing angle characteristics can be improved. On the other hand, when adjacent pixels in the input signal represent achromatic colors at greatly different grayscale levels and the grayscale levels b1, b2 are greatly different from each other, the grayscale level b1' is generally equal to the grayscale level b2'. In this case, although the effect of improving the viewing angle characteristics decreases, the liquid crystal display panel 200A displays an image with the grayscale levels represented by the input signal as they are, so that the "jaggedness" of the edges can be removed.

Here, it is assumed that two pixels in the input signal represent achromatic colors. In this case, Max ($r_{ave}$, $g_{ave}$, $b_{ave}$)=Min ($r_{ave}$, $g_{ave}$, $b_{ave}$), and the saturation factor HW=1.

When the achromatic colors of the two pixels in the input signal are at the same grayscale level, for example, when (r1, g1, b1)=(100, 100, 100) and (r2, g2, b2)=(100, 100, 100), Max ($r_{ave}$, $g_{ave}$, $b_{ave}$)=100 and Min ($r_{ave}$, $g_{ave}$, $b_{ave}$)=100 and the saturation factor HW=1. In this case, the grayscale level b1 is equal to the grayscale level b2, the edge factor HE=0, and the correction factor HC=1. Therefore, the grayscale levels b1' and b2' are greatly different from the grayscale levels b1 and b2, respectively. The luminances of the blue subpixels B1 and B2 in the liquid crystal display panel 200A are greatly different from the luminances corresponding to the grayscale levels b1, b2 represented by the input signal.

When the achromatic colors of the two pixels in the input signal are at different grayscale levels, for example, when (r1, g1, b1)=(100, 100, 100) and (r2, g2, b2)=(50, 50, 50), Max ($r_{ave}$, $g_{ave}$, $b_{ave}$)=75 and Min ($r_{ave}$, $g_{ave}$, $b_{ave}$)=75, and the saturation factor HW=1. In this case, the edge factor HE=0.5 (=|100−50|/100), and the correction factor HC=0.5. Therefore, the grayscale levels b1' and b2' are different from the grayscale levels b1 and b2, respectively. The luminances of the blue subpixels B1, B2 in the liquid crystal display panel 200A are different from the luminances corresponding to the grayscale levels b1, b2 represented by the input signal.

On the other hand, when the grayscale levels of the achromatic colors of the two pixels in the input signal are relatively largely different, for example, when (r1, g1, b1)=(100, 100, 100) and (r2, g2, b2)=(0, 0, 0), Max ($r_{ave}$, $g_{ave}$, $h_{ave}$)=50 and Min ($r_{ave}$, $g_{ave}$, $b_{ave}$)=50, and the saturation factor HW=1. In this case, the edge factor HE=1 (=|100−0|/100), and the correction factor HC=0. Thus, when the correction factor HC is zero, the grayscale level b1' is equal to the grayscale level b1, and the grayscale level b2' is equal to the grayscale level b2. The luminances of the blue subpixels B1, B2 in the liquid crystal display panel 200A are generally equal to the luminances corresponding to the grayscale levels b1, b2 represented by the input signal.

In the above description, the yellow shift which is perceived when viewed from the oblique viewing direction is reduced, although the color which is perceived as being a "shifted" color when viewed from the oblique viewing direction is not limited to yellow. In the description below, a phenomenon where the color is perceived as being a shifted color is also referred to as "color shift". The present invention may be applied to reduction of a color shift other than the yellow shift.

In the above description, a change is made such that the Z value increases at the middle grayscale levels, although the present invention is not limited to this example. The Z value may be corrected such that the Z value is increased in a certain grayscale level range while the Z value is decreased in the other grayscale level range. For example, to improve the liquid crystal display device of Comparative Example 1 shown in FIG. 4, the correction to the grayscale level of the blue subpixel may be made such that the Z value is decreased in a low-middle grayscale level range while the Z value is increased in a middle-high grayscale level range.

In the above description, the correction to the grayscale level of the blue subpixel is made only to the middle grayscale levels, although the correction to the grayscale level of the blue subpixel is preferably made at all the grayscale levels in order to further reduce the color shift. It is preferred that the correction to the grayscale level of the blue subpixel is also made in the range from low grayscale levels (e.g., black) to middle grayscale levels and in the range from middle grayscale levels to high grayscale levels (e.g., white).

As previously described, the liquid crystal display panel 200A operates in the VA mode. Now, a specific configuration example of the liquid crystal display panel 200A is described. For example, the liquid crystal display panel 200A may operate in the MVA mode. First, a configuration of the liquid crystal display panel 200A which operates in the MVA mode is described with reference to FIGS. 15(*a*) to 15(*c*).

The liquid crystal display panel 200A includes a pixel electrode 224, a counter electrode 244 which opposes the pixel electrode 224, and a vertical alignment type liquid crystal layer 260 interposed between the counter electrode 244 and the counter electrode 244. Note that, herein, the alignment films are not shown.

At a side of the liquid crystal layer 260 which is closer to the pixel electrode 224, slits (portions where a conductive film is not provided) 227 and ribs (protrusions) 228 are provided. At the other side of the liquid crystal layer 260 which is closer to the counter electrode 244, slits 247 and ribs 248 are provided. The slits 227 and the ribs 228 provided at the side of the liquid crystal layer 260 which is closer to the pixel electrodes 224 are also referred to as "first alignment regulating means". The slits 247 and the ribs 248 provided in the other side of the liquid crystal layer 260 which is closer to the counter electrode 244 are also referred to as "second alignment regulating means".

In liquid crystal regions defined between the first alignment regulating means and the second alignment regulating means, the liquid crystal molecules 262 are subject to the alignment regulating forces produced by the first alignment regulating means and the second alignment regulating means. When a voltage is applied between the pixel electrode 224 and the counter electrode 244, the liquid crystal molecules 262 incline (or "tilt") in directions shown by arrows in the drawings. In other words, in each liquid crystal region, the liquid crystal molecules 262 unidirectionally incline, so that each liquid crystal region can be regarded as a domain.

Figure 15:
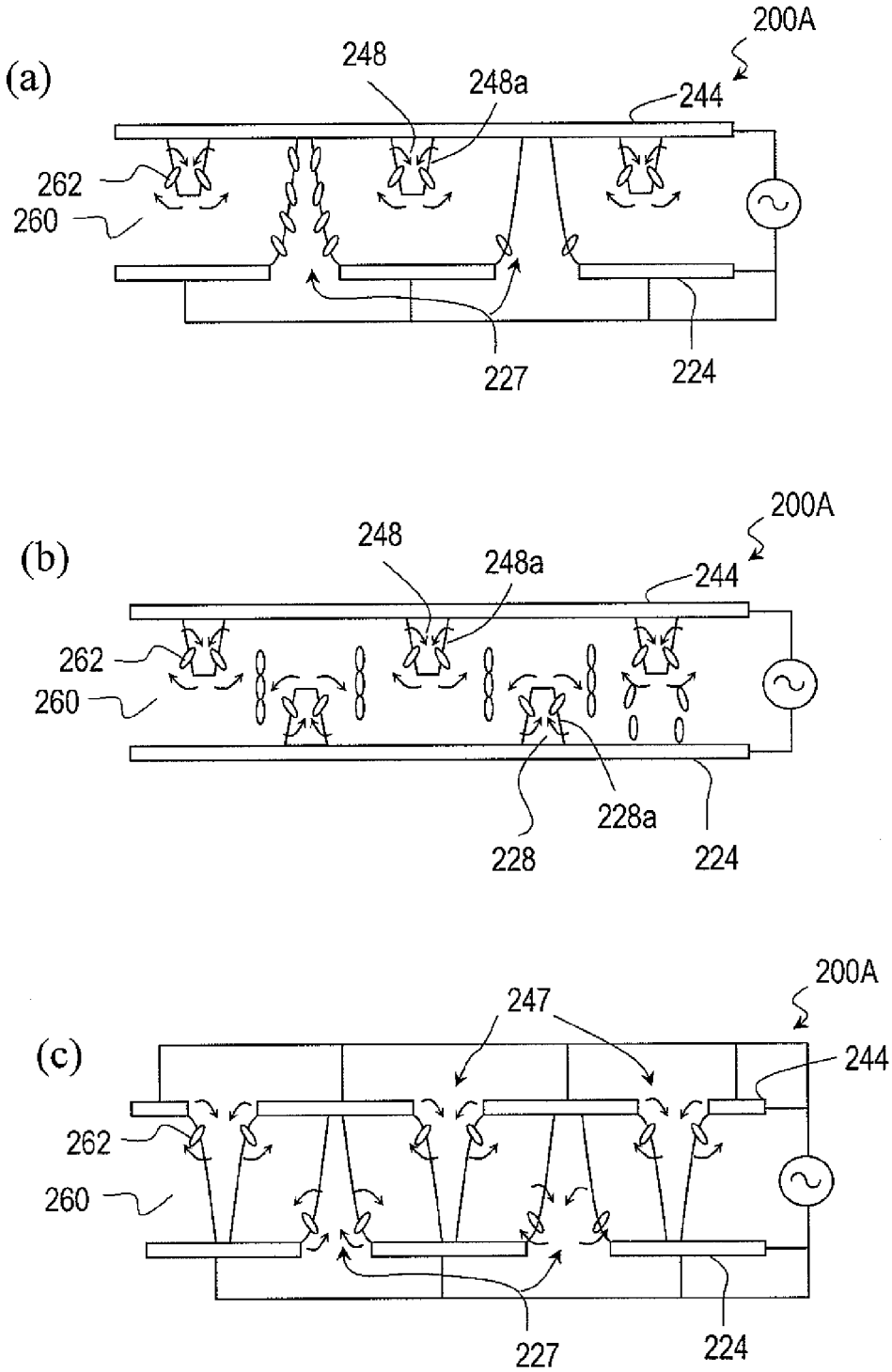
FIGS. 15(*a*) to (*c*) are schematic diagrams of the liquid crystal display panel of the liquid crystal display device shown in FIG. 1.

The first alignment regulating means and the second alignment regulating means (which are sometimes generically referred to as "alignment regulating means") are in a band-like arrangement in each subpixel. FIGS. 15(*a*) to 15(*c*) are cross-sectional views which are perpendicular to the direction of extension of the band-like alignment regulating means. At the opposite sides of each alignment regulating means, liquid crystal regions (or "domains") are formed between which the direction of inclination of the liquid crystal molecules 262 is different by 180°. As the alignment regulating means, a variety of alignment regulating means (or "domain regulating means"), such as disclosed in Japanese Laid-Open Patent Publication No. 11-242225, may be used.

In FIG. 15(*a*), the slits 227 are provided in the pixel electrodes 224 as the first alignment regulating means, and the ribs 248 are provided as the second alignment regulating means. The slits 227 and the ribs 248 are each elongated to have a band-like form (strip-like form). When a potential difference is produced between the pixel electrode 224 and the counter electrode 244, an oblique electric field is generated in part of the liquid crystal layer 260 which is in the vicinity of an edge of the slit 227. The oblique electric field acts on the liquid crystal molecules 262 such that the liquid crystal molecules 262 are aligned along the direction perpendicular to the extension of the slit 227. The ribs 248 make the liquid crystal molecules 262 aligned generally perpendicular to its lateral surface 248*a*, whereby the liquid crystal molecules 262 are also aligned along a direction perpendicular to the direction of extension of the ribs 248. The slits 227 and the ribs 248 are arranged in parallel to one another with certain intervals therebetween. A liquid crystal region (or "domain") is formed between the slit 227 and the rib 248 which are adjacent to each other.

The configuration of FIG. 15(*b*) is different from that of FIG. 15(*a*) in that the ribs 228 and the ribs 248 are provided as the first alignment regulating means and the second alignment regulating means, respectively. The ribs 228 and the ribs 248 are arranged parallel to one another with certain intervals therebetween. The ribs 228 and the ribs 248 function such that the liquid crystal molecules 262 are oriented generally perpendicular to a lateral surface 228*a* of the ribs 228 and a lateral surface 248*a* of the ribs 248, whereby liquid crystal regions (or "domains") are formed therebetween.

The configuration of FIG. 15(*c*) is different from that of FIG. 15(*a*) in that the slits 227 and the slits 247 are provided as the first alignment regulating means and the second alignment regulating means, respectively. The slits 227 and the slits 247 function such that, when a potential difference is produced between the pixel electrode 224 and the counter electrode 244, an oblique electric field is generated in part of the liquid crystal layer 260 which is in the vicinity of an edge of the slits 227 and 247. The oblique electric field acts on the liquid crystal molecules 262 such that the liquid crystal molecules 262 are oriented in directions perpendicular to the direction of extension of the slits 227 and 247. The slits 227 and the slits 247 are provided in parallel to one another with certain intervals therebetween. Between the slits 227 and the slits 247, liquid crystal regions (or "domains") are formed.

As previously described, any combination of ribs and slits may be used as the first alignment regulating means and the second alignment regulating means. When the configuration of the liquid crystal display panel 200A which is shown in FIG. 15(*a*) is employed, the advantage of minimizing the increase of the fabrication steps is obtained. Even when a slit is provided in the pixel electrode, an additional step is not necessary. On the other hand, as for the counter electrode, providing a rib is better than providing a slit because a smaller number of steps are added. As a matter of course, a configuration where only a rib is provided as the alignment regulating means, or a configuration where only a slit is provided as the alignment regulating means, may be employed.

Figure 16:
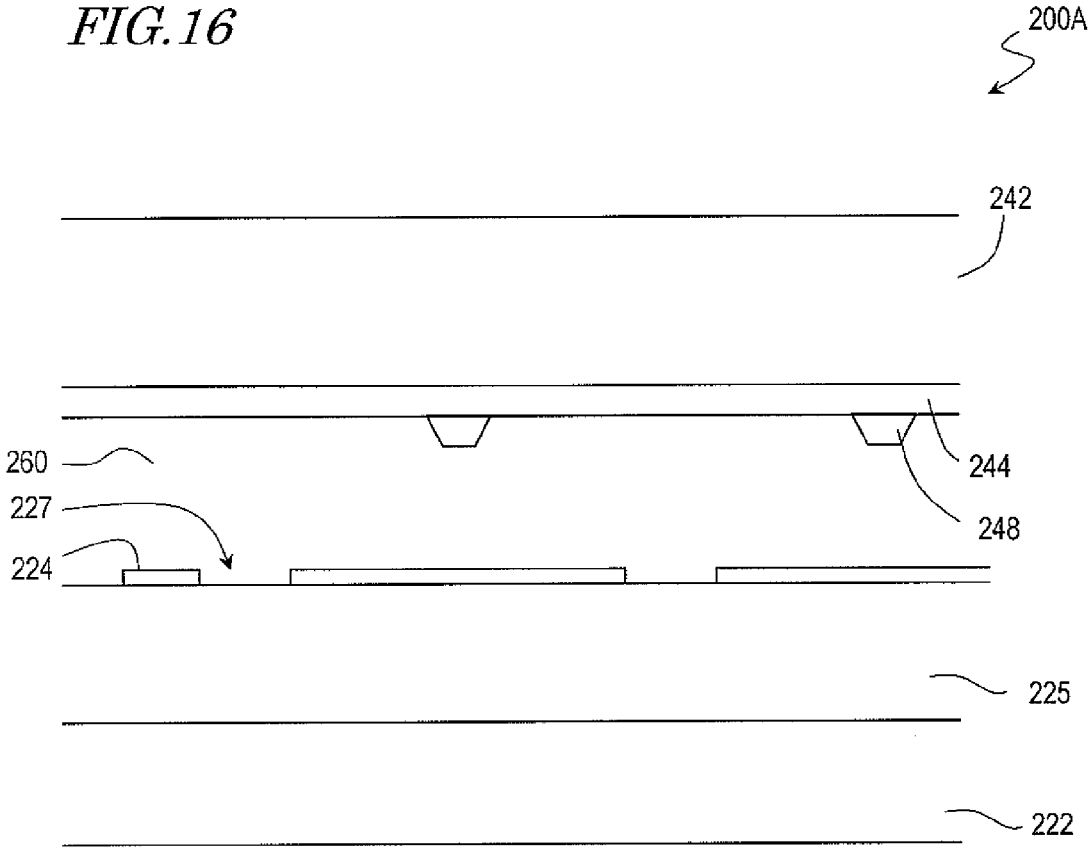
FIG. 16 A partial cross-sectional view schematically showing a cross-sectional structure of the liquid crystal display panel of the liquid crystal display device shown in FIG. 1.
Figure 17:
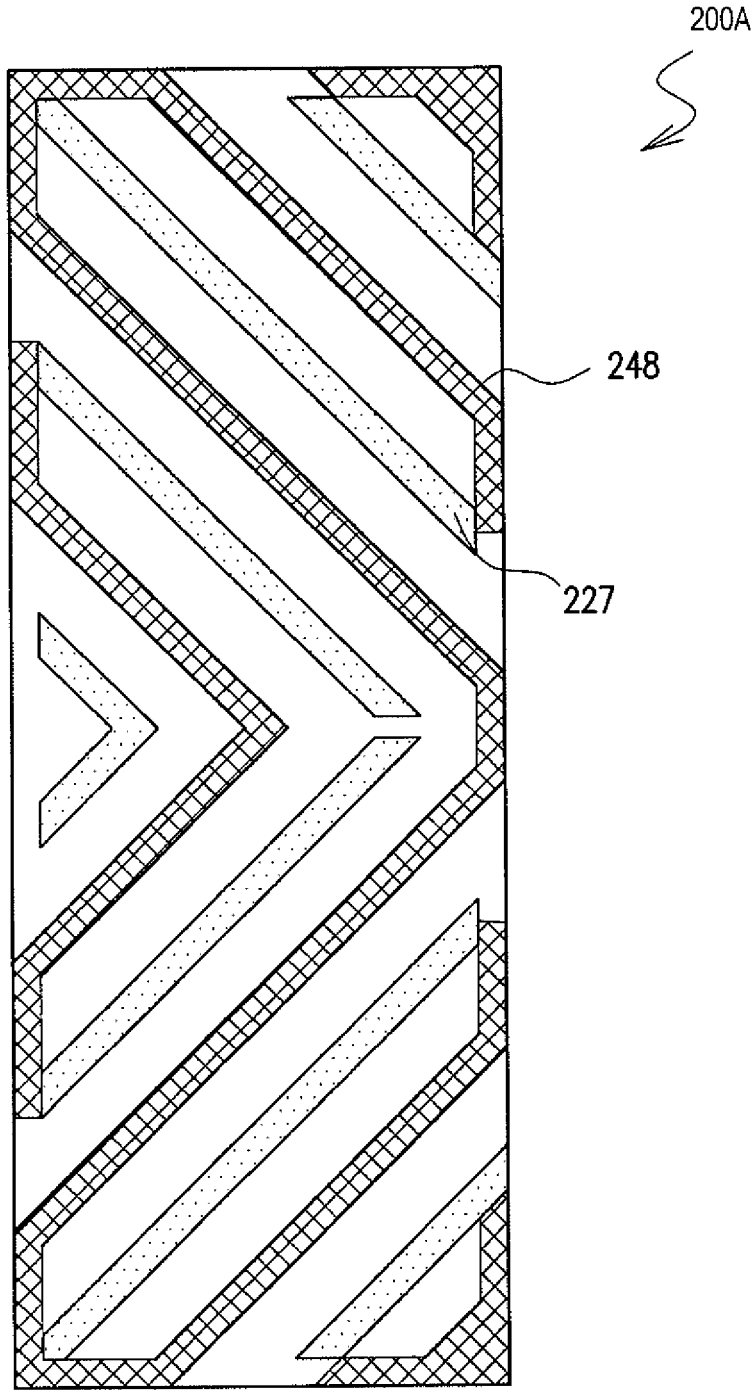
FIG. 17 A plan view schematically showing a region corresponding to one subpixel of the liquid crystal display panel of the liquid crystal display device shown in FIG. 1.

FIG. 16 is a partial cross-sectional view schematically showing a cross-sectional structure of the liquid crystal display panel 200A. FIG. 17 is a plan view schematically showing a region corresponding to one subpixel of the liquid crystal display panel 200A. The slits 227 are in the form of a band. Adjacent ribs 248 are arranged parallel to each other.

A surface of the insulative substrate 222 which is closer to the liquid crystal layer 260 is provided with an unshown gate line (scanning line) and a source line (signal line), and a TFT. Further, an interlayer insulation film 225 is provided for covering these components. A Pixel electrode 224 is provided on the interlayer insulation film 225. The pixel electrode 224 and the counter electrode 244 oppose each other with a liquid crystal layer 260 interposed therebetween.

The pixel electrode 224 has a band-like slit 227, and a vertical alignment film (not shown) is provided generally over the entire surface of the pixel electrode 224 that includes the slit 227. The slit 227 is in the form of a band as shown in FIG. 17. Two adjacent slits 227 are arranged parallel to each other so as to generally halve the interval of adjacent ribs 248.

In a space between the band-like slit 227 and rib 248 extending parallel to each other, the orientations of the liquid crystal molecules 262 are regulated by the slit 227 and the rib 248 at both sides of the space, so that domains in which the orientations of the liquid crystal molecules 262 are different by 180° from each other are formed at both sides of each of the slit 227 and the rib 248. In the liquid crystal display panel 200A, as shown in FIG. 17, the slits 227 and the ribs 248 extend in two directions which are different by 90° from each other, so that four domains in which the orientations of the liquid crystal molecules 262 are different by 90° from one another are formed in each subpixel.

A pair of polarizers (not shown) provided at the outer sides of the insulative substrate 222 and the insulative substrate 242 are arranged such that the transmission axes are generally perpendicular to each other (crossed Nicols arrangement). The polarizers may be arranged such that, in every one of the four types of domains which have different orientation directions by angles of 90°, the orientation direction and the transmission axes of the polarizers form an angle of 45°, whereby the change of retardation which is attributed to formation of the domains can be utilized most efficiently. Thus, it is preferred that the polarizers are arranged such that the transmission axes of the polarizers and the direction of extension of the slit 227 and the ribs 248 form an angle of about 45°. In a display device in which the viewing direction may be horizontally moved relative to the display surface in many cases, arranging the transmission axis of one of the pair of polarizers so as to be horizontal to the display surface is preferred from the viewpoint of decreasing the viewing angle dependence of the display quality. In the liquid crystal display panel 200A which has the above-described configuration, when a predetermined voltage is applied across the liquid crystal layer 260 in each subpixel, a plurality of regions (or "domains") are formed among which the azimuth of inclination of the liquid crystal molecules 262 is different, so that display of a wide viewing angle is realized.

In the above description, the liquid crystal display panel 200A operates in the MVA mode, although the present invention is not limited to this example. As previously described, the liquid crystal display panel 200A operates in the CPA mode.

Hereinafter, the liquid crystal display panel 200A which operates in the CPA mode is described with reference to FIG. 18 and FIG. 19. A separate electrode 224*a*, 224*b* of the liquid crystal display panel 200A shown in FIG. 18(*a*) has a plurality of notches 224β which are provided at predetermined positions. The separate electrode 224*a*, 224*b* is divided by these notches 224β into a plurality of unit electrodes 224α. Each of the plurality of unit electrodes 224*a* has a generally rectangular shape. In the example described herein, the separate electrode 224*a*, 224*b* is divided into three unit electrodes 224α, although the number of divisions is not limited to this example.

Figure 18:
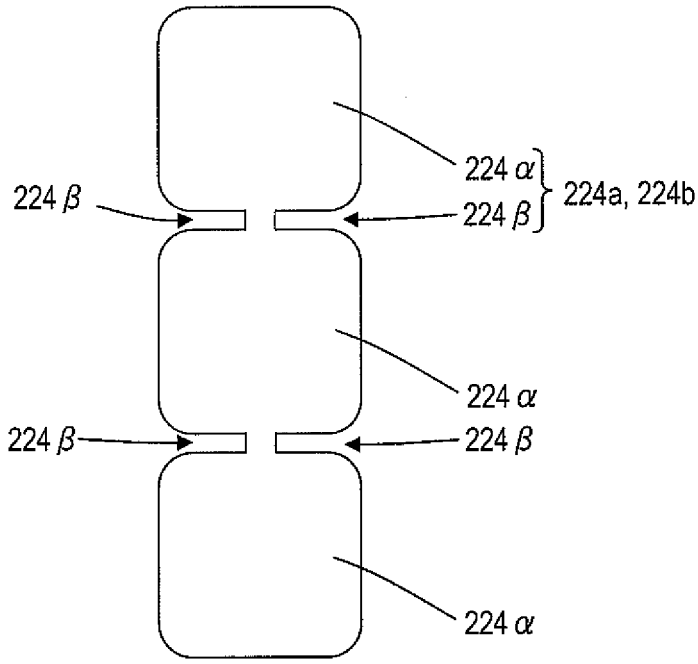
FIGS. 18(*a*) and (*b*) are plan views schematically showing a region corresponding to one subpixel of the liquid crystal display panel of the liquid crystal display device shown in FIG. 1.
Figure 18:
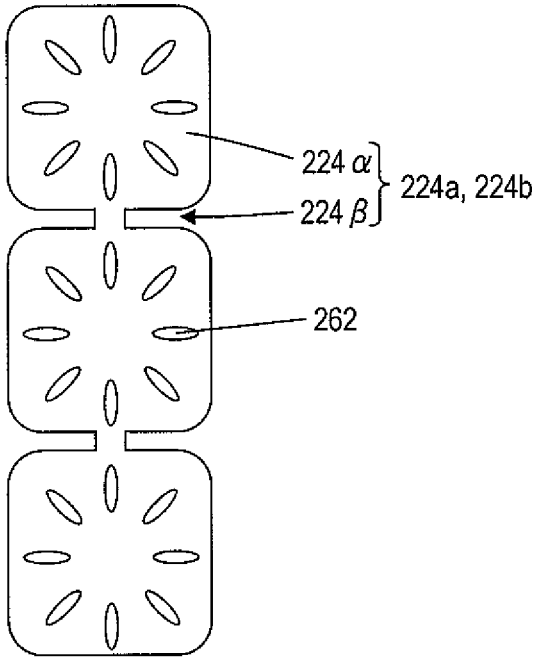

When a voltage is applied between the separate electrode 224*a*, 224*b* which has the above-described structure and the counter electrode (not shown), oblique electric fields generated in the vicinity of the periphery of the separate electrode 224*a*, 224*b* and in the notches 224β contribute to formation of a plurality of liquid crystal domains each of which exhibits an axial symmetry alignment (radial inclination alignment) as shown in FIG. 18(*b*). The liquid crystal domains are formed in such a manner that one liquid crystal domain is formed on each unit electrode 224α. In each liquid crystal domain, the liquid crystal molecules 262 incline in substantially all the azimuths. Thus, the liquid crystal display panel 200A includes an enormous number of regions among which the azimuth of inclination of the liquid crystal molecules 262 is different. Therefore, display of a wide viewing angle is realized.

Figure 19:
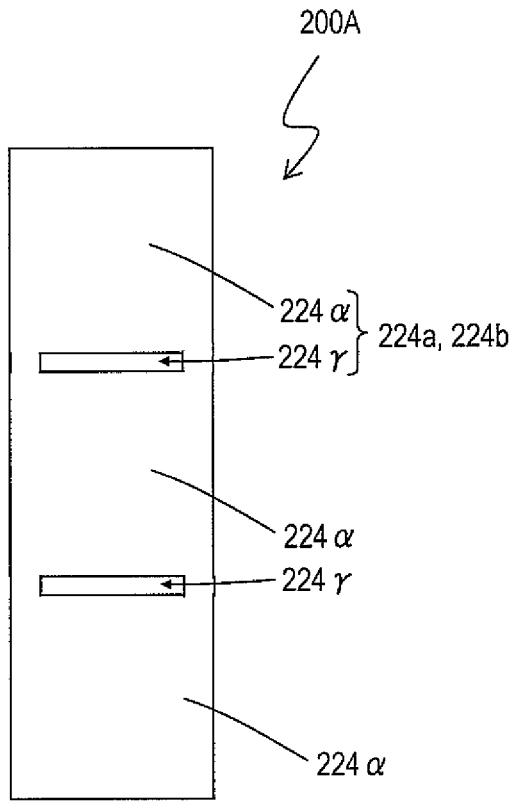
FIG. 19 A plan view schematically showing a region corresponding to one subpixel of the liquid crystal display panel of the liquid crystal display device shown in FIG. 1.

Note that, although the separate electrode 224*a*, 224*b* has the notches 224β in the example shown in FIG. 18, the separate electrode 224*a*, 224*b* may have openings 224γ instead of the notches 224β as shown in FIG. 19. The separate electrode 224*a*, 224*b* shown in FIG. 19 has a plurality of openings 224γ and is divided by the openings 224γ into a plurality of unit electrodes 224α. When a voltage is applied between the separate electrode 224*a*, 224*b* having such a structure and the counter electrode (not shown), oblique electric fields generated in the vicinity of the periphery of the separate electrode 224*a*, 224*b* and in the openings 224γ contribute to formation of a plurality of liquid crystal domains each of which exhibits an axial symmetry alignment (radial inclination alignment) as shown in FIG. 18(*b*).

In the examples of FIG. 18 and FIG. 19 which have been illustrated above, one separate electrode 224*a*, 224*b* has a plurality of notches 224β or openings 224γ, although the separate electrode 224*a*, 224*b* may have only one notch 224β or opening 224γ in the case where the separate electrode 224*a*, 224*b* is divided into two parts. In other words, by providing at least one notch 224β or opening 224γ in the separate electrode 224*a*, 224*b*, a plurality of liquid crystal domains of axial symmetry alignment can be formed. The shape of the separate electrode 224*a*, 224*b* may be selected from a variety of shapes such as disclosed in, for example, Japanese Laid-Open Patent Publication No. 2003-43525.

In the above description, it is assumed that the input signal is a YCrCb signal which is commonly used as the color television signal. However, the input signal is not limited to the YCrCb signal but may be a signal which represents the luminances of the respective subpixels of three primary colors of RGB. It may be a signal which represents the luminances of the respective subpixels of other three primary colors, such as YeMC (Ye: yellow, M: magenta, C: cyan).

In the above description, the correction section 300A includes the saturation determination section 340, although the present invention is not limited to this example. The correction section 300A may not include the saturation determination section 340.

In the above description, the unit of adjustment of the luminance of the blue subpixels consists of the blue subpixels included in two adjacent pixels that are placed side by side along the row direction, although the present invention is not limited to this example. The unit of adjustment of the luminance of the blue subpixels may consist of the blue subpixels included in two adjacent pixels that are placed side by side along the column direction. It should be noted that, in the case where the unit of correction consists of the blue subpixels included in two adjacent pixels that are placed side by side along the column direction, line memories or the like are necessary, and a large-size circuit is necessary.

Figure 20:
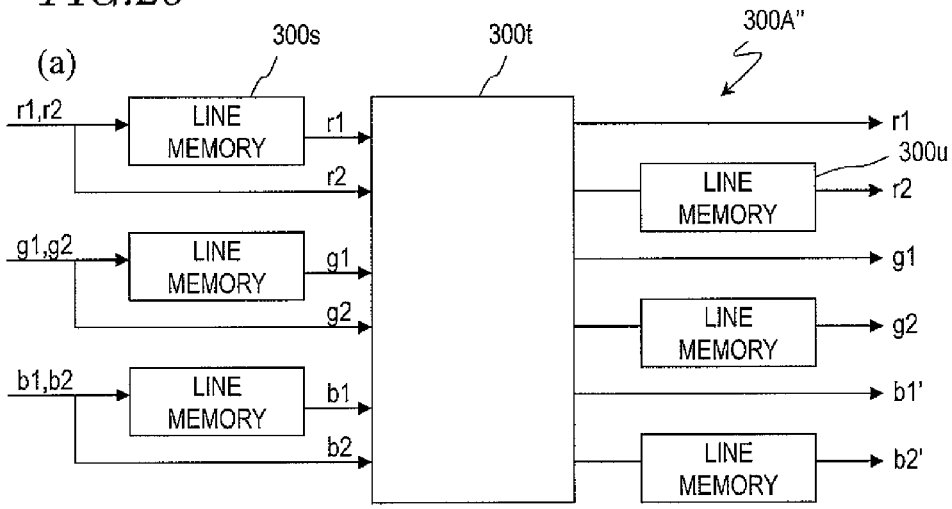
FIG. 20(*a*) is a schematic diagram showing the structure of a correction section of a variation of the liquid crystal display device of the first embodiment. (*b*) is a schematic diagram showing the structure of a grayscale adjustment section.
Figure 20:
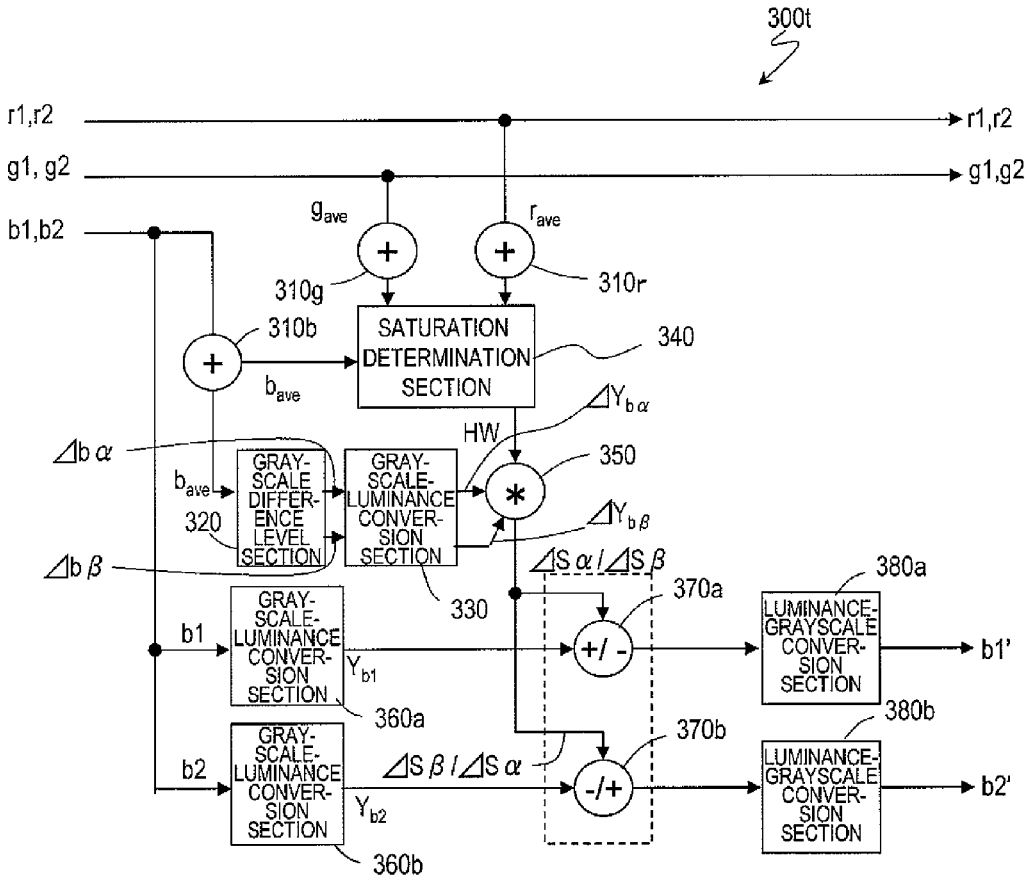

FIG. 20 is a schematic diagram of a correction section 300A" that is suitable to adjustment of the luminance which is carried out by the unit of two blue subpixels included in adjacent pixels that are placed side by side along the column direction. As shown in FIG. 20(*a*), the correction section 300A" includes preceding-stage line memories 300*s*, a grayscale adjustment section 300*t*, and subsequent-stage line memories 300*u*. The grayscale levels r1, g1, b1 represented by the input signal correspond to the red, green and blue subpixels included in a certain pixel. The grayscale levels r2, g2, b2 represented by the input signal correspond to the red, green and blue subpixels included in a pixel of the subsequent row. The preceding-stage line memories 300*s* delay the grayscale levels r1, g1 and b1 by one line and input the delayed grayscale levels to the grayscale adjustment section 300*t*.

FIG. 20(*b*) is a schematic diagram of the grayscale adjustment section 300*t*. The addition section 310*b* is used to obtain the average grayscale level $b_{ave}$ of the grayscale level b1 and the grayscale level b2. Then, the grayscale difference level section 320 generates two grayscale difference levels Δbα, Δbβ from one average grayscale level $b_{ave}$. The grayscale difference level Δbα corresponds to the brighter blue subpixel. The grayscale difference level Δbβ corresponds to the darker blue subpixel. In this way, the grayscale difference level section 320 generates two grayscale difference levels Δbα, Δbβ from the average grayscale level $b_{ave}$. Then, the grayscale-luminance conversion section 330 converts the grayscale difference level Δbα to the luminance difference level $\Delta Y_b\alpha$ and the grayscale difference level Δbβ to the luminance difference level $\Delta Y_b\beta$.

On the other hand, the addition section 310*r* is used to obtain the average grayscale level $r_{ave}$ of the grayscale level r1 and the grayscale level r2. Meanwhile, the addition section 310*g* is used to obtain the average grayscale level $g_{ave}$ of the grayscale level g1 and the grayscale level g2. The saturation determination section 340 uses the average grayscale levels $r_{ave}$, $g_{ave}$, $b_{ave}$ to obtain the saturation factor HW.

Then, the shift amounts ΔSα, ΔSβ are obtained. The shift amount ΔSα is represented by the product of $\Delta Y_b\alpha$ and the saturation factor HW, and the shift amount ΔSβ is represented by the product of $\Delta Y_b\beta$ and the saturation factor HW. The multiplication section 350 multiplies the luminance difference levels $\Delta Y_b\alpha$, $\Delta Y_b\beta$ by the saturation factor HW to obtain the shift amounts ΔSα, ΔSβ.

The grayscale-luminance conversion section 360*a* performs a grayscale-luminance conversion on the grayscale level b1 to obtain the luminance level $Y_{b1}$. Likewise, the grayscale-luminance conversion section 360*b* performs a grayscale-luminance conversion on the grayscale level b2 to obtain the luminance level $Y_{b2}$.

Then, in the addition/subtraction section 370*a*, the luminance level $Y_{b1}$ and the shift amount ΔSα are added together, and the luminance-grayscale conversion section 380*a* performs a luminance-grayscale conversion to obtain the grayscale level b1'. Meanwhile, in the addition/subtraction section 370*b*, the shift amount ΔSβ is subtracted from the luminance level $Y_{b2}$, and the luminance-grayscale conversion section 380*b* performs a luminance-grayscale conversion to obtain the grayscale level b2'. Thereafter, as illustrated in FIG. 20(*a*), the subsequent-stage line memories 300*u* delays the grayscale levels r2, g2, b2' by one line. The correction section 300A" thus performs an adjustment of the luminance by the unit of blue subpixels included in adjacent pixels that are placed side by side along the column direction.

In the above description, each of the subpixels R, G and B includes two divisional regions, although the present invention is not limited to this example. Each of the subpixels R, G and B may include three or more divisional regions.

Figure 21:
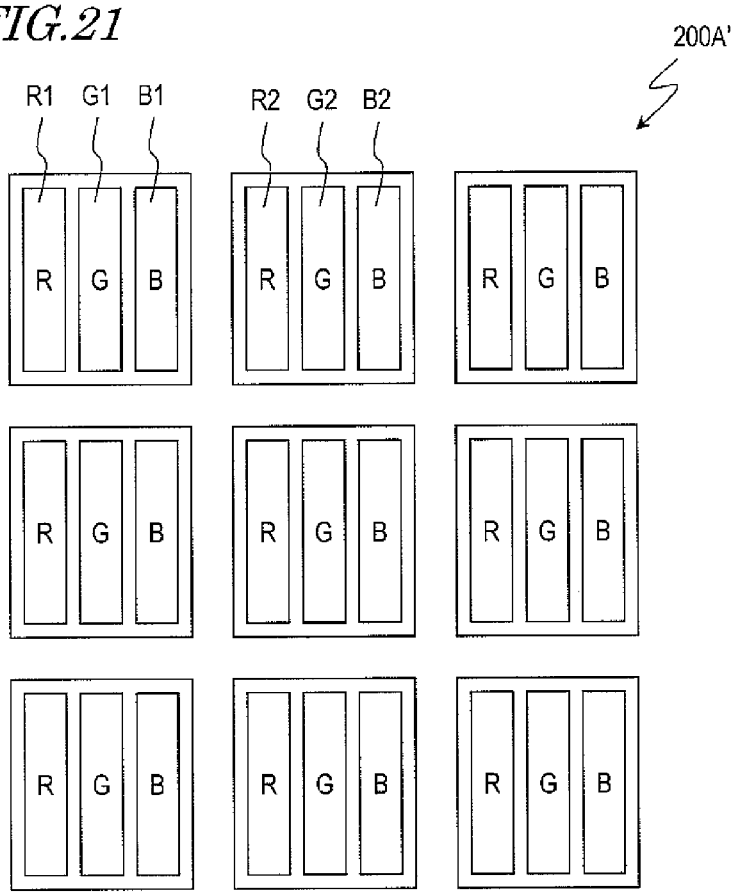
FIG. 21 A schematic diagram showing a liquid crystal display panel in a liquid crystal display device of a variation of the first embodiment.

Alternatively, each of the subpixels R, G and B may not include multiple divisional regions. For example, as shown in FIG. 21, in the liquid crystal display panel 200A' of the liquid crystal display device 100A', each of the subpixels R, G and B may be formed by a single region. The red subpixels R1, R2, G1, G2, B1 and B2 may provide the luminances corresponding to the grayscale levels r1, r2, g1, g2, b1' and b2', respectively.

Figure 22:
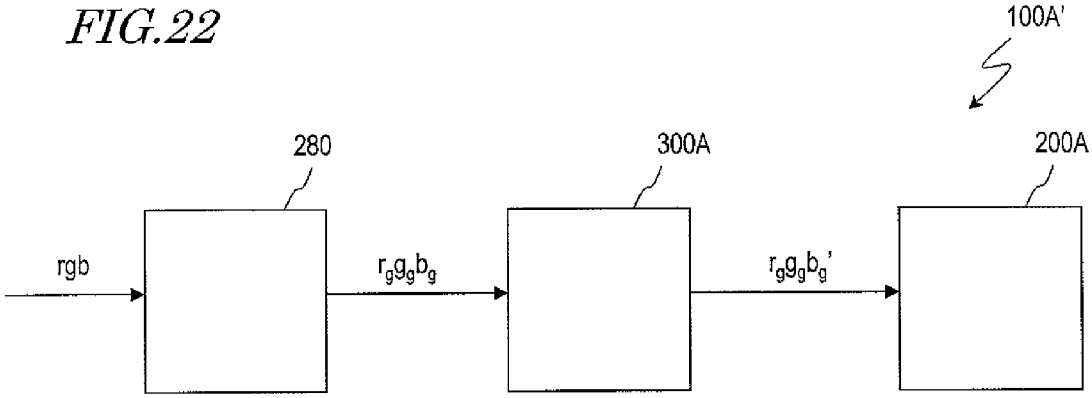
FIG. 22 A schematic diagram showing the liquid crystal display device of a variation of the first embodiment.

As shown in FIG. 22, in the liquid crystal display device 100A', the independent gamma correction processing section 280 may be located at a stage which is precedent to the correction section 300A. In this case, the independent gamma correction processing section 280 performs an independent gamma correction process on the grayscale levels rgb represented by the input signal to obtain the grayscale levels $r_g$, $g_g$, $b_g$. Thereafter, the correction section 300A makes a correction to the signal which has already undergone the independent gamma correction process. The exponent which is used in the luminance-grayscale conversion in the correction section 300A may be a value which is determined according to the properties of the liquid crystal display panel 200A, rather than a constant value (e.g., 2.2).

In the above description, the saturation determination and the level difference determination are carried out based on the average grayscale level, although the present invention is not limited to this example. The saturation determination and the level difference determination may be carried out based on the average luminance level. Note that the luminance level is equal to the grayscale level raised to the power of 2.2, and therefore, the accuracy of the luminance level needs to be equal to the grayscale level accuracy raised to the power of 2.2. Therefore, the lookup table that contains luminance difference levels requires a large circuit size, whereas the lookup table that contains grayscale difference levels can be realized with a small circuit size.

In the above description, the grayscale level is represented by the input signal, and the correction section 300A makes a correction to the grayscale level of the blue subpixel, although the present invention is not limited to this example. The correction section 300A may make a correction to the luminance level of the blue subpixel when the luminance level is already represented by the input signal or after the grayscale level is converted to luminance level. Note that the luminance level is equal to the grayscale level raised to the power of 2.2, and the accuracy of the luminance level needs to be equal to the grayscale level accuracy raised to the power of 2.2. Therefore, a circuit for making a correction to the grayscale level can be realized at a lower cost than a circuit for making a correction to the luminance level.

The independent gamma correction processing section 280 and the correction section 300A shown in FIG. 1(*a*) may be incorporated in, for example, an integrated circuit (IC) which is provided in the frame region of the liquid crystal display panel 200A. In the above description, the liquid crystal display device 100A includes the independent gamma correction processing section 280, although the present invention is not limited to this example. The liquid crystal display device 100 may not include the independent gamma correction processing section 280.

Embodiment 2

In the above description, an adjustment of the luminance of the blue subpixels is performed by the unit of blue subpixels included in adjacent pixels, although the present invention is not limited to this example.

Figure 23:
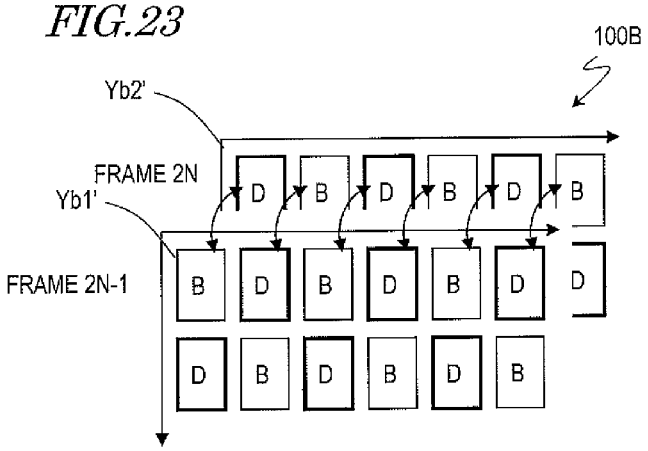
FIG. 23 A schematic diagram for illustrating the second embodiment of the liquid crystal display device of the present invention.

Hereinafter, the second embodiment of the liquid crystal display device of the present invention is described with reference to FIG. 23 and FIG. 24. The liquid crystal display device 100B of the present embodiment has the same configuration as that of the above-described display device of embodiment 1 except that an adjustment of the luminance of the blue subpixels is performed by the unit of blue subpixels of different frames. To avoid redundancy, repetitive description is not given herein.

First, the general structure of the liquid crystal display device 100B of the present embodiment is described with reference to FIG. 23. FIG. 23 only shows the blue subpixels of the liquid crystal display panel 200A of the liquid crystal display device 100B, while the red and green subpixels are not shown. In the liquid crystal display device 100B, an adjustment of the luminance of each blue subpixel is performed by the unit of blue subpixels of two consecutive frames. Where, in the input signal, the grayscale level of the blue subpixel B of the preceding frame (e.g., the $2N-1^{th}$ frame) is grayscale level b1 and the grayscale level of the blue subpixel B of the subsequent frame (e.g., the $2N^{th}$ frame) is grayscale level b2, the luminance of the blue subpixel B in the preceding frame in the liquid crystal display panel 200A is different from the luminance of the same blue subpixel B in the subsequent frame even when the middle grayscale level of each pixel represented by the input signal does not change (i.e., even when the grayscale level b1 is equal to the grayscale level b2) over multiple frames.

As for the blue subpixels included in adjacent pixels in a certain frame, even when all the pixels are at the same achromatic color level in the input signal, the blue subpixels included in adjacent pixels that are placed side by side along the row direction and the column direction in the liquid crystal display panel 200A are at different luminance levels, so that brighter blue subpixels and darker blue subpixels are arranged in a checkered pattern.

Figure 24:
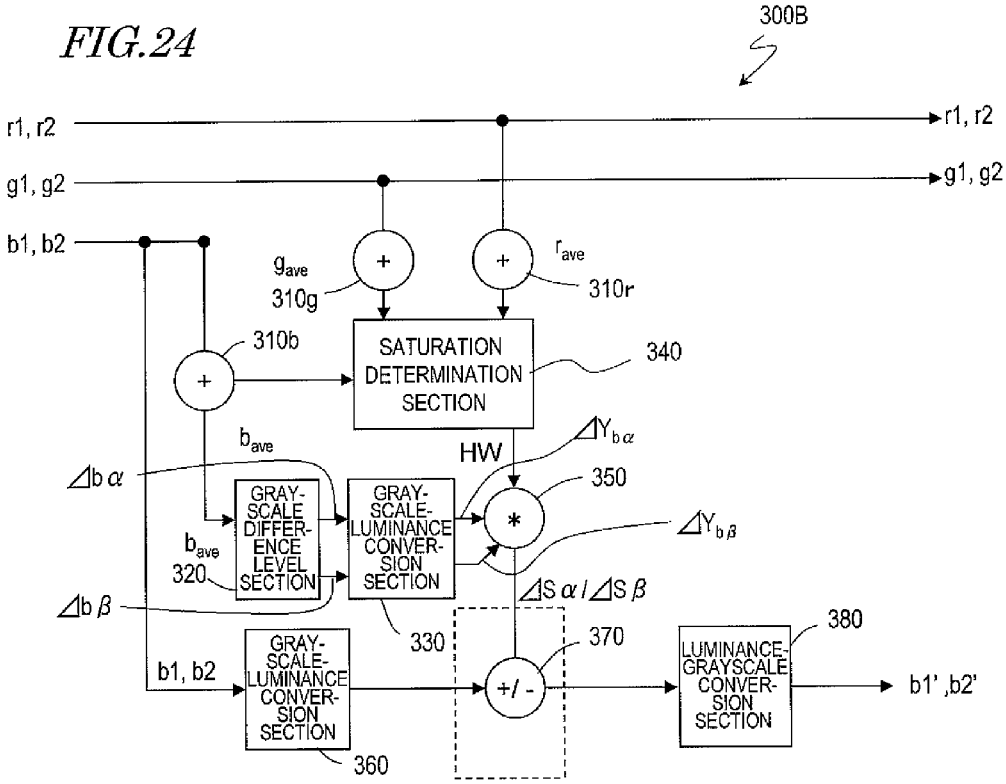
FIG. 24 A schematic diagram showing a structure of a correction section in the second embodiment of the liquid crystal display device of the present invention.

FIG. 24 is a schematic diagram of a correction section 300B in the liquid crystal display device 100B of the present embodiment. In the correction section 300B, at least under certain conditions, a correction is made to the grayscale level b1 of the preceding frame to obtain the grayscale level b1', and a correction is made to the grayscale level b2 of the subsequent frame to obtain the grayscale level b2'.

The grayscale levels b1', b2' output from the correction section 300B vary among frames. For example, as for the blue subpixel B of one pixel, the blue subpixel B exhibits the luminance corresponding to the grayscale level b1' in the immediately preceding frame (e.g., the $2N-1^{th}$ frame), and the blue subpixel B exhibits the luminance corresponding to the grayscale level b2' in the subsequent frame (e.g., the $2N^{th}$ frame). In this way, an adjustment of the luminance of the blue subpixels is performed by the unit of blue subpixels of different frames. Thereby, the color shift can be reduced without decreasing the resolution. Note that, in this case, from the viewpoint of the response speed of the liquid crystal molecules, it is preferred that the frame period is relatively long.

Embodiment 3

Hereinafter, the third embodiment of the liquid crystal display device of the present invention is described. FIG.

25(*a*) is a schematic diagram of a liquid crystal display device 100C of the present embodiment. The liquid crystal display device 100C has the same configuration as that of the above-described display device of embodiment 1 except that an adjustment of the luminance of the blue subpixels is performed by the unit of multiple divisional regions of the blue subpixel. To avoid redundancy, repetitive description is not given herein.

In the liquid crystal display device 100C, a correction section 300C generates two grayscale levels b1', b2' from the grayscale level b of the blue subpixel represented by the input signal. The independent gamma correction processing section 280 performs an independent gamma correction process.

Figure 25:
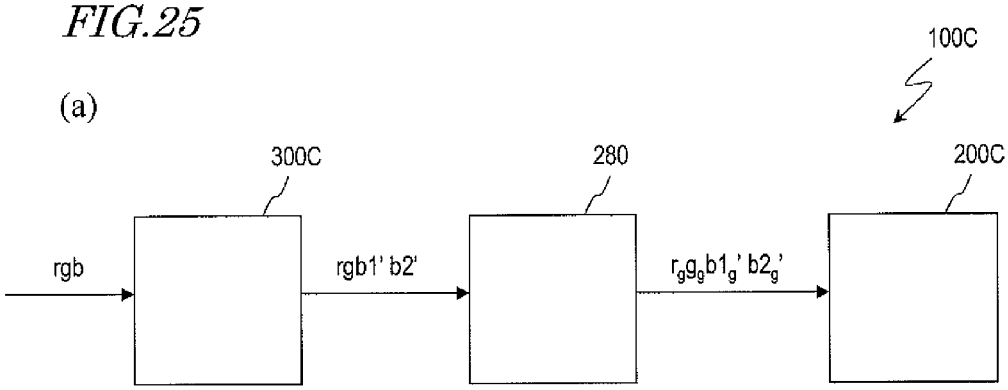
FIG. 25(*a*) is a schematic diagram showing the third embodiment of the liquid crystal display device of the present invention. (*b*) is a schematic diagram showing an arrangement of pixels in the liquid crystal display device shown in (*a*).
Figure 25:
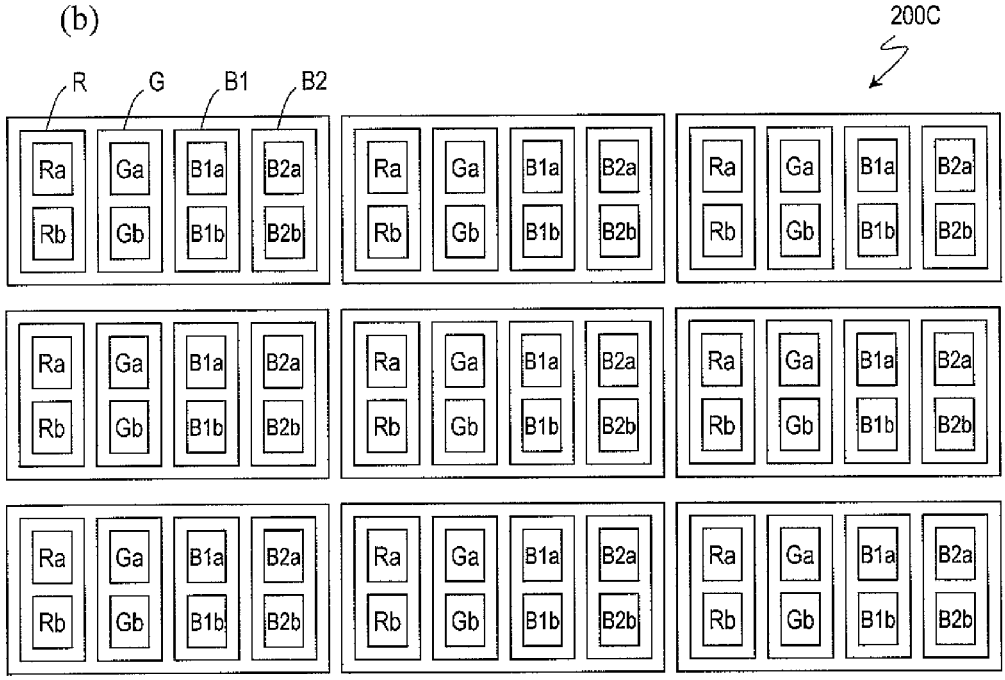

FIG. 25(*b*) is a schematic diagram of a liquid crystal display panel 200C in the liquid crystal display device 100C of the present embodiment. The pixel includes the red subpixel R, the green subpixel G, the first blue subpixel B1 and the second blue subpixel B2. Note that, in the liquid crystal display panel 200C, each of the subpixels R, G, B1 and B2 includes two divisional regions.

Specifically, the red subpixel R includes the first region Ra and the second region Rb. The green subpixel G includes the first region Ga and the second region Gb. The first blue subpixel B1 includes the first region B1*a* and the second region B1*b*. The second blue subpixel B2 includes the first region B2*a* and the second region B2*b*.

The correction section 300C shown in FIG. 25(*a*) does not makes a correction to the grayscale levels r and g represented by the input signal, for example, but generates the grayscale levels b1', b2' based on the grayscale level b represented by the input signal.

Then, the independent gamma correction processing section 280 performs an independent gamma correction process on each of the grayscale levels r, g, b1', b2'. By the independent gamma correction process, the grayscale levels r, g, b1', b2' are converted to the grayscale levels $r_g$, $g_g$, $b1_g'$ and $b2_g'$. The independent gamma correction processing section 280 outputs the grayscale levels $r_g$, $g_g$, $b1_g'$ and $b2_g'$ which have undergone the independent gamma correction process to the liquid crystal display panel 200C. Note that, in the liquid crystal display panel 200C, the luminances corresponding to the first and second regions Ra, Rb, Ga, Gb, B1*a*, B1*b*, B2*a* and B2*b* of the red, green, first blue and second blue subpixels R, G, B1, B2 are determined based on the grayscale levels $r_g$, $g_g$, $b1_g'$ and $b2_g'$.

Figure 26:
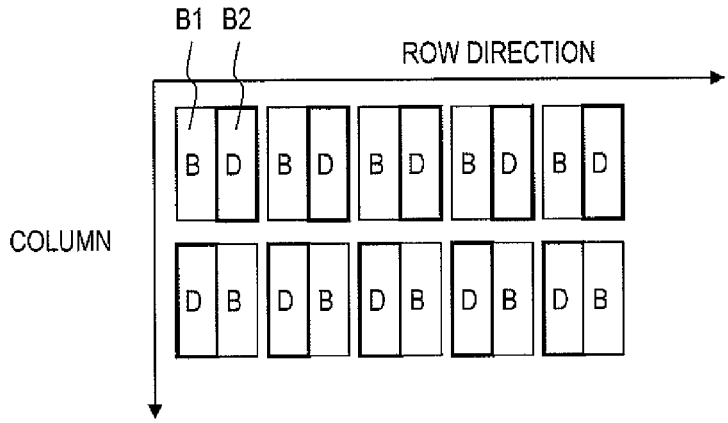
FIG. 26 A schematic diagram for illustrating the third embodiment of the liquid crystal display device of the present invention.

Next, the general structure of the liquid crystal display device 100C of the present embodiment is described with reference to FIG. 26. FIG. 26 only shows the first blue subpixels B1 and the second blue subpixels B2 of the liquid crystal display panel 200C of the liquid crystal display device 100C, while the red and green subpixels are not shown. In the liquid crystal display device 100C, an adjustment of the luminance of the blue subpixels is performed by the unit of two blue subpixels B1, B2 included in one pixel. The grayscale level of the blue subpixels included in one pixel represented by the input signal is the grayscale level b and, however, in the liquid crystal display panel 200C, the luminance of the first blue subpixel B1 is different from the luminance of the second blue subpixel B2. Note that, in the case where the first blue subpixels and the second blue subpixels included in adjacent pixels that are placed side by side along the column direction are arranged in a line along the column direction, for example, the luminance of the first blue subpixel included in a pixel of an odd-numbered row is higher than the luminance of the second blue subpixel included in the same pixel, and the luminance of the first blue subpixel included in a pixel of an even-numbered row is lower than the luminance of the second blue subpixel included in the same pixel.

Figure 27:
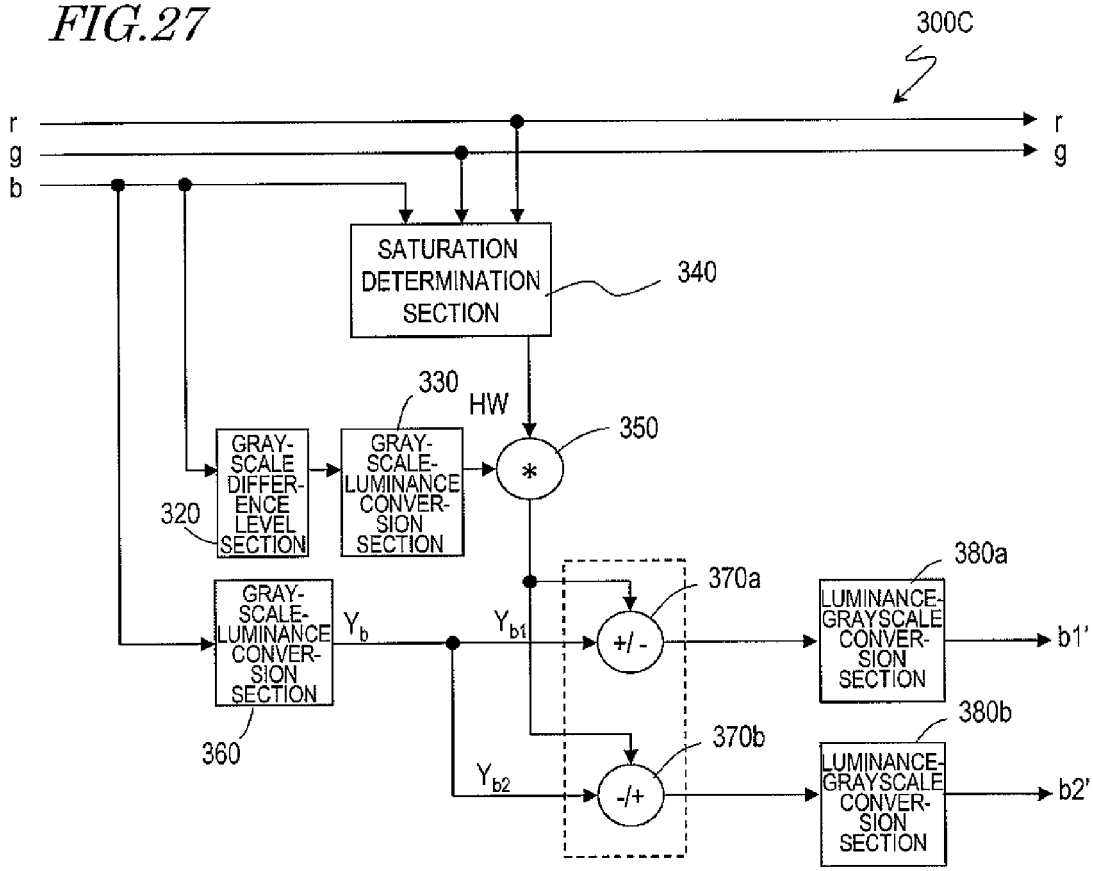
FIG. 27 A schematic diagram showing a structure of a correction section in the liquid crystal display device shown in FIG. 26.

FIG. 27 is a schematic diagram of the correction section 300C of the liquid crystal display device 100C. In the correction section 300C, the luminance level $Y_b$ obtained in a grayscale-luminance conversion section 360 is equal to the luminance level $Y_{b1}$ and the luminance level $Y_{b2}$. Therefore, the luminance levels $Y_{b1}$ and $Y_{b2}$ are equal to each other before the operations in the addition/subtraction sections 370*a*, 370*b*. The grayscale level b1' obtained in the correction section 300C corresponds to the first blue subpixel B1, and the grayscale level b2' corresponds to the second blue subpixel B2.

As previously described, the first blue subpixel B1 includes the first region B1*a* and the second region B1*b*, and the second blue subpixel B2 includes the first region B2*a* and the second region B2*b*. For example, the average luminance of the brighter region and the darker region of the brighter blue subpixel is the grayscale level b1', and the average luminance of the brighter region and the darker region of the darker blue subpixel is the grayscale level b2'.

Note that, in the liquid crystal display panel 200C shown in FIG. 25(*b*), each of the subpixels R, G and B includes two divisional regions, although the present invention is not limited to this example. Each of the subpixels R, G and B may include three or more divisional regions. Alternatively, each of the subpixels R, G and B may not include multiple divisional regions. For example, each of the subpixels R, G and B may be formed by a single region.

Figure 28:
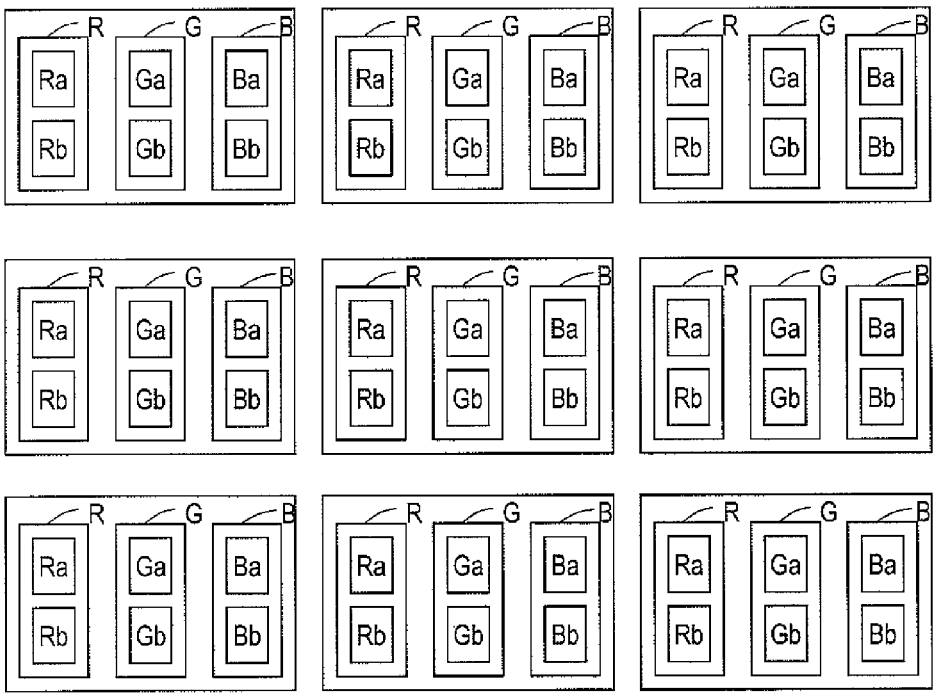
FIG. 28(*a*) is a schematic diagram showing a liquid crystal display device of a variation of the third embodiment. (*b*) is a schematic diagram showing the structure of a blue subpixel.
Figure 28:
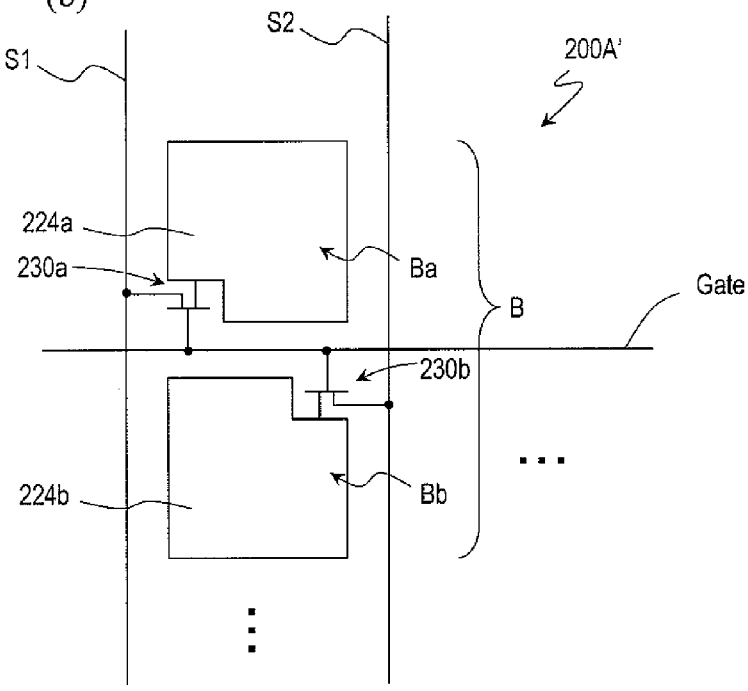

In the above description, each pixel includes two blue subpixels, although the present invention is not limited to this example. As shown in FIG. 28(*a*), each pixel may includes one blue subpixel B that includes the first region Ba corresponding to the grayscale level b1' and the second region Bb corresponding to the grayscale level b2'. FIG. 28(*b*) shows the structure of the blue subpixel B. A separate electrode 224*a* which corresponds to the first region Ba of the blue subpixel B and a separate electrode 224*b* which corresponds to the second region Bb are electrically coupled to different source lines via different TFTs.

Embodiment 4

In the above-described liquid crystal display devices, the pixel performs display using three primary colors, although the present invention is not limited to this example. The pixel may perform display using four or more primary colors.

Figure 29:
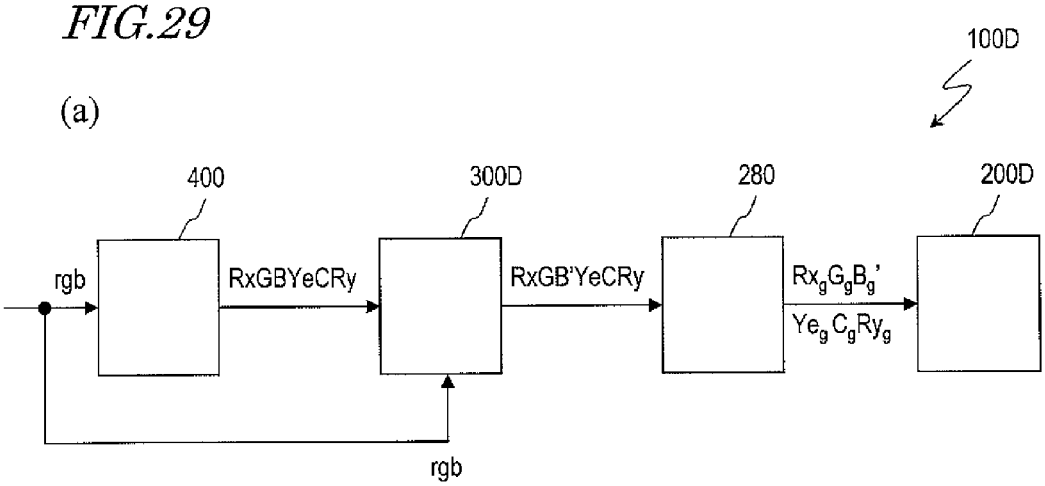
FIG. 29(*a*) is a schematic diagram showing the fourth embodiment of the liquid crystal display device of the present invention. (*b*) is a schematic diagram showing an arrangement of pixels in the liquid crystal display device shown in (*a*).
Figure 29:
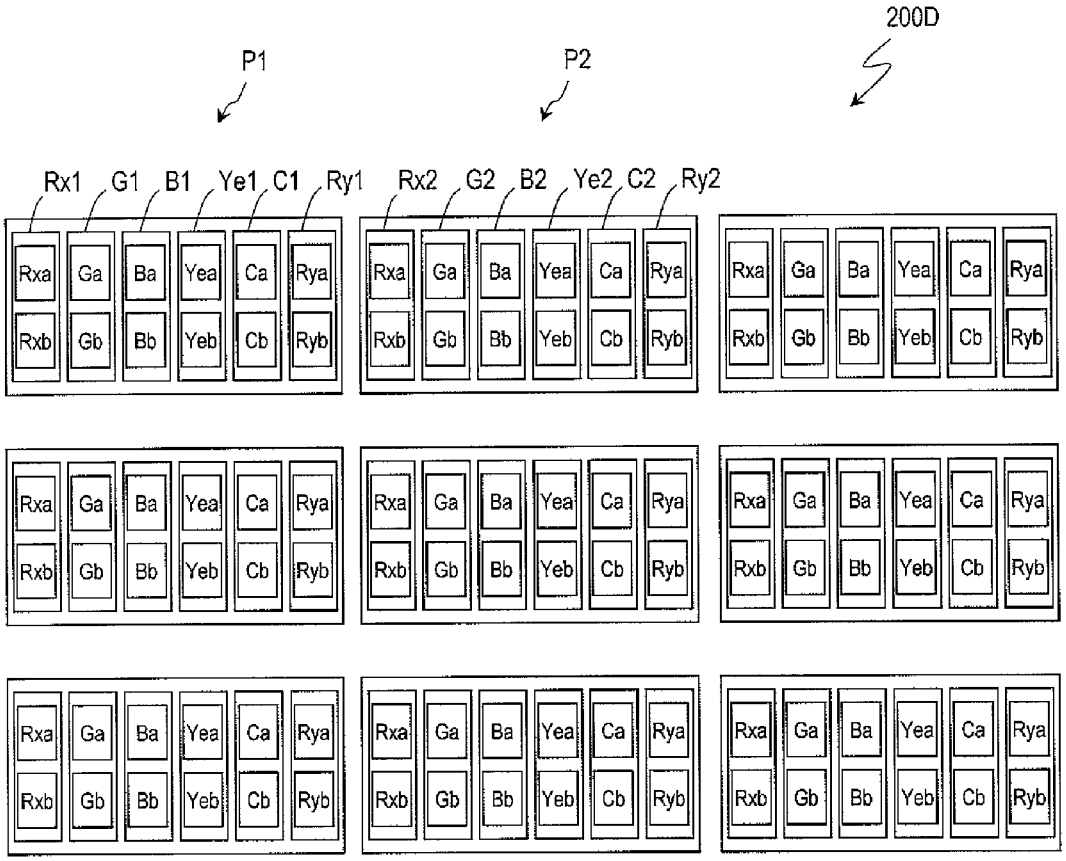

Hereinafter, the fourth embodiment of the liquid crystal display device of the present invention is described. FIG. 29(*a*) is a schematic diagram of a liquid crystal display device 100D of the present embodiment. The liquid crystal display device 100D further includes a multi-primary color conversion section 400 in addition to a liquid crystal display panel 200D, an independent gamma correction processing section 280, and a correction section 300D. In the liquid crystal display panel 200D, each pixel includes three or more subpixels which provide different colors. In the description below, the liquid crystal display panel 200D is sometimes referred to as a multi-primary color display panel 200D.

The multi-primary color conversion section 400 generates a multi-primary color signal based on the input signal which represents the grayscale levels rgb. The multi-primary color signal represents the grayscale levels R1 GBYeCR2 which correspond to the respective subpixels included in a pixel of the liquid crystal display panel 200D.

The correction section 300D makes, at least under predetermined conditions, a correction to the grayscale level, or the luminance level corresponding to the grayscale level, of at least the blue subpixel that is one of the subpixels represented by the multi-primary color signal. The independent gamma correction processing section 280 performs an independent gamma correction process.

FIG. 29(*b*) shows an arrangement of pixels provided in the multi-primary color display panel 200D and subpixels included in the pixels. In FIG. 29(*b*), as an example, pixels arranged in three rows and three columns are shown. Each pixel includes six types of subpixels, namely, a first red subpixel Rx, a green subpixel G, a blue subpixel B, a yellow subpixel Ye, a cyan subpixel C, and a second red subpixel Ry. In the multi-primary color display panel 200D, one color is expressed by one pixel that includes the first red subpixel Rx, the green subpixel G, the blue subpixel B, the yellow subpixel Ye, the cyan subpixel C, and the second red subpixel Ry. The luminance of each subpixel is independently controlled. Note that the arrangement of the color filter of the multi-primary color display panel 200D corresponds to the configuration shown in FIG. 29(*b*).

In the multi-primary color display panel 200D, each f the subpixels Rx, G, B, Ye, C and Ry includes two divisional regions. Specifically, the first red subpixel Rx includes the first region Rxa and the second region Rxb. The green subpixel G includes the first region Ga and the second region Gb. The blue subpixel B includes the first region Ba and the second region Bb. The yellow subpixel Ye includes the first region Yea and the second region Yeb. The cyan subpixel C includes the first region Ca and the second region Cb. The second red subpixel Ry includes the first region Rya and the second region Ryb. Note that, in the description below, one of two adjacent pixels that are placed side by side along the row direction is labeled "P1", and the first red, green, blue, yellow, cyan, and second red subpixels included in the pixel P1 are labeled "Rx1", "G1", "B1", "Ye1", "C1", and "Ry1". The other pixel is labeled "P2", and the red, green, and blue subpixels included in the pixel P2 are labeled "Rx2", "G2", "B2", "Ye2", "C2", and "Ry2".

In general, red, green and blue are called "three additive primaries", while yellow, cyan and magenta are called "three subtractive primaries". Some multi-primary color display panels are provided with six subpixels corresponding to the three additive primaries and the three subtractive primaries. However, in the example described herein, the second red subpixel Ry is provided in place of the magenta subpixel. Thus, in the multi-primary color display panel 200D, each pixel includes six types of subpixels, but the number of primary colors is five. Such a subpixel arrangement is disclosed in, for example, Patent Document 4.

In the description below, for the sake of convenience, the luminance level of a subpixel corresponding to the lowest grayscale level (e.g., grayscale level 0) is represented by "0", and the luminance level of a subpixel corresponding to the highest grayscale level (e.g., grayscale level 255) is represented by "1". Even when the red, green, blue, yellow and cyan subpixels have equal luminance levels, the actual luminances of these subpixels are different. The luminance level is the ratio of the luminance of each subpixel to the highest luminance.

For example, in the case where the color of a pixel which is represented by the input signal is black, all the grayscale levels r, g and b represented by the input signal are the lowest grayscale level (e.g., grayscale level 0). All the grayscale levels Rx, G, B, Ye, C, Ry, which are the results of a multi-primary color conversion of the grayscale levels r, g and b, are the lowest grayscale level (e.g., grayscale level 0). Alternatively, in the case where the color of a pixel represented by the input signal is white, all the grayscale levels r, g and b are the highest grayscale level (e.g., grayscale level 255). All the grayscale levels Rx, G, B, Ye, C, Ry, which are the results of a multi-primary color conversion of the grayscale levels r, g and b, are the highest grayscale level (e.g., grayscale level 255). Many of the TV sets recently circulated in the market allow the user to adjust the color temperature, and the adjustment of the color temperature is realized by finely adjusting the luminance of each subpixel. Here, the luminance level after the adjustment to a desired color temperature is represented by "1".

The six subpixels included in one pixel are aligned along the row direction. As for subpixels included in adjacent pixels that are placed side by side along the row direction, the order of arrangement along the row direction of the first red subpixel Rx, the green subpixel G, the blue subpixel B, the yellow subpixel Ye, the cyan subpixel C and the second red subpixel Ry included in one of the adjacent pixels is the same as the order of arrangement of the subpixels included the other one of the adjacent pixels. Thus, the subpixels are periodically arranged.

The multi-primary color conversion section 400 shown in FIG. 29(*a*) generates a multi-primary color signal based on, for example, an input signal for a three primary color display device. The input signal to the three primary color display device represents the grayscale levels r, g and b of the red, green and blue subpixels. Usually, the grayscale levels r, g and b are in an 8-bit representation. Alternatively, the input signal may have a value convertible to the grayscale levels r, g and b of the red, green and blue subpixels. This value is in a three-dimensional representation. The input signal has already undergone a gamma correction process. In FIG. 29, the grayscale levels r, g and b of the input signal are represented by a single symbol, rgb. When the input signal is compliant with the BT.709 standards, the grayscale levels r, g and b represented by the input signal are each within the range from the lowest grayscale level (e.g., grayscale level 0) to the highest grayscale level (e.g., grayscale level 255). The luminances of the red, green and blue subpixels are within the range of "0" to "1". The input signal is, for example, a YCrCb signal.

The multi-primary color conversion section 400 converts the grayscale levels rgb of the input signal to the grayscale levels RxGBYeCRy. In the description provided below in this specification, the grayscale levels of the first red subpixel Rx, the green subpixel G, the blue subpixel B, the yellow subpixel Ye, the cyan subpixel C and the second red subpixel Ry are also represented by "Rx", "G", "B", "Ye", "C" and "Ry", respectively. In FIG. 29(*a*), the grayscale levels Rx, G, B, Ye, C and Ry are represented by a single symbol, RxGBYeCRy. Possible values for grayscale levels Rx, G, B, Ye, C, Ry are from 0 to 255. The multi-primary color conversion section 400 has, for example, an unshown lookup table. The lookup table may contain data which represent the grayscale levels of the red, green, blue, yellow and cyan subpixels corresponding to the grayscale levels r, g and b of the three primary colors. Note that the color specified by the grayscale levels RxGBYeCRy is basically the same as the color specified by the grayscale levels rgb, but these colors may be different as necessary.

The independent gamma correction processing section 280 performs an independent gamma correction process to correct the grayscale error included in the grayscale levels RxGBYeCRy obtained in the multi-primary color conversion section 400. This grayscale error is specific to the liquid crystal display panel 200D. For example, the independent gamma correction processing section 280 may refer to the lookup table to perform an independent gamma correction process or may perform an arithmetic operation based on the respective grayscale levels.

In the liquid crystal display device 100D, the correction section 300D is interposed between the multi-primary color conversion section 400 and the independent gamma correction processing section 280. The grayscale levels which have undergone a multi-primary color conversion are corrected in the correction section 300D. For example, the correction section 300D corrects the grayscale level B to the grayscale level B', without making a correction to the grayscale levels Rx, G, Ye, C and Ry represented by the multi-primary color signal. The details of this correction will be described later with reference to FIG. 33. Since the independent gamma correction processing section 280 is provided at a stage which is subsequent to the correction section 300D, a grayscale-luminance conversion performed in the correction section 300D can be carried out with a constant exponent (e.g., 2.2).

Note that, in the liquid crystal display panel 200D, the color filter for the first red subpixel is made of the same material as that of the color filter for the second red subpixel, and the hue of the first red subpixel Rx is equal to that of the second red subpixel Ry. The second red subpixel Ry and the first red subpixel Rx are coupled to different signal lines (not shown). The second red subpixel Ry can be controlled independently of the first red subpixel Rx. However, herein, the voltage applied across the liquid crystal layer of the first red subpixel Rx is equal to the voltage applied across the liquid crystal layer of the second red subpixel Ry. The color displayed by the first red subpixel Rx is equal to the color displayed by the second red subpixel Ry. Thus, in the description below, unless otherwise specifically described, the grayscale level (e.g., 0 to 255) and the luminance level ("0" to "1") of the red subpixel mean the total grayscale level and the total luminance level of the two red subpixels.

Figure 30:
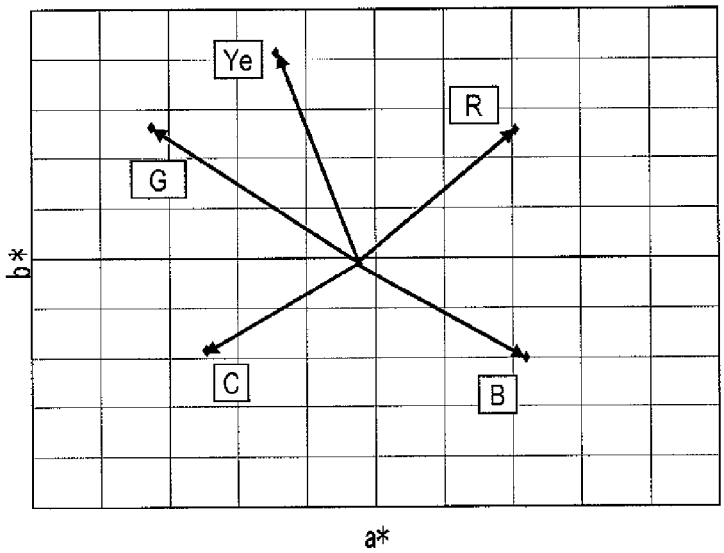
FIG. 30 A schematic diagram showing the a*b* plane of the L*a*b* color space in the liquid crystal display device shown in FIG. 29.

FIG. 30 schematically shows the a*b* plane of the L*a*b* color space in which the a* and b* coordinates of the colors of the respective subpixels of the display device of the present embodiment are plotted. Table 1 shows the X, Y and Z values and the x and y values of the respective colors of the six subpixels. Note that the values of the respective colors of the six subpixels correspond to the values of the colors which are provided when the respective subpixels are at the highest grayscale level.

TABLE 1

| | X | Y | Z | x | y |
|---|---|---|---|---|---|
| red subpixel | 0.011 | 0.005 | 0.000 | 0.677 | 0.311 |
| yellow subpixel | 0.013 | 0.017 | 0.000 | 0.439 | 0.550 |
| green subpixel | 0.003 | 0.008 | 0.001 | 0.242 | 0.677 |
| cyan subpixel | 0.002 | 0.004 | 0.006 | 0.142 | 0.372 |
| blue subpixel | 0.006 | 0.002 | 0.033 | 0.145 | 0.053 |
| white | 0.035 | 0.036 | 0.040 | 0.313 | 0.329 |

In the case where the color represented by a pixel is changed from black to white by equally increasing the luminances of the respective subpixels, the color displayed by the pixel changes while it remains achromatic when viewed from the front viewing direction. However, when viewed from the oblique viewing direction, the achromatic color may sometimes be perceived as having some hue.

Hereinafter, the advantages of the liquid crystal display device 100D of the present embodiment are described as compared to a liquid crystal display device of Comparative Example 3. First, the liquid crystal display device of Comparative Example 3 is described. The liquid crystal display device of Comparative Example 3 has basically the same configuration as that of the liquid crystal display device 100D except that it does not include a component which is equivalent to the correction section 300D. The liquid crystal display device of Comparative Example 3 has the same subpixel arrangement as that of the liquid crystal display device 100D of the present embodiment. Note that, herein, the input signal to the liquid crystal display device is such that all the pixels over the entire screen display an achromatic color. The grayscale levels of the subpixels in the input signal increase at equal rates such that the lightness of the achromatic color changes from black to white. Specifically, in an initial state, the achromatic color represented by the input signal is black, and the luminances of the red, green, blue, yellow and cyan subpixels are "0". The grayscale levels of the red, green, blue, yellow and cyan subpixels increase at equal rates. As the luminances of the red, green, blue, yellow and cyan subpixels increase, the lightness of the achromatic color displayed by the pixel increases. When the luminances of the red, green, blue, yellow and cyan subpixels increase to reach "1", the achromatic color represented by the input signal is white.

Figure 31:
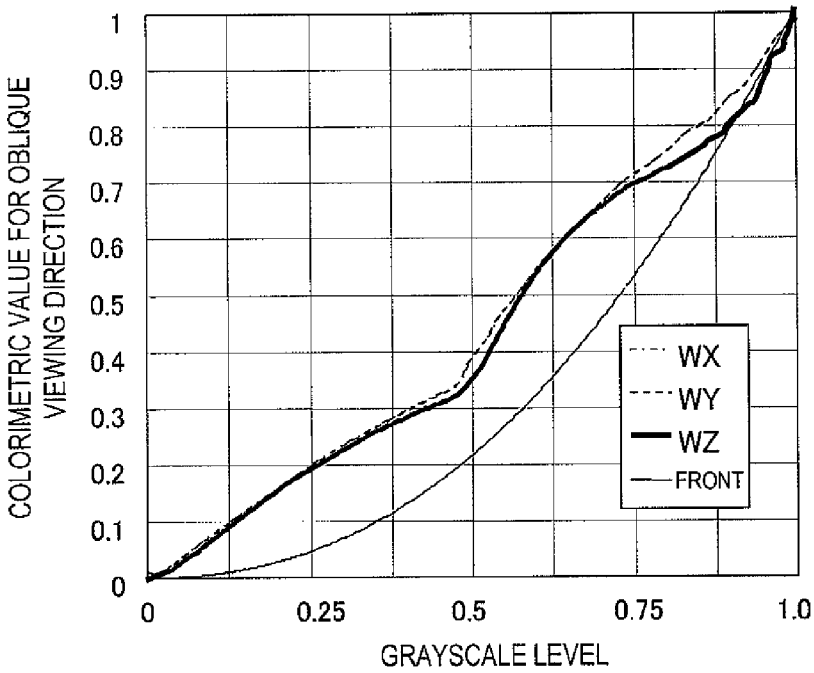
FIG. 31(*a*) is a graph showing the change of the colorimetric values for the oblique viewing direction with respect to the change of the grayscale level in a liquid crystal display device of Comparative Example 3. (*b*) is a schematic diagram showing the change of the color which is displayed by a pixel in the liquid crystal display device of Comparative Example 3.
Figure 31:
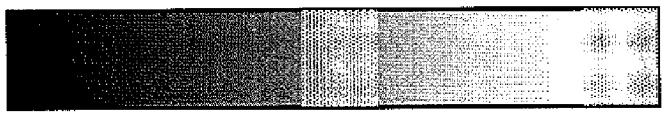

Hereinafter, the change of the colorimetric values of the X value, the Y value and the Z value with respect to the change of the grayscale level in the liquid crystal display device of Comparative Example 3 is described with reference to FIG. 31. In FIG. 31(*a*), WX, WY and WZ represent the change of the colorimetric values of the X value, the Y value and the Z value, respectively, with respect to the change of the grayscale level for the oblique viewing direction. Note that the X value, the Y value and the Z value for the front viewing direction change in the same fashion. In FIG. 31(*a*), the X value, the Y value and the Z value for the front viewing direction are collectively represented by a single curve labeled "front". The liquid crystal display device of Comparative Example 3 used herein is a VA mode liquid crystal display device. The "oblique viewing direction" refers to a direction that is inclined from the normal to the screen by 60°. In the liquid crystal display device of Comparative Example 3, the grayscale levels of the respective subpixels change at equal increase rates.

In the liquid crystal display device of Comparative Example 3, each subpixel includes multiple divisional regions, so that a whitening phenomenon is prevented. To further prevent the whitening phenomenon, the X value, the Y value and the Z value for the oblique viewing direction preferably change in the same fashion as those for the front viewing direction. In this respect, the X value and the Y value are more distant from the curve for the front viewing direction than the Z value is. In other words, the X value and the Y value have larger deviations from the values for the front viewing direction. Thus, from the viewpoint of preventing whitening, the X value, the Y value and the Z value (particularly, the X value and the Y value among these values) are preferably made closer to the values for the front viewing direction.

On the other hand, comparing the changes of the X value, the Y value and the Z value for the oblique viewing direction, the X value, the Y value and the Z value seem to change in basically the same fashion. More strictly, however, the Z value for the oblique viewing direction changes in a different fashion from the X value and the Y value at least in part of the grayscale level range. Specifically, the Z value is different from the X value and the Y value at around grayscale level 0.5 and around grayscale level 0.9. In the case where the Z value is different from the X value and the Y value, the achromatic color looks yellowish when viewed from the oblique viewing direction.

FIG. 31(*b*) shows the change of the color which is perceived when viewed from the oblique viewing direction as the color changes from black to white. When viewed from the oblique viewing direction, the achromatic color at the middle grayscale levels sometimes looks to have a shift toward yellow so that, in the case of the liquid crystal display device of Comparative Example 3, the display quality would deteriorate.

Even in the multi-primary color display device, the achromatic color at the middle grayscale levels sometimes looks to have a shift toward yellow. In the case of the liquid crystal display device of Comparative Example 3, the display quality would deteriorate. To prevent such a yellow shift, simply changing the luminance of yellow leads to a change in luminance for the front viewing direction, so that the display quality for the front viewing direction also deteriorates.

Figure 32:
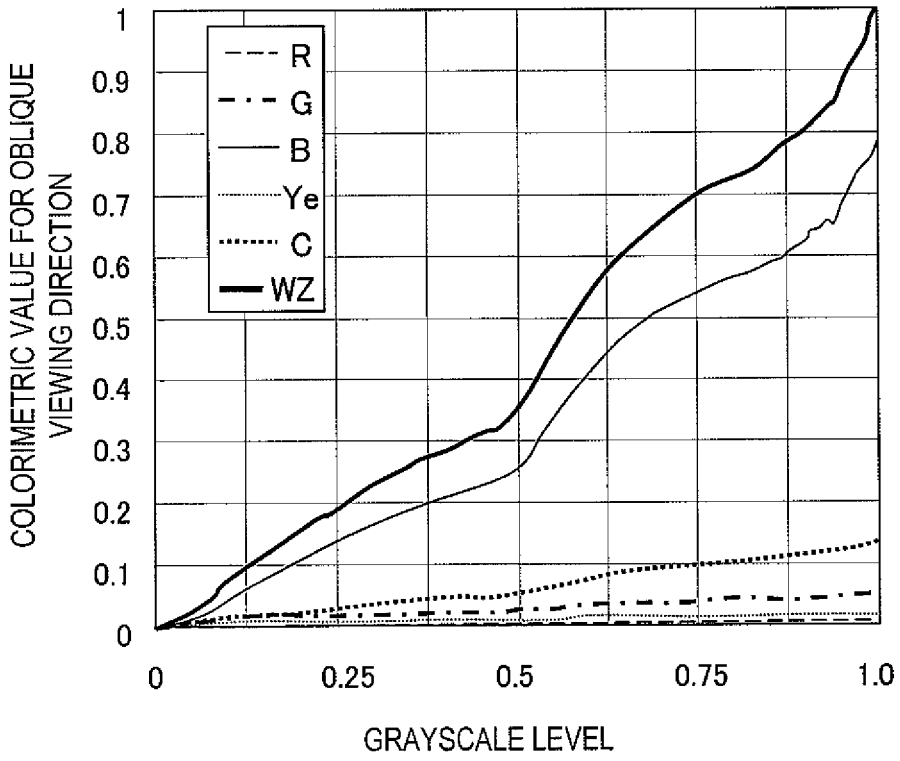
FIG. 32 A graph showing the colorimetric value of the Z value for the oblique viewing direction with respect to the change of the grayscale level in each subpixel and in the entire pixel of the liquid crystal display device of Comparative Example 3.

Now, the proportion of the components of the respective subpixels to the colorimetric value of the Z value in the liquid crystal display device of Comparative Example 3 is described with reference to FIG. 32. In FIG. 32, R, G, B, Ye and C respectively represent the Z value components of the red, green, blue, yellow and cyan subpixels, and WZ represents the Z value of the entire pixel. The Z value of the entire pixel is equal to the sum of the Z value components of the red, green, blue, yellow and cyan subpixels. As understood from FIG. 32, the component of the blue subpixel is larger than the components of the red, green, yellow and cyan subpixels. Note that, in Table 1, the ratio of the component of the blue subpixel to the Z value of the white display is large as compared with the other subpixels.

The present inventors found that, even in multi-primary color display, an adjustment of the luminance of the blue subpixels is performed by the unit of a plurality of blue subpixels whose luminance can be independently controlled, whereby the yellow shift can be reduced. In the liquid crystal display device 100D of the present embodiment, the blue subpixels included in adjacent pixels that are placed side by side along the row direction have different luminances. Note that the correction to the X value and the Y value may be realized by correcting the grayscale level of the yellow subpixel. In this case, however, undesirably, the resolution substantially decreases as the difference in grayscale level between yellow subpixels increases.

Figure 33:
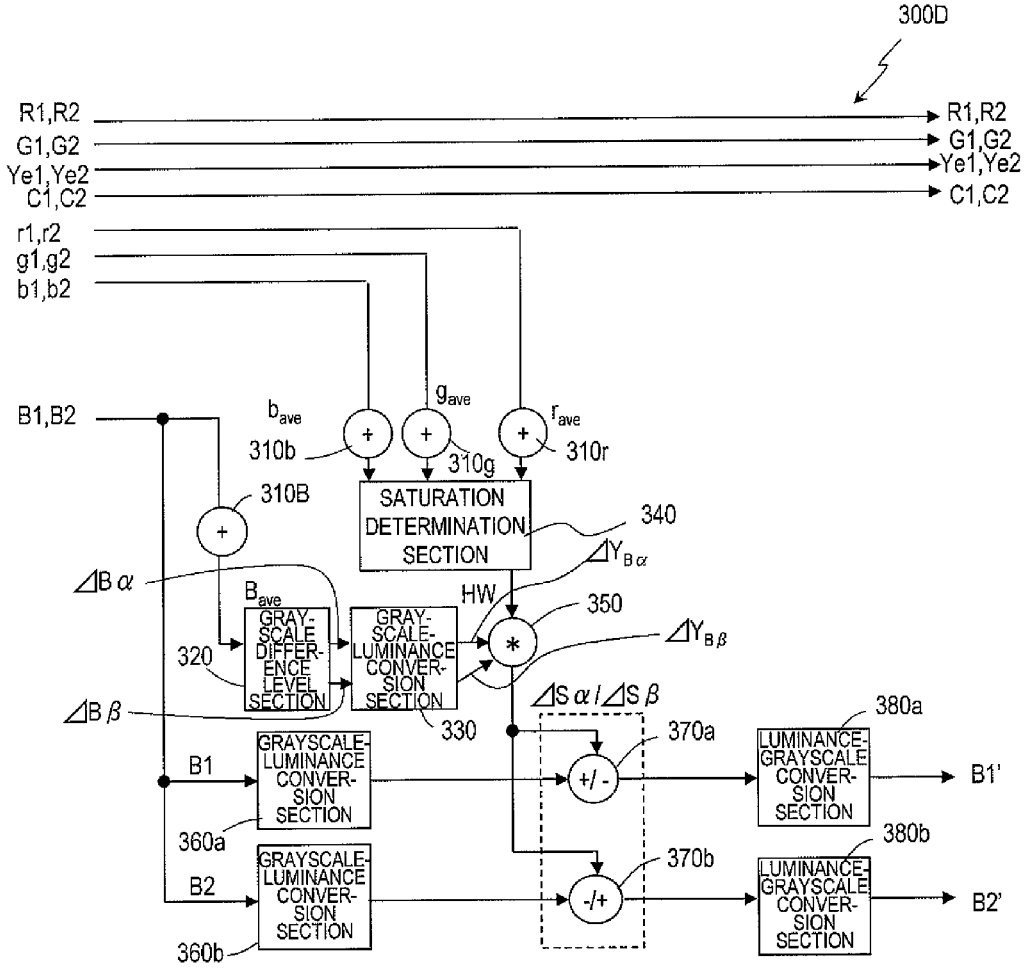
FIG. 33 A schematic diagram showing a structure of a correction section in the liquid crystal display device shown in FIG. 29.

Now, the components of the correction section 300D and their operation are described with reference to FIG. 33. In FIG. 33, the grayscale levels R1, G1, B1, Ye1, C1 represented by the multi-primary color signal are equivalent to the grayscale levels of the respective subpixels included in the pixel P1, and the grayscale levels R2, G2, B2, Ye2, C2 represented by the multi-primary color signal are equivalent to the grayscale levels of the respective subpixels included in the pixel P2.

The correction section 300D corrects the grayscale level or luminance level of the blue subpixel such that the change of the Z value is identical with, or has similarity to, the change of the X value and the Y value. In the correction section 300D, the grayscale levels R1, R2, G1, G2, Ye1, Ye2, C1 and C2 are not corrected, while the grayscale levels B1 and B2 are corrected as described below. The correction section 300D produces the shift amounts ΔSα, ΔSβ of the luminance levels of the blue subpixels B1, B2.

First, the addition section 310B is used to obtain the average of the grayscale level B1 and the grayscale level B2. In the description below, the average of the grayscale levels B1 and B2 is referred to as "average grayscale level $B_{ave}$".

The grayscale difference level section 320 generates two grayscale difference levels ΔBα, ΔBβ from one average grayscale level $B_{ave}$. The average grayscale level $B_{ave}$ and the grayscale difference levels ΔBα, ΔBβ have a predetermined relationship. The grayscale difference level ΔBα corresponds to the brighter blue subpixel. The grayscale difference level ΔBβ corresponds to the darker blue subpixel.

When the average grayscale level $B_{ave}$ is a low grayscale level, the grayscale difference levels ΔBα and ΔBβ are approximately zero. When the average grayscale level $B_{ave}$ is a middle grayscale level, the grayscale difference level ΔBα and the grayscale difference level ΔBβ are relatively high. Note that these grayscale difference levels ΔBα, ΔBβ are not directly associated with the grayscale levels B1, B2 represented by the input signal. The grayscale difference level section 320 may refer to a lookup table for average grayscale level $B_{ave}$ to determine the grayscale difference levels ΔBα, ΔBβ. Alternatively, the grayscale difference level section 320 may have data about the grayscale levels corresponding to the brighter blue subpixel and the darker blue subpixel to calculate the difference from the average grayscale level $B_{ave}$. Alternatively, the grayscale difference level section 320 may perform a predetermined operation to determine the grayscale difference levels ΔBα, ΔBβ based on the average grayscale level $B_{ave}$. Then, the grayscale-luminance conversion section 330 converts the grayscale difference level ΔBα to the luminance difference level $\Delta Y_B\alpha$ and the grayscale difference level ΔBβ to the luminance difference level $\Delta Y_B\beta$.

A yellow shift is less perceivable as the saturation of the color of a pixel which is represented by the input signal increases. On the contrary, a yellow shift is more conspicuous as the color of a pixel which is represented by the input signal is closer to an achromatic color. Thus, the degree of a yellow shift varies depending on the color of a pixel which is represented by the input signal. The color of a pixel which is represented by the input signal is reflected in the shift amounts ΔSα, ΔSβ as described below.

The correction section 300D is also supplied with a three primary color signal which has not yet undergone a multi-primary color conversion. The addition section 310*r* is used to obtain the average of the grayscale level r1 and the grayscale level r2. The addition section 310*g* is used to obtain the average of the grayscale level g1 and the grayscale level g2. The addition section 310*b* is used to obtain the average of the grayscale level b1 and the grayscale level b2. In the description below, the average of the grayscale levels r1 and r2 is referred to as "average grayscale level $r_{ave}$", the average of the grayscale levels g1 and g2 is referred to as "average grayscale level $g_{ave}$", and the average of the grayscale levels b1 and b2 is referred to as "average grayscale level $b_{ave}$".

A saturation determination section 340 determines the saturation of a pixel which is represented by the input signal. The saturation determination section 340 utilizes the average grayscale levels $r_{ave}$, $g_{ave}$, $b_{ave}$ to determine the saturation factor HW. The saturation factor HW is a function which decreases as the saturation increases. In the description below, where MAX=MAX ($r_{ave}$, $g_{ave}$ $b_{ave}$) and MIN=MIN ($r_{ave}$, $g_{ave}$, $b_{ave}$), the saturation factor HW is expressed as, for example, HW=MIN/MAX. Note that, for the saturation factor HW, the saturation determination section 340 may generate $R_{ave}$, $G_{ave}$, $Ye_{ave}$, $C_{ave}$ which are the averages of the grayscale levels R1, R2, G1, G2, Ye1, Ye2, C1, C2, before it utilizes $R_{ave}$, $G_{ave}$, $B_{ave}$, $Ye_{ave}$, $C_{ave}$. In this case, $R_{ave}$, $G_{ave}$, $B_{ave}$, $Ye_{ave}$, $C_{ave}$ correspond to the average grayscale levels which are based on the grayscale levels represented by the input signal, and therefore, a correction to the blue subpixel is made indirectly depending on the saturation of the pixel represented by the input signal. Note that the determination of the saturation can be sufficiently performed using the average grayscale levels $r_{ave}$, $g_{ave}$, $b_{ave}$, so that complicated procedure can be avoided.

Then, the shift amounts ΔSα, ΔSβ are obtained. The shift amount ΔSα is represented by the product of $\Delta Y_B\alpha$ and the saturation factor HW, and the shift amount ΔSβ is represented by the product of $\Delta Y_B\beta$ and the saturation factor HW. The multiplication section 350 multiplies the luminance difference level ΔY by the saturation factor HW to obtain the shift amounts ΔSα, ΔSβ.

The grayscale-luminance conversion section 360*a* performs a grayscale-luminance conversion on the grayscale level B1 to obtain the luminance level $Y_{B1}$. For example, the luminance level $Y_{B1}$ may be obtained according to the following formula:

$$Y_{B1}=B1^{2.2}.$$

Likewise, the grayscale-luminance conversion section 360*b* performs a grayscale-luminance conversion on the grayscale level B2 to obtain the luminance level $Y_{B2}$.

Then, in the addition/subtraction section 370*a*, the luminance level $Y_{B1}$ and the shift amount ΔSα are added together, and the luminance-grayscale conversion section 380*a* performs a luminance-grayscale conversion to obtain a corrected grayscale level B1'. Meanwhile, in the addition/subtraction section 370*b*, the shift amount αSβ is subtracted from the luminance level $Y_{B2}$, and the luminance-grayscale conversion section 380*b* performs a luminance-grayscale conversion to obtain a corrected grayscale level B2'. The grayscale levels B1', B2' undergo an independent gamma correction process in the independent gamma correction processing section 280 shown in FIG. 29(*a*) in the same way as for R1, R2, G1, G2, Ye1, Ye2, C1 and C2.

Based on the thus-obtained grayscale levels B1', B2', the blue subpixel B1 exhibits a luminance which is equivalent to the sum of the luminance level $Y_{B1}$ and the shift amount ΔSα, and the blue subpixel B2 exhibits a luminance which is equivalent to the difference between the luminance level $Y_{B2}$ and the shift amount ΔSβ. Note that, as previously described, in the liquid crystal display panel 200D, a pixel includes multiple divisional regions. The grayscale level B1' of the blue subpixel B1 is realized by a brighter region and a darker region. The grayscale level B2' of the blue subpixel B2 is realized by a brighter region and a darker region. As for the blue subpixels included in adjacent pixels that are placed side by side along the row direction and the column direction, even when all the pixels are at the same achromatic color level in the input signal, the blue subpixels included in the adjacent pixels that are placed side by side along the row direction and the column direction in the liquid crystal display panel 200D are at different luminance levels, so that brighter blue subpixels and darker blue subpixels are arranged in a checkered pattern.

Note that, even in the correction section 300D, the resolution may sometimes deteriorate at an edge portion of display as previously described with reference to FIG. 13. In this case, a correction to the grayscale level of the blue subpixels is preferably made with a consideration for the difference in grayscale level between the blue subpixels included in adjacent pixels represented by the input signal.

Figure 34:
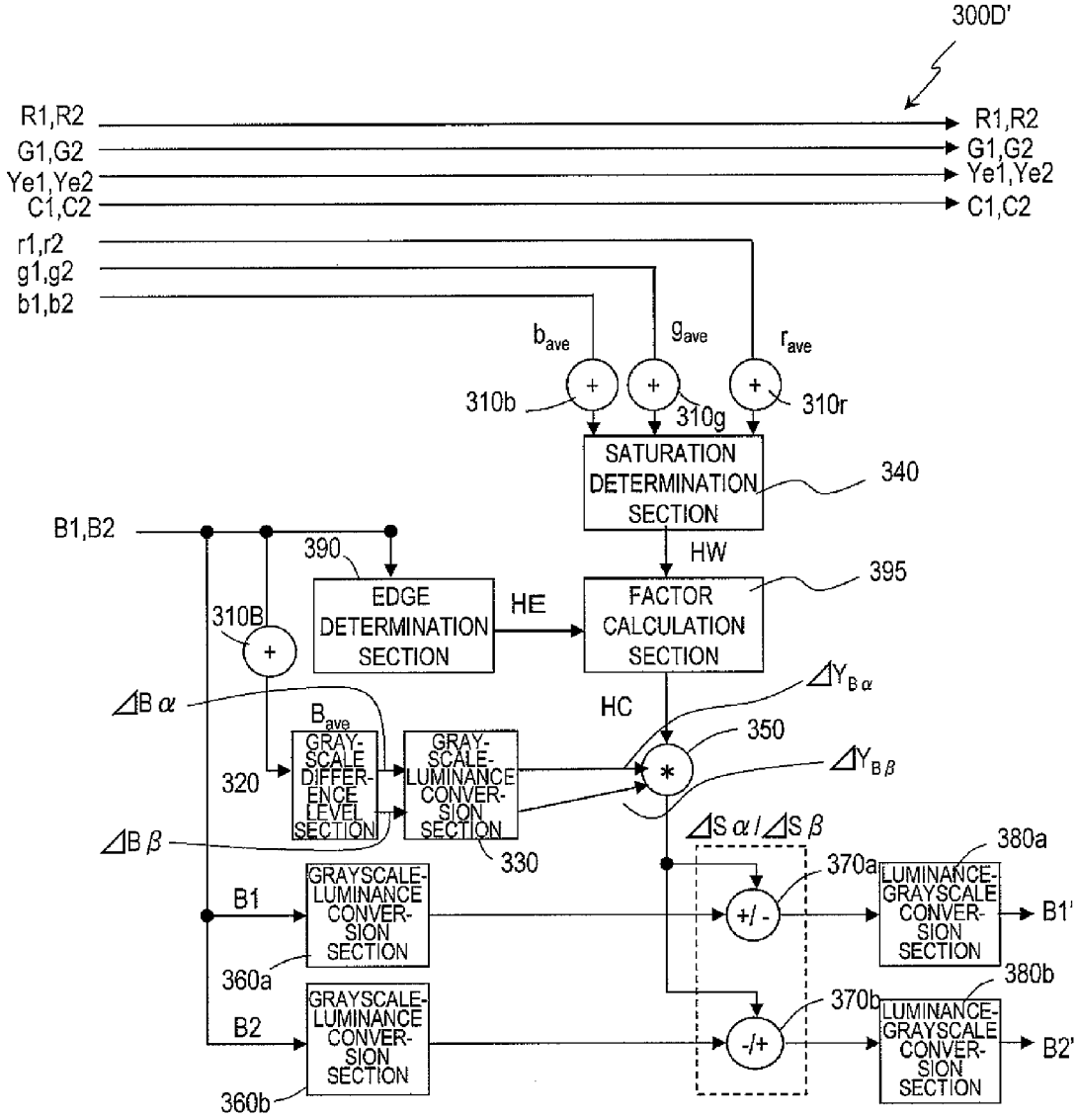
FIG. 34 A schematic diagram showing a structure of a correction section in a variation of the liquid crystal display device of the fourth embodiment.

Hereinafter, the configuration of the correction section 300D' is described with reference to FIG. 34. The correction section 300D' has basically the same configuration as that of the correction section 300D that has been previously described with reference to FIG. 33, except that it includes the edge determination section 390 and the factor calculation section 395. To avoid redundancy, repetitive description is not given herein.

The edge determination section 390 determines the edge factor HE based on the difference in grayscale level between the blue subpixels included in adjacent pixels represented by the multi-primary color signal. The edge factor HE is a function which increases as the difference in grayscale level between the blue subpixels included in adjacent pixels increases. For example, the edge factor HE is expressed as HE=|B1−B2|/MAX where, for example, MAX=MAX (B1, B2), and |B1−B2| is the absolute value of the difference in grayscale level between the blue subpixels represented by the multi-primary color signal.

In the factor calculation section 395, the correction factor HC is calculated based on the saturation factor HW and the edge factor HE which have been previously described. The correction factor HC is a function which decreases as the saturation factor HW decreases and which decreases as the edge factor HE increases. The correction factor HC is expressed as, for example, HC=HW−HE. In the factor calculation section 395, clipping may be performed such that the correction factor HC falls within the range of 0 to 1. Then, the multiplication section 350 generates the shift amounts ΔSα, ΔSβ using the correction factor HC instead of the saturation factor HW. Thus, the corrected grayscale levels B1', B2' may be obtained with consideration for the edge factor HE.

Note that, although in the graph shown in FIG. 31(*a*) WZ is different from WX and WY not only at around grayscale level 0.5 but also at around grayscale level 0.9, the difference between the corrected grayscale levels cannot be increased at around grayscale level 0.9 because the grayscale level is high even when a correction is made to the grayscale level of the blue subpixels. Thus, it is difficult to reduce the yellow shift.

Figure 35:
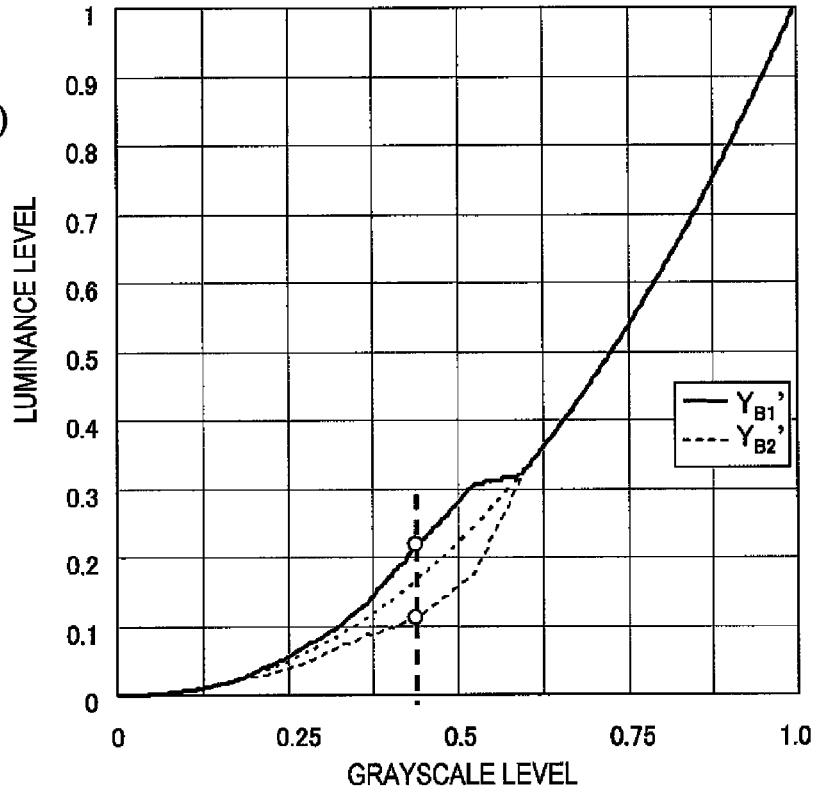
FIG. 35(*a*) is a graph showing the change of the luminance level with respect to the change of the grayscale level in the liquid crystal display device shown in FIG. 29. (*b*) is a graph showing the change of the colorimetric value of the Z value for the oblique viewing direction with respect to the change of the grayscale level in each subpixel and in the entire pixel of the liquid crystal display device shown in FIG. 29.
Figure 35:
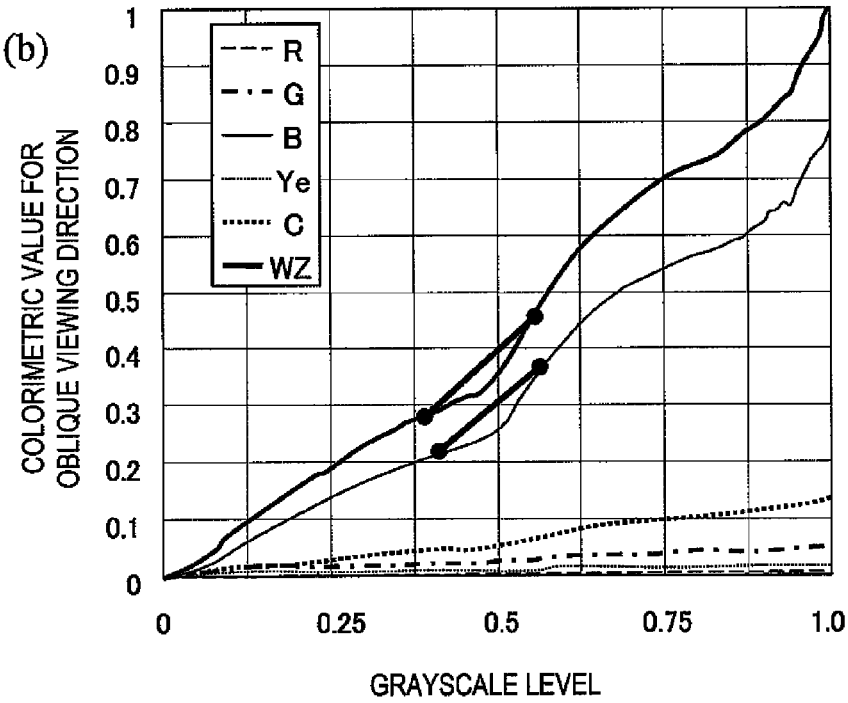

FIG. 35(*a*) shows the change of the luminance level of the blue subpixels with respect to the change of the grayscale level in the liquid crystal display device 100D of the present embodiment. In FIG. 35(*a*), $Y_{B1'}$ represents the change of the luminance level of the brighter blue subpixel with respect to the average grayscale level $B_{ave}$, and $Y_{B2'}$ represents the change of the luminance level of the darker blue subpixel with respect to the average grayscale level $B_{ave}$ Note that, in FIG. 35(*a*), the dotted line represents the change with respect to the average grayscale level $B_{ave}$.

As seen from FIG. 35(*a*), at low grayscale levels and high grayscale levels, the luminance level $Y_{B1'}$ of the blue subpixel is generally equal to the luminance level $Y_{B2'}$ of the darker blue subpixel. However, at the middle grayscale levels, the luminance level $Y_{B1'}$ of the brighter blue subpixel is higher than the luminance level $Y_{B2'}$ of the darker blue subpixel.

FIG. 35(*b*) shows the change of the Z value of a pixel and the components of the respective subpixels of the pixel for the oblique viewing direction with respect to the change of the grayscale level in the liquid crystal display device 100D of the present embodiment. In FIG. 35(*b*), R, G, B, Ye and C represent the Z value components of the respective subpixels, and WZ represents the Z value of the pixel. For the sake of comparison, FIG. 35(*b*) also shows the Z value and the Z value components of the respective subpixels in the liquid crystal display device of Comparative Example 3 which are shown in FIG. 31(*a*). In FIG. 35(*b*), solid circles indicate the calorimetric values of the blue subpixels for the luminance level $Y_{B1'}$ and the luminance level $Y_{B2'}$ corresponding to a certain average grayscale level $B_{ave}$ and the corresponding values of the liquid crystal display device 100D. In this case, the total calorimetric value of the blue subpixels is on a line segment extending between the solid circles corresponding to the luminance level $Y_{B1'}$ and the luminance level $Y_{B2'}$. Thus, in the liquid crystal display device 100D of the present embodiment, the luminance levels of the blue subpixels are the luminance levels $Y_{B1'}$, $Y_{B2'}$, and therefore, the Z value component of the blue subpixels for the oblique viewing direction can be high as compared with the liquid crystal display device of Comparative Example 3. Note that the average value of the luminances for the front viewing direction at the luminance levels $Y_{B1'}$, $Y_{B2'}$ is equal to the luminance corresponding to the average grayscale level $B_{ave}$.

Figure 36:
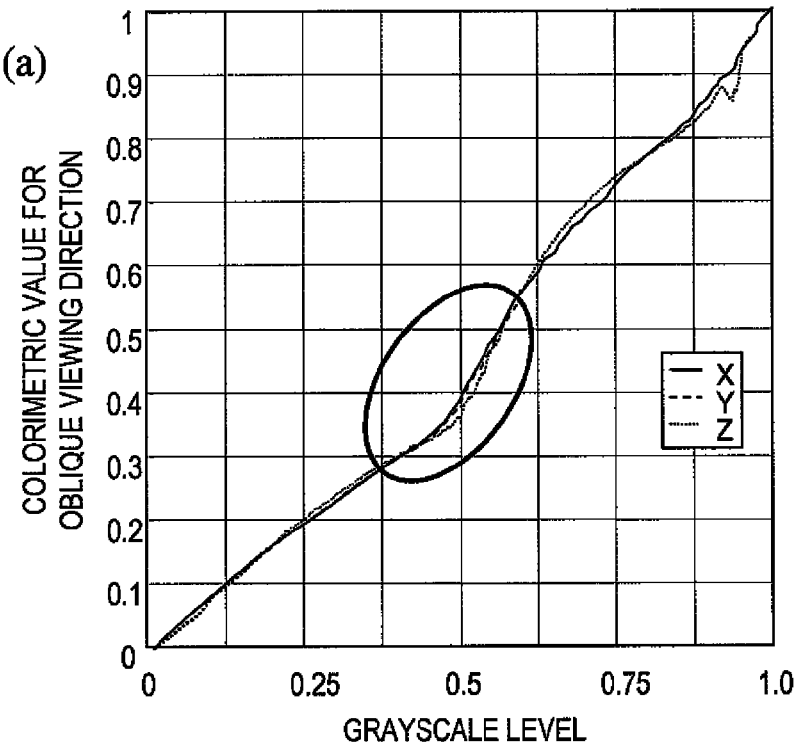
FIG. 36(*a*) is a graph showing the change of the colorimetric values of the X value, the Y value and the Z value for the oblique viewing direction with respect to the change of the grayscale level in the liquid crystal display device of Comparative Example 3. (*b*) is a graph showing the change of the colorimetric values of the X value, the Y value and the Z value for the oblique viewing direction with respect to the change of the grayscale level in the liquid crystal display device shown in FIG. 29.
Figure 36:
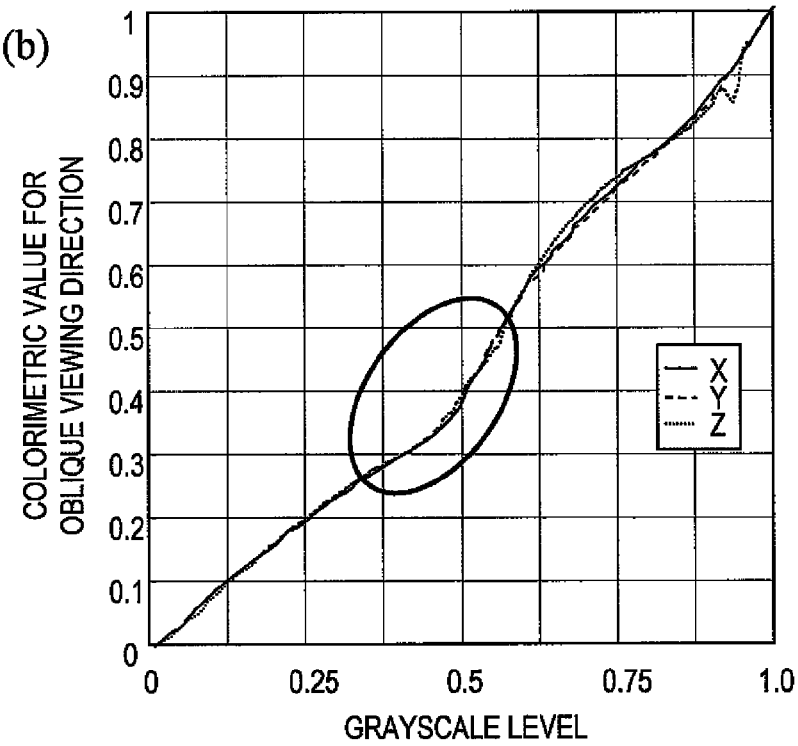
Figure 37:
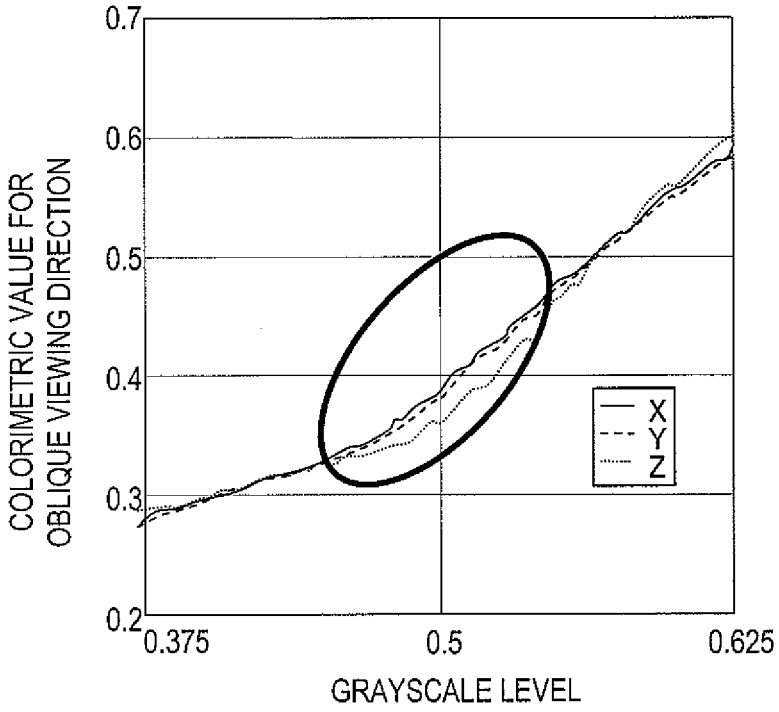
FIG. 37(*a*) is an enlarged graph showing part of FIG. 36(*a*). (*b*) is an enlarged graph showing part of FIG. 36(*b*).
Figure 37:
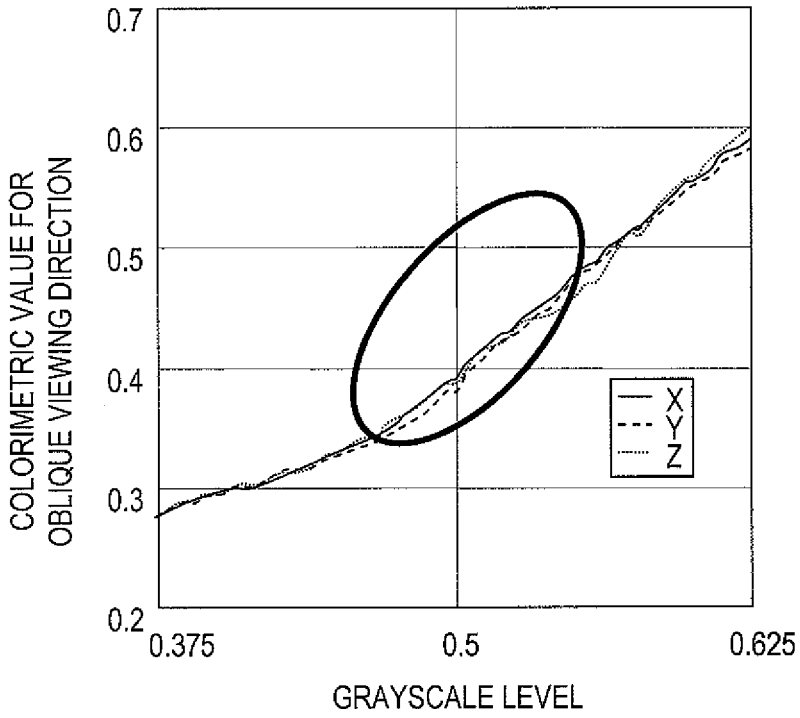

FIG. 36 and FIG. 37 show the change of the X value, the Y value and the Z value for the oblique viewing direction with respect to the front grayscale in the liquid crystal display device of Comparative Example 3 and the liquid crystal display device 100D of the present embodiment. FIG. 36(*a*) and FIG. 37(*a*) show the change of the values in the liquid crystal display device of Comparative Example 3. FIG. 37(*a*) is an enlarged diagram showing part of the graph of FIG. 36(*a*) in the range of the middle grayscale levels. FIG. 36(*b*) and FIG. 37(*b*) show the change of the values in the liquid crystal display device 100D of the present embodiment. FIG. 37(*b*) is an enlarged diagram showing part of the graph of FIG. 36(*b*) in the range of the middle grayscale levels.

As seen from FIG. 36(*a*) and FIG. 37(*a*), in the liquid crystal display device of Comparative Example 3, the Z value deviates from the X value and the Y value at around grayscale level 0.5. Therefore, a yellow shift occurs in the liquid crystal display device of Comparative Example 3.

On the other hand, in the liquid crystal display device 100D of the present embodiment, as seen from FIG. 36(*b*) and FIG. 37(*b*), the Z value changes in the same way as the X value and the Y value even at around grayscale level 0.5, so that deviation is prevented. Thus, occurrence of a yellow shift is prevented in the liquid crystal display device 100D.

As described above, in the liquid crystal display device 100D, the blue subpixels of the two adjacent pixels have different grayscale-luminance characteristics (i.e., different gamma characteristics). In this case, strictly speaking, although the colors displayed by the two adjacent pixels are supposed to look different, a human eye will perceive the average of the colors displayed by the two adjacent pixels if the resolution of the display device 100D is sufficiently high. Thus, not only the X value, the Y value and the Z value for the front viewing direction exhibit equal grayscale-luminance characteristics but also the X value, the Y value and the Z value for the oblique viewing direction exhibit equal grayscale-luminance characteristics. Thus, occurrence of a yellow shift is prevented without substantially changing the display quality for the front viewing direction, so that the display quality for the oblique viewing direction can be improved.

Although not shown, in the liquid crystal display device of Comparative Example 3, a component which is equivalent to the independent gamma correction processing section 280 performs only an independent gamma correction process on every one of all the grayscale levels R, G, B, Ye and C, unlike the liquid crystal display device 100D of the present embodiment. On the other hand, the liquid crystal display device 100D of the present embodiment includes the correction section 300D for producing the corrected grayscale levels B1', B2' from the grayscale levels B1, B2. Thereby, a deviation of the Z value from the X value and the Y value for the oblique viewing direction is prevented. Thus, the liquid crystal display device 100D includes the correction section 300D so that prevention of the yellow shift can be realized at low cost.

Figure 38:
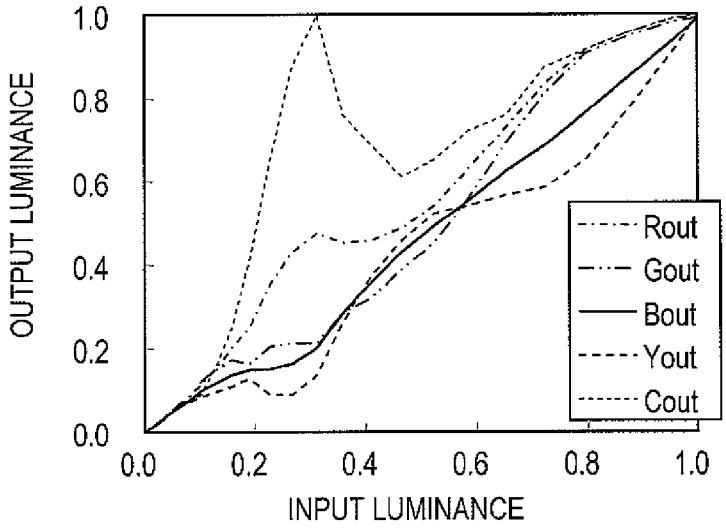
FIG. 38 A graph showing the change of the luminance of respective subpixels in the case where the XYZ values for the oblique viewing direction are equal.

Note that, herein, the yellow shift is prevented by adjusting the luminance of the blue subpixel, although, in the case of using a multi-primary color display panel, the yellow shift can be prevented by adjusting the luminance of any other subpixel in theory. However, in the liquid crystal display panel 200D where only the Z value changes differently from the X value and the Y value for the oblique viewing direction, making a correction to the blue subpixel is very effective because the correction to the blue subpixel greatly affects the Z value but scarcely affects the X value and the Y value. In the multi-primary color display panel, there are a larger number of primary colors, and therefore, it is possible to equalize the XYZ values for the oblique viewing direction. On the other hand, it is preferred that the luminance of each subpixel is increased as monotonically as possible as the lightness of the achromatic color increases. Considering only equalizing the XYZ values for the oblique viewing direction, the respective subpixels change in a very complicated and unequal fashion according to the lightness of the achromatic color as shown in FIG. 38. For example, it cannot flexibly apply itself to variations specific to the liquid crystal display panel. On the other hand, in the liquid crystal display device 100D of the present embodiment, an adjustment of the luminance of the blue subpixels is performed by the unit of blue subpixels included in adjacent pixels. Thereby, the respective primary colors are monotonically changed basically according to the grayscale level, so that it can display the achromatic color.

It is known that the resolution of the human eye for blue is lower than for the other colors. Particularly, when subpixels other than the blue subpixel are lit as in the case of an achromatic color at a middle grayscale level, the decrease of the resolution of the blue subpixel is less perceivable. As appreciated from this fact, making a correction to the grayscale level of the blue subpixel is more effective than making a correction to the grayscale level of any other subpixel.

As previously described, in the liquid crystal display panel 200D, each pixel includes two red subpixels Rx, Ry. Hereinafter, the advantages of a configuration where each pixel includes two red subpixels are described. As the number of primary colors used for display is increased, the number of subpixels included in one pixel increases. Accordingly, the area of each subpixel decreases, so that the lightness of the color displayed by each subpixel (corresponding to the Y value in the XYZ color space) decreases. For example, when the number of primary colors for use in display is increased from three to six, the area of each subpixel is generally halved, so that the lightness (Y value) of each subpixel is also generally halved. The "lightness" is one of the three factors that define a color, along with "hue" and "saturation". By increasing the number of primary colors, the color gamut over the xy chromaticity diagram (i.e., the ranges of the "hue" and "saturation" which can be expressed) is increased. However, as the "lightness" is decreased, the actual color gamut (i.e., the color gamut including "lightness") cannot be sufficiently increased. Specifically, as the area of the red subpixel is decreased, the Y value for red decreases, so that only dark red can be displayed. Thus, a red color of the object colors cannot be sufficiently expressed.

On the other hand, in the multi-primary color display panel 200D of the display device 100D of the present embodiment, two out of the six types of subpixels (first red subpixel Rx and second red subpixel Ry) display red colors. Therefore, the lightness (Y value) of red can be improved, and a bright red color can be displayed. Thus, the color gamut which includes not only the hue and saturation represented on the xy chromaticity diagram but also the lightness can be expanded. Note that, although a magenta subpixel is not provided in the multi-primary color display panel 200D, a magenta color of the object colors can be sufficiently expressed by additive color mixture with the use of the first and second red subpixels Rx, Ry and the blue subpixel B.

Figure 39:
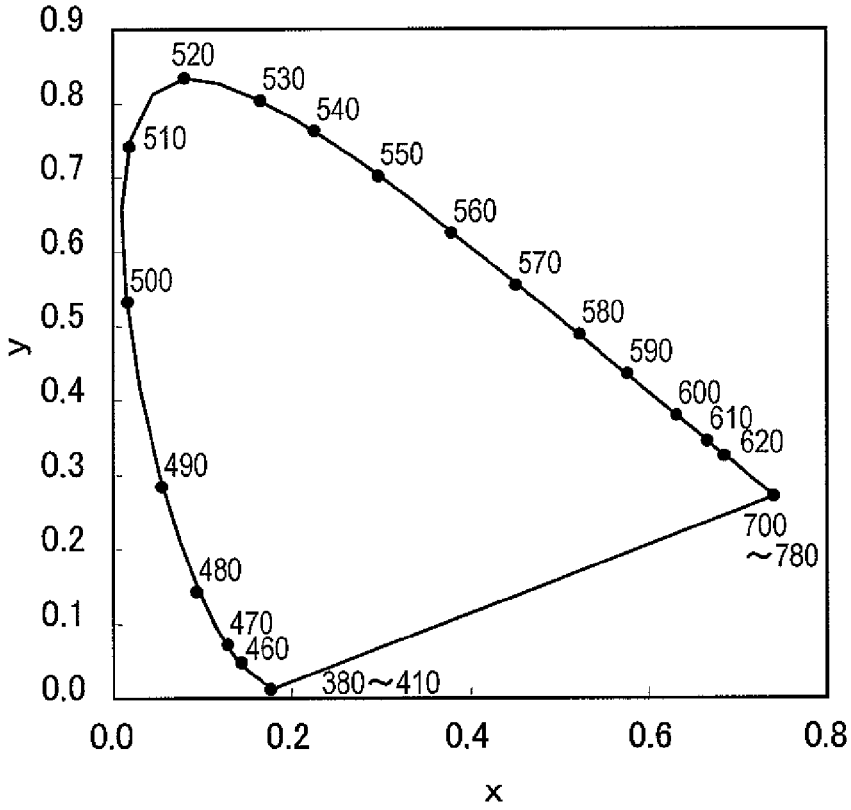
FIG. 39 A schematic diagram showing a XYZ color space chromaticity diagram.

FIG. 39 is the xy chromaticity diagram of the XYZ color space. FIG. 39 shows the spectrum locus and the dominant wavelength. In this specification, the dominant wavelength of the red subpixel is from 605 nm to 635 nm. The dominant wavelength of the yellow subpixel is from 565 nm to 580 nm. The dominant wavelength of the green subpixel is from 520 nm to 550 nm. The dominant wavelength of the cyan subpixel is from 475 nm to 500 nm. The dominant wavelength of the blue subpixel is not more than 470 nm. The auxiliary dominant wavelength of the magenta subpixel is from 495 nm to 565 nm.

In the above description, the input signal is compliant with the BT.709 standards, and the grayscale levels r, g and b which are represented by the input signal (or which are convertible from the values of the input signal) are within the range of, for example, 0 to 255, although the present invention is not limited to this example. In the case of an input signal which is compliant with the xvYCC standards, for example, the values that the input signal can have are not defined. In this case, the values that the luminance level of each subpixel in a three primary color display device can have may be arbitrarily determined to be within the range of −0.05 to 1.33, for example, and the grayscale levels r, g and b may be arbitrarily determined to have a grayscale range consisting of 355 grayscale levels from grayscale level −65 to grayscale level 290. In this case, if any of the grayscale levels r, g and b has a negative value, the multi-primary color display panel 200D can express colors which are out of the range of colors that can be expressed when the grayscale levels r, g and b are within the range of 0 to 255.

In the above description, the subpixels included in the same pixel are arranged in one line along the row direction, although the present invention is not limited to this example. The subpixels included in the same pixel may be arranged in one line along the row direction and the column direction. Alternatively, the subpixels included in the same pixel may be arranged in multiple rows and multiple columns. For example, the subpixels included in one pixel may be arranged in two rows.

The viewing angle dependence of the gamma characteristic, i.e., the difference between the gamma characteristic obtained when the display surface is viewed from the front viewing direction and the gamma characteristic obtained when the display surface is viewed from the oblique viewing direction, can be reduced by independently controlling the luminance values of the red subpixels R1, R2. As the technique of reducing the viewing angle dependence of the gamma characteristic, a technique called "multi-pixel driving" is proposed in Japanese Laid-Open Patent Publications Nos. 2004-62146 and 2004-78157. In this technique, one subpixel is divided into two divisional regions, and different voltages are applied to the divisional regions, whereby the viewing angle dependence of the gamma characteristic is reduced. When employing a configuration where the first red subpixel Rx and the second red subpixel Ry are controlled independently of each other, as a matter of course, different voltages can be applied across the liquid crystal layer of the first red subpixel Rx and the liquid crystal layer of the second red subpixel Ry. Thus, the effect of reducing the viewing angle dependence of the gamma characteristic can be obtained as in the case of the multi-pixel driving disclosed in Japanese Laid-Open Patent Publications Nos. 2004-62146 and 2004-78157.

In the above description, the first red, green, blue, yellow, cyan and second red subpixels included in one pixel are arranged in this order along the row direction, although the present invention is not limited to this example. The subpixels may be arranged in the order of the first red, green, blue, yellow, second red and cyan subpixels.

In the above description, each pixel includes two red subpixels, although the present invention is not limited to this example. The pixel may include a magenta subpixel in place of one of the red subpixels. For example, the pixel may include red, green, blue, yellow, cyan and magenta subpixels. The red, green, blue, yellow, cyan and magenta subpixels included in one pixel may be arranged in this order along the row direction.

In the above description, as for subpixels included in two adjacent pixels that are placed side by side along the column direction, subpixels of the same color are arranged along the column direction, although the present invention is not limited to this example.

Figure 40:
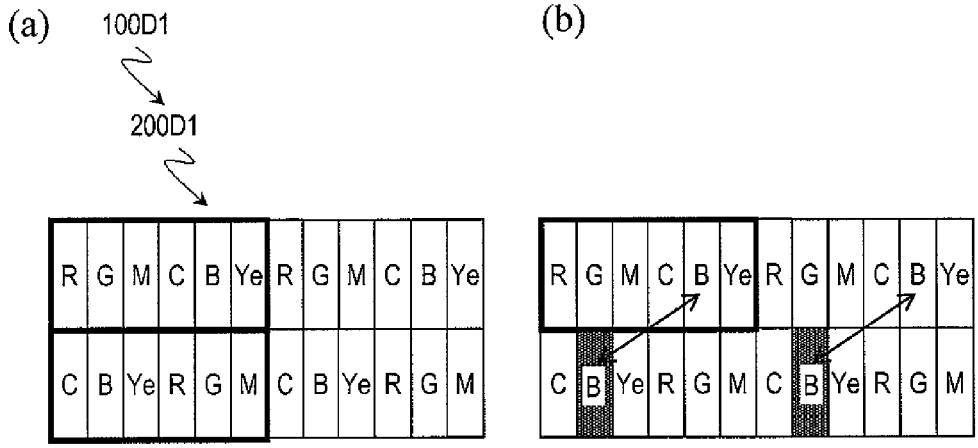
FIG. 40(*a*) is a schematic diagram showing a subpixel arrangement of a liquid crystal display panel of a liquid crystal display device of a variation of the fourth embodiment. (*b*) is a schematic diagram showing the positional relationship between blue subpixels which are to be adjusted in terms of luminance and brighter blue subpixels.

FIG. 40(*a*) is a schematic diagram of a multi-primary color display panel 200D1 of a liquid crystal display device 100D1. Each subpixel includes divisional regions which can have different luminances as in the multi-primary color display panel 200D that has been previously described with reference to FIG. 29(*b*). Here, the divisional regions are not shown in the drawing.

In the multi-primary color display panel 200D1, each pixel includes red (R), green (G), blue (B), yellow (Ye), cyan (C) and magenta (M) subpixels. In one row, the red, green, magenta, cyan, blue and yellow subpixels included in one pixel are arranged in this order along the row direction. In the immediately subsequent row, the cyan, blue, yellow, red, green and magenta subpixels included in different pixels are arranged in this order along the row direction. In the multi-primary color display panel 200D1, as for the subpixel arrangement in two adjacent rows, the subpixels in one of the rows are positioned with a shift of three subpixels relative to the subpixels in the other row. As for the subpixel arrangement along the column direction, the red subpixels and the cyan subpixels are alternately arranged, the green subpixels and the blue subpixels are alternately arranged, and the magenta subpixels and the yellow subpixels are alternately arranged.

In the liquid crystal display device 100D1, an adjustment of the luminance of the blue subpixels is performed by the unit of blue subpixels included in two adjacent pixels that are placed side by side along the column direction. FIG. 40(*b*) schematically shows the multi-primary color display panel 200D1 in the case where all the pixels in the input signal exhibit an achromatic color at the same grayscale level. In FIG. 40(*b*), two blue subpixels whose luminances are to be corrected are indicated by arrows. In FIG. 40(*b*), non-hatched blue subpixels are brighter blue subpixels, while hatched blue subpixels are darker blue subpixels. In the liquid crystal display device 100D1, an adjustment of the luminance is performed by the unit of blue subpixels included in two adjacent pixels that are placed side by side along the column direction, such that the brighter blue subpixels are arranged along the row direction. Therefore, nonuniform distribution of the brighter blue subpixels can be prevented, and accordingly, substantial decrease in blue resolution can be prevented.

In the multi-primary color display panel 200D1 shown in FIG. 40, the subpixels included in one pixel are arranged in one row, although the present invention is not limited to this example. The subpixels included in one pixel may be arranged in a plurality of rows.

Figure 41:
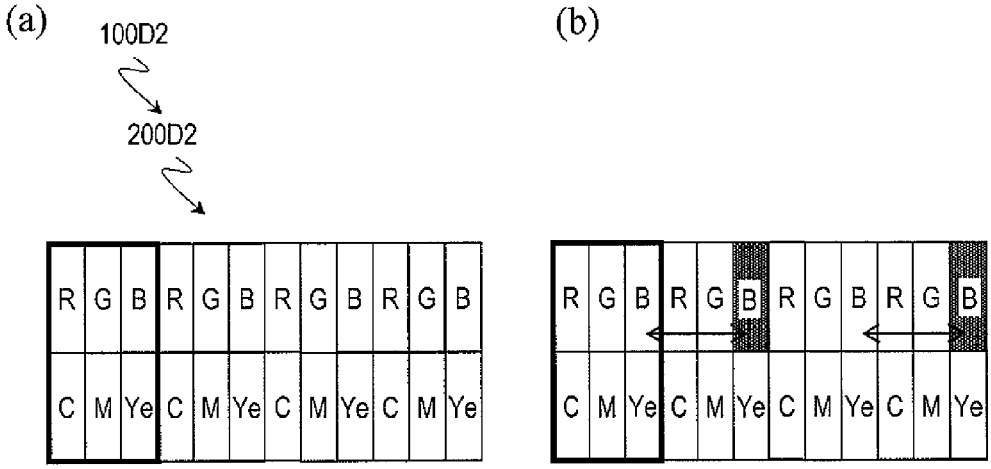
FIG. 41(*a*) is a schematic diagram showing a subpixel arrangement of a liquid crystal display panel of a liquid crystal display device of a variation of the fourth embodiment. (*b*) is a schematic diagram showing the positional relationship between blue subpixels which are to be adjusted in terms of luminance and brighter blue subpixels.

FIG. 41(*a*) is a schematic diagram of a multi-primary color display panel 200D2 of a liquid crystal display device 100D2. In the multi-primary color display panel 200D2, the subpixels included in one pixel are arranged in two rows and three columns. The red, green and blue subpixels included in one pixel are arranged in a row in this order along the row direction, and the cyan, magenta and yellow subpixels included in the same pixel are arranged in the immediately subsequent row in this order along the row direction. As for the subpixel arrangement along the column direction, the red subpixels and the cyan subpixels are alternately arranged, the green subpixels and the magenta subpixels are alternately arranged, and the blue subpixels and the yellow subpixels are alternately arranged. As shown in FIG. 41(*b*), in the liquid crystal display device 100D2, an adjustment of the luminance is performed by the unit of blue subpixels included in two adjacent pixels that are placed side by side along the row direction, such that the brighter blue subpixels and the darker blue subpixels are alternately arranged along the row direction. Therefore, nonuniform distribution of the brighter blue subpixels can be prevented, and accordingly, substantial decrease in blue resolution can be prevented.

The subpixel arrangement along the column direction in the multi-primary color display panel 200D2 is not limited to the arrangement shown in FIG. 41. The subpixel arrangement along the column direction may be such that the red subpixels and the yellow subpixels are alternately arranged, the green subpixels and the magenta subpixels are alternately arranged, and the blue subpixels and the cyan subpixels are alternately arranged. The magenta subpixel may be replaced by another red subpixel.

In the above-described multi-primary color display panels 200D, 200D1, 200D2, the number of subpixels included in one pixel is six, although the present invention is not limited to this example. In a multi-primary color display panel, the number of subpixels included in one pixel may be four.

Figure 42:
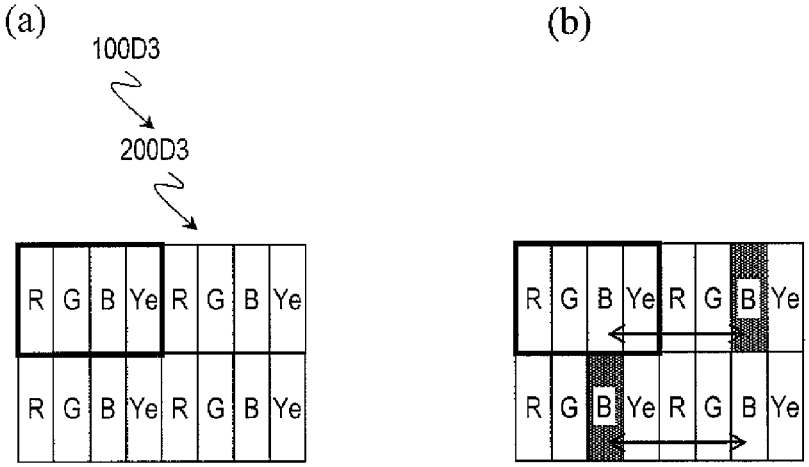
FIG. 42(*a*) is a schematic diagram showing a subpixel arrangement of a liquid crystal display panel of a liquid crystal display device of a variation of the fourth embodiment. (*b*) is a schematic diagram showing the positional relationship between blue subpixels which are to be adjusted in terms of luminance and brighter blue subpixels.

FIG. 42(*a*) is a schematic diagram of a multi-primary color display panel 200D3 of a liquid crystal display device 100D3. In the multi-primary color display panel 200D3, each pixel includes red (R), green (G), blue (B) and yellow (Ye) subpixels. The red, green, blue and yellow subpixels are arranged in this order along the row direction.

Also, subpixels of the same color are arranged along the column direction. As shown in FIG. 42(*b*), in the liquid crystal display device 100D3, an adjustment of the luminance is performed by the unit of two blue subpixels included in two adjacent pixels that are placed side by side along the row direction, such that the brighter blue subpixels are diagonally aligned. Therefore, nonuniform distribution of the brighter blue subpixels can be prevented, and accordingly, substantial decrease in blue resolution can be prevented.

In the multi-primary color display panel 200D3 shown in FIG. 42, each pixel includes the red, green, blue and yellow subpixels, although the present invention is not limited to this example. The pixel may include a white subpixel in place of the yellow subpixel. The red, green, blue and white subpixels may be arranged in this order along the row direction.

In the multi-primary color display panel 200D3 shown in FIG. 42, subpixels of the same color are arranged along the column direction, although the present invention is not limited to this example. Subpixels of different colors may be arranged along the column direction.

Figure 43:
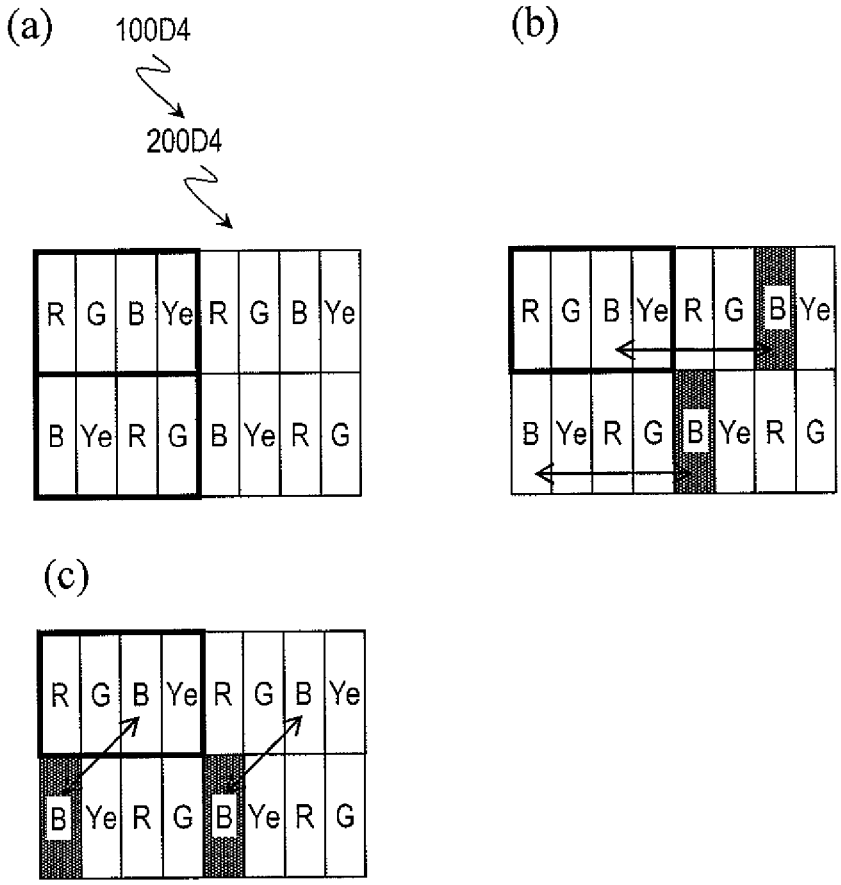
FIG. 43(*a*) is a schematic diagram showing a subpixel arrangement of a liquid crystal display panel of a liquid crystal display device of a variation of the fourth embodiment. (*b*) and (*c*) are schematic diagrams showing the positional relationship between blue subpixels which are to be adjusted in terms of luminance and brighter blue subpixels.

FIG. 43(*a*) is a schematic diagram of a multi-primary color display panel 200D4 of a liquid crystal display device 100D4. In the multi-primary color display panel 200D4, the red, green, blue and yellow subpixels included in one pixel are arranged in a certain row in this order along the row direction, while the blue, yellow, red and green subpixels included in another pixel are arranged in a subsequently adjacent row in this order along the row direction. As for the subpixel arrangement of two adjacent rows, the subpixels in one of the rows are positioned with a shift of two subpixels relative to the subpixels in the other row. As for the subpixel arrangement along the column direction, the red subpixels and the blue subpixels are alternately arranged, and the green subpixels and the yellow subpixels are alternately arranged.

In the case where an adjustment of the luminance is performed by the unit of blue subpixels included in two adjacent pixels that are placed side by side along the row direction, such that the brighter blue subpixels are diagonally aligned, some of the blue subpixels that are spatially closest to one brighter blue subpixel, for example, are brighter blue subpixels so that the brighter blue subpixels result in a nonuniform distribution. As shown in FIG. 43(*b*), even in the case where an adjustment of the luminance is performed by the unit of blue subpixels included in two adjacent pixels that are placed side by side along the row direction, such that brighter blue subpixels are included in adjacent pixels that are placed side by side along the column direction, the brighter blue subpixels result in a nonuniform distribution. On the other hand, as shown in FIG. 43(*c*), in the case where an adjustment of the luminance is performed by the unit of blue subpixels included in two adjacent pixels that are placed side by side along the column direction, such that the brighter blue subpixels are arranged along the row direction, nonuniform distribution of the brighter blue subpixels is prevented, so that substantial decrease in blue resolution is prevented.

In the multi-primary color display panels 200D3, 200D4 shown in FIG. 42 and FIG. 43, the subpixels included in one pixel are arranged in one row, although the present invention is not limited to this example. The subpixels included in one pixel may be arranged in a plurality of rows.

Figure 44:
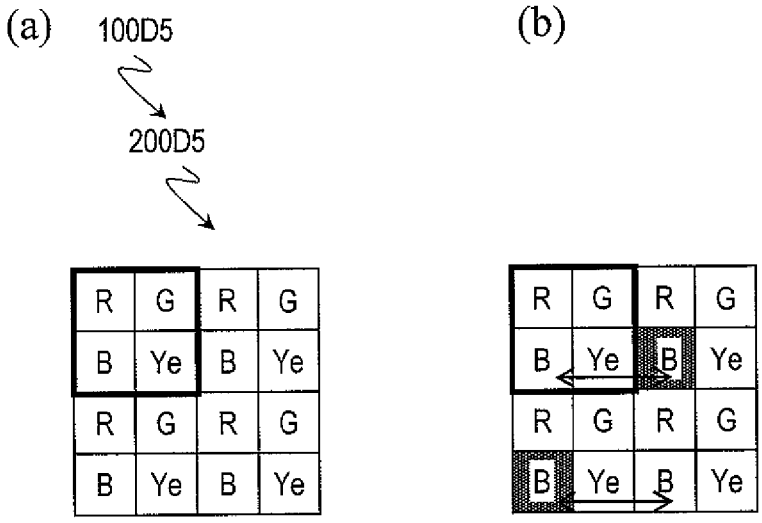
FIG. 44(*a*) is a schematic diagram showing a subpixel arrangement of a liquid crystal display panel of a liquid crystal display device of a variation of the fourth embodiment. (*b*) is a schematic diagram showing the positional relationship between blue subpixels which are to be adjusted in terms of luminance and brighter blue subpixels.

FIG. 44(*a*) is a schematic diagram of a multi-primary color display panel 200D5 of a liquid crystal display device 100D5. In the multi-primary color display panel 200D5, the subpixels included in one pixel are arranged in two rows and two columns. The red and green subpixels included in one pixel are arranged in a certain row in this order along the row direction, and the blue and yellow subpixels included in the same pixel are arranged in an adjacent row in this order along the row direction. As for the subpixel arrangement along the column direction, the red subpixels and the blue subpixel are alternately arranged, and the green subpixels and the yellow subpixel are alternately arranged. As shown in FIG. 44(*b*), in the liquid crystal display device 100D5, an adjustment of the luminance is performed by the unit of two blue subpixels included in two adjacent pixels that are placed side by side along the row direction, such that brighter blue subpixels are diagonally arranged. Thus, nonuniform distribution of the brighter blue subpixels is prevented, so that substantial decrease of the blue resolution can be prevented.

In the multi-primary color display panel 200D5 shown in FIG. 44, each pixel includes red, green, blue and yellow subpixels, although the present invention is not limited to this example. The pixel may include a white subpixel in place of the yellow subpixel.

In the above description, it is assumed that the input signal is a YCrCb signal which is commonly used as the color television signal. However, the input signal is not limited to the YCrCb signal but may be a signal which represents the luminances of the respective subpixels of three primary colors of RGB. It may be a signal which represents the luminances of the respective subpixels of other three primary colors, such as YeMC (Ye: yellow, M: magenta, C: cyan).

In the liquid crystal display panel 200D shown in FIG. 29(*b*), each of the subpixels R1, G, B, Ye, C and R2 includes two divisional regions, although the present invention is not limited to this example. Each of the subpixels R1, G, B, Ye, C and R2 may include three or more divisional regions.

Figure 45:
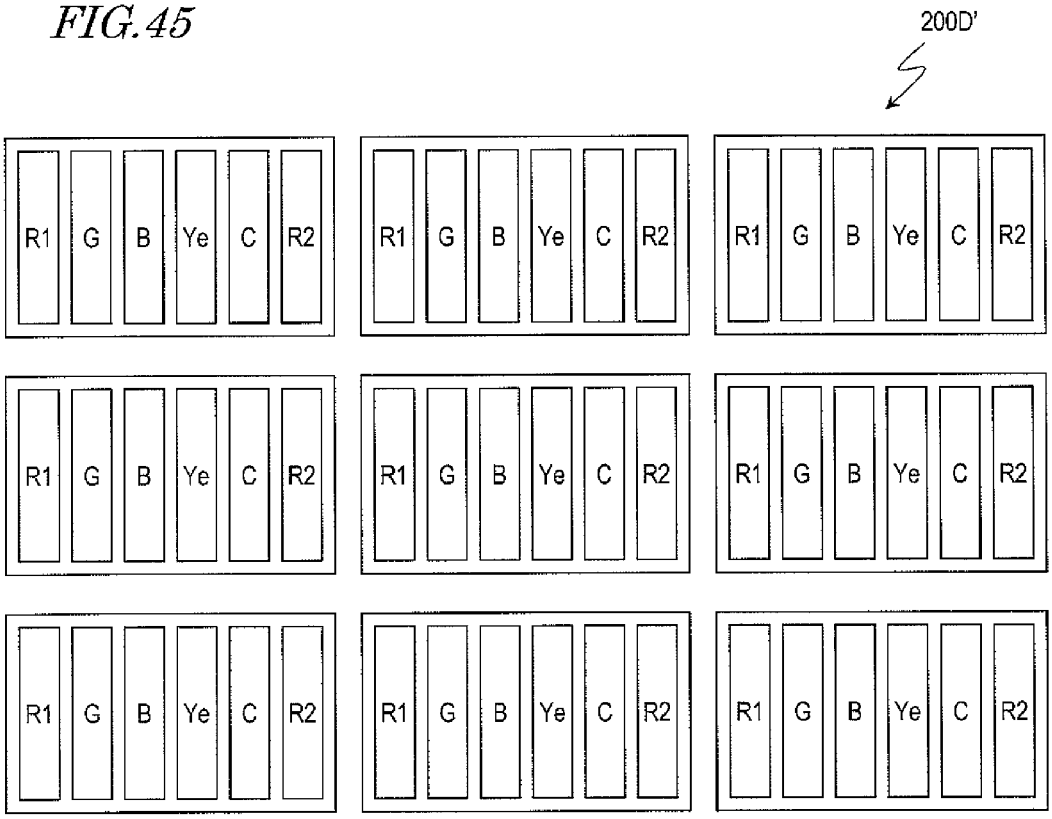
FIG. 45 A schematic diagram showing a subpixel arrangement of a liquid crystal display panel of a liquid crystal display device of a variation of the fourth embodiment.

Alternatively, each of the subpixels R1, G, B, Ye, C and R2 may not include multiple divisional regions. For example, as shown in FIG. 45, each of the subpixels R1, G, B, Ye, C and R2 in the liquid crystal display panel 200D' may be formed by a single region.

Embodiment 5

In the fourth embodiment, an adjustment of the luminance of the blue subpixels is performed by the unit of blue subpixels included in adjacent pixels, although the present invention is not limited to this example.

Figure 46:
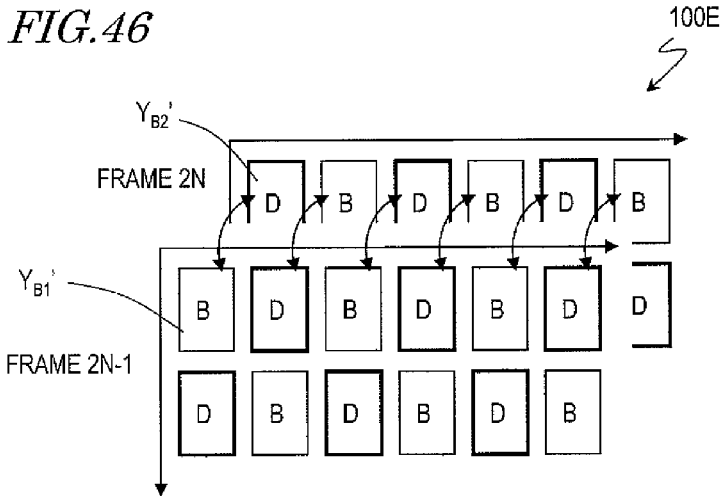
FIG. 46 A schematic diagram showing the luminance of blue subpixels in different frames in the fifth embodiment of the liquid crystal display device of the present invention.

Hereinafter, the fifth embodiment of the liquid crystal display device of the present invention is described with reference to FIG. 46 and FIG. 47. The liquid crystal display device 100E of the present embodiment has the same configuration as that of the above-described display device of embodiment 4 except that an adjustment of the luminance of the blue subpixels is performed by the unit of blue subpixels of different frames. To avoid redundancy, repetitive description is not given herein.

First, the general structure of the liquid crystal display device 100E of the present embodiment is described with reference to FIG. 46. FIG. 46 only shows the blue subpixels of the liquid crystal display panel 200D of the liquid crystal display device 100E, while the first red, green, yellow, cyan and second red subpixels are not shown.

In the liquid crystal display device 100E, an adjustment of the luminance of each blue subpixel is performed by the unit of blue subpixels of two consecutive frames. Where, in the multi-primary color signal, the grayscale level of the blue subpixel B in the preceding frame (e.g., the $2N-1^{th}$ frame) is grayscale level B1 and the grayscale level of the blue subpixel B in the subsequent frame (e.g., the $2N^{th}$ frame) is grayscale level B2, the luminance of the blue subpixel B in the preceding frame in the liquid crystal display panel 200D is different from the luminance of the same blue subpixel B in the subsequent frame even when the middle grayscale level of each pixel represented by the input signal does not change (i.e., even when the grayscale level B1 is equal to the grayscale level B2) over multiple frames.

As for the blue subpixels included in adjacent pixels in a certain frame, even when all the pixels are at the same achromatic color level in the input signal, the blue subpixels included in adjacent pixels that are placed side by side along the row direction and the column direction in the liquid crystal display panel 200D are at different luminance levels, so that brighter blue subpixels and darker blue subpixels are arranged in a checkered pattern.

Figure 47:
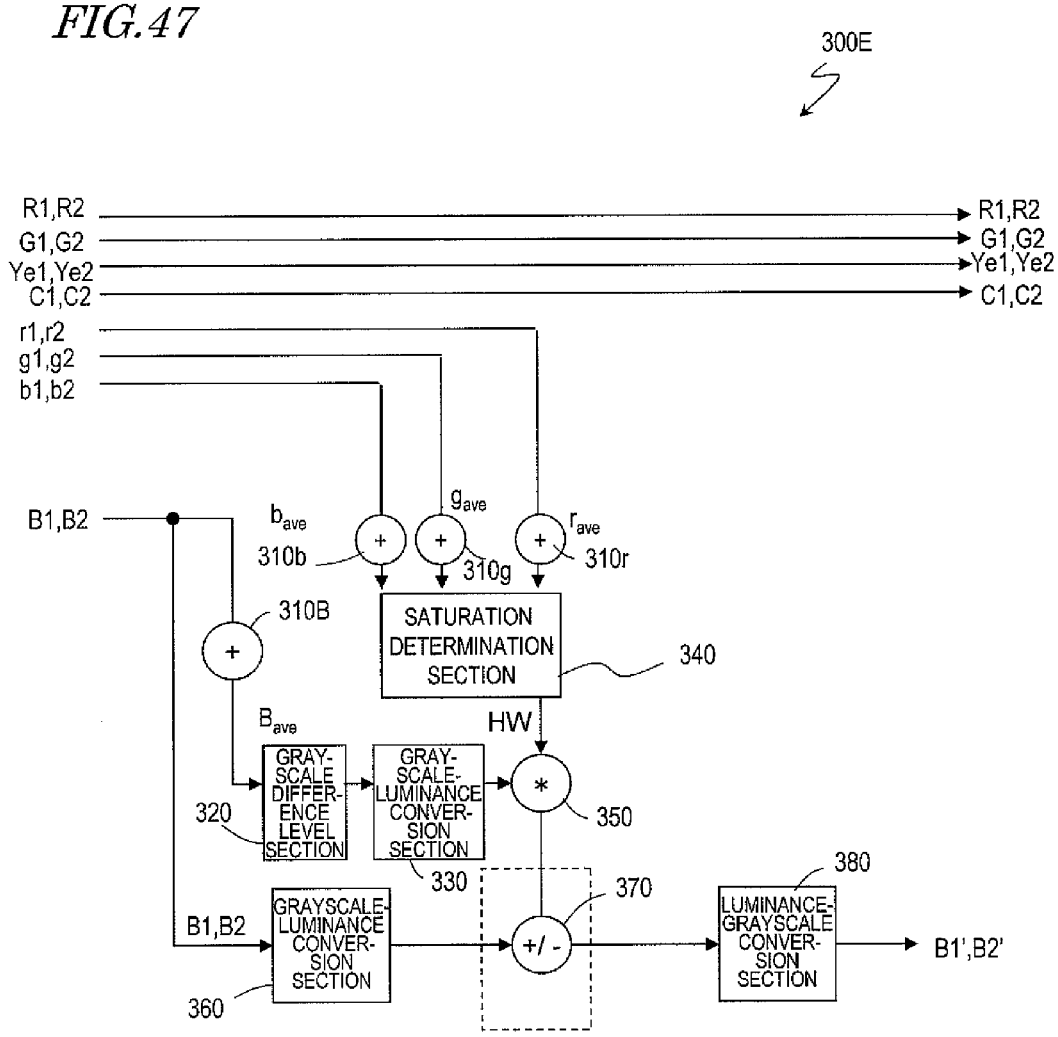
FIG. 47 A schematic diagram showing a structure of a correction section in the liquid crystal display device shown in FIG. 46.

FIG. 47 is a schematic diagram of a correction section 300E in the liquid crystal display device 100E of the present embodiment. In the correction section 300E, at least under certain conditions, a correction is made to the grayscale level B1 of the preceding frame to obtain the grayscale level B1', and a correction is made to the grayscale level B2 of the subsequent frame to obtain the grayscale level B2'.

The grayscale levels B1', B2' output from the correction section 300E vary among frames. As for the blue subpixel B of one pixel, the blue subpixel B exhibits the luminance corresponding to the grayscale level B1' in the immediately preceding frame (e.g., the $2N-1^{th}$ frame), and the blue subpixel B exhibits the luminance corresponding to the grayscale level B2' in the subsequent frame (e.g., the $2N^{th}$ frame). For example, in the case where an achromatic color at the same middle grayscale level is displayed over multiple frames at the frame frequency of 60 Hz, the luminance of the blue subpixel changes every 16.7 ms (=1/60 second). Thus, when an adjustment of the luminance of the blue subpixels is performed by the unit of blue subpixels of different frames, the yellow shift can be reduced without decreasing the resolution. Note that, in this case, from the viewpoint of the response speed of the liquid crystal molecules, it is preferred that the frame period is relatively long.

Embodiment 6

Figure 48:
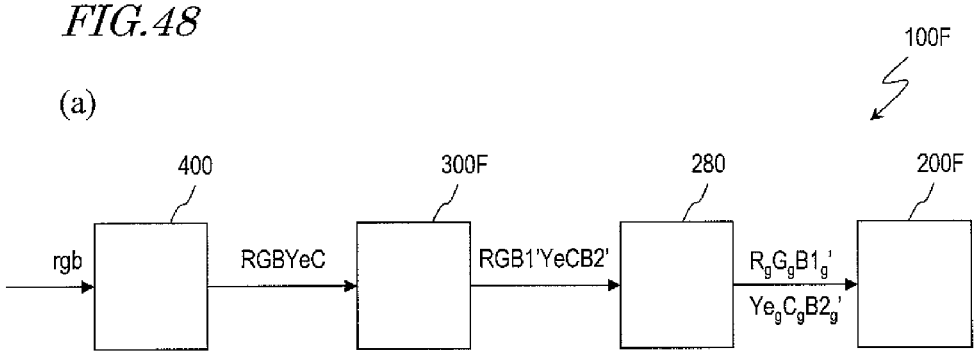
FIG. 48(*a*) is a schematic diagram showing the sixth embodiment of the liquid crystal display device of the present invention. (*b*) is a schematic diagram showing an arrangement of pixels in the liquid crystal display device shown in (*a*).
Figure 48:
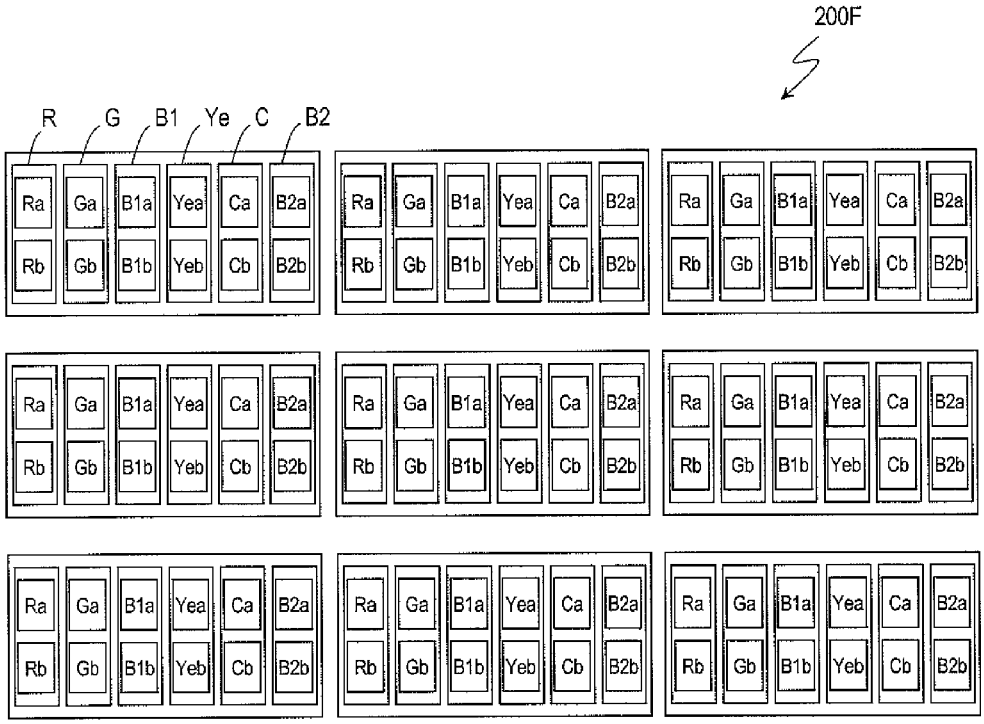

Hereinafter, the sixth embodiment of the liquid crystal display device of the present invention is described. FIG. 48(*a*) is a schematic diagram of a liquid crystal display device 100F of the present embodiment. The liquid crystal display device 100F of the present embodiment has the same configuration as that of the above-described display device of embodiment 4 except that an adjustment of the luminance of the blue subpixels is performed by the unit of multiple divisional regions of the blue subpixel. To avoid redundancy, repetitive description is not given herein.

FIG. 48(*b*) shows pixels of a multi-primary color display panel 200F of a liquid crystal display device 100F of the present embodiment. Each pixel includes the red subpixel R, the green subpixel G, the first blue subpixel B1, the yellow subpixel Ye, the cyan subpixel C and the second blue subpixel B2.

Figure 49:
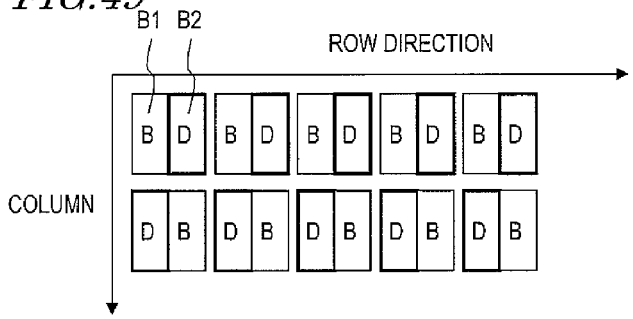
FIG. 49 A schematic diagram for illustrating the sixth embodiment of the liquid crystal display device of the present invention.

Next, the general structure of the liquid crystal display device 100F of the present embodiment is described with reference to FIG. 49. FIG. 49 only shows the blue subpixels of the liquid crystal display panel 200F of the liquid crystal display device 100F, while the red and green subpixels are not shown. In the liquid crystal display device 100F, an adjustment of the luminance of the blue subpixels is performed by the unit of two blue subpixels B1, B2 included in one pixel. Therefore, when the grayscale level of the blue subpixels included in one pixel represented by the input signal is the grayscale level B, the luminance of the first blue subpixel B1 is different from the luminance of the second blue subpixel B2 in the liquid crystal display panel 200F. Note that, in the case where the first blue subpixels and the second blue subpixels included in adjacent pixels that are placed side by side along the column direction are arranged in a line along the column direction, for example, the luminance of the first blue subpixel included in a pixel of an odd-numbered row is higher than the luminance of the second blue subpixel included in the same pixel while the luminance of the first blue subpixel included in a pixel of an even-numbered row is lower than the luminance of the second blue subpixel included in the same pixel.

Figure 50:
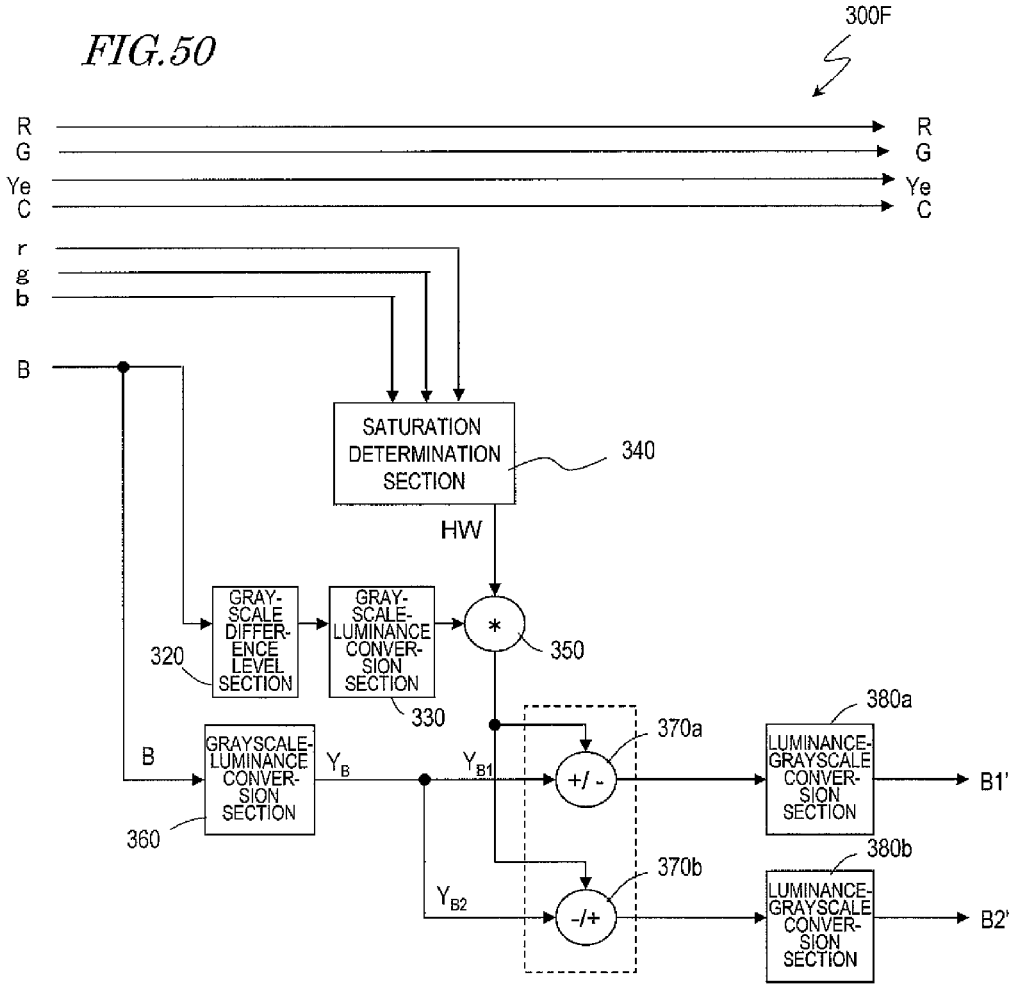
FIG. 50 A schematic diagram showing a structure of a correction section in the liquid crystal display device shown in FIG. 48(*a*).

FIG. 50 is a schematic diagram of the correction section 300F of the liquid crystal display device 100F. In the correction section 300F, the luminance level $Y_B$ obtained in a grayscale-luminance conversion section 360 is equal to the luminance level $Y_{B1}$ and the luminance level $Y_{B2}$. Therefore, the luminance levels $Y_{b1}$ and $Y_{b2}$ are equal to each other before the operations in the addition/subtraction sections 370*a*, 370*b*. The grayscale level B1' obtained in the correction section 300F corresponds to the first blue subpixel B1, and the grayscale level B2' corresponds to the second blue subpixel B2.

Note that, in the liquid crystal display panel 200F shown in FIG. 48(*b*), each of the subpixels R, G, B1, Ye, C and B2 includes two divisional regions, although the present invention is not limited to this example. Each of the subpixels R, G, B1, Ye, C and B2 may include three or more divisional regions. Alternatively, each of the subpixels R, G, B1, Ye, C and B2 may not include multiple divisional regions. For example, each of the subpixels R, G, B1, Ye, C and B2 may be formed by a single region.

Figure 51:
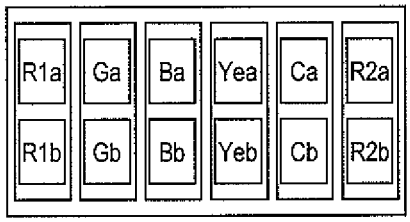
FIG. 51(*a*) is a schematic diagram showing a liquid crystal display panel of a liquid crystal display device of a variation of the sixth embodiment. (*b*) is a schematic diagram showing the structure of a blue subpixel.
Figure 51:
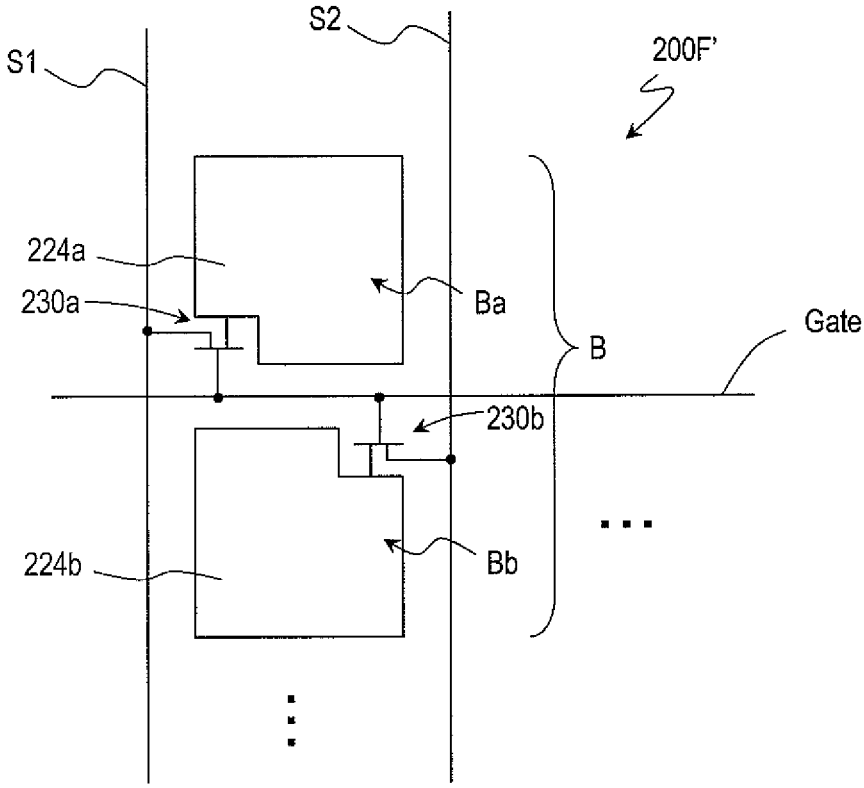

Each pixel includes only one red subpixel, although the present invention is not limited to this example. Each pixel may include two red subpixels. In the above description, each pixel includes two blue subpixels, although the present invention is not limited to this example. As shown in FIG. 51(*a*), each pixel may include one blue subpixel B that includes a first region Ba corresponding to the grayscale level B1' and a second region Bb corresponding to the grayscale level B2'. FIG. 51(*b*) shows the structure of the blue subpixel B. A separate electrode 224*a* which corresponds to the first region Ba of the blue subpixel B and a separate electrode 224*b* which corresponds to the second region Bb are electrically coupled to different source lines via different TFTs.

In the above description, each pixel includes six subpixels, although the present invention is not limited to this example. The number of subpixels included in each pixel may be four or may be five. For example, when the number of subpixels included in each pixel is four, each pixel may include red, green, blue and yellow subpixels. Alternatively, when the number of subpixels included in each pixel is five, each pixel may include red, green, blue, yellow and cyan subpixels.

The present application claims the priority benefit of Japanese Patent Applications Nos. 2008-315067 and 2009-96522, the disclosures of which are incorporated herein by reference.

Industrial Applicability

According to the present invention, a liquid crystal display device can be provided in which deterioration of the display quality for oblique viewing directions is prevented.

Reference Signs List

| | |
|---|---|
| 100 | liquid crystal display device |
| 200 | liquid crystal display panel |
| 280 | independent gamma correction processing section |
| 300 | correction section |
| 400 | multi-primary color conversion section |

The invention claimed is:

1. A liquid crystal display device, comprising: an active matrix substrate; a counter substrate; and a vertical alignment type liquid crystal layer interposed between the active matrix substrate and the counter substrate, wherein the display device has a plurality of pixels, each of the pixels including a plurality of subpixels, the plurality of subpixels include a red subpixel, a green subpixel, and a blue subpixel, and when, in an input signal, each of adjacent two of the plurality of pixels represents an achromatic color at a certain grayscale level, a luminance of the blue subpixel included in one of the two adjacent pixels is different from a luminance of the blue subpixel included in the other of the two adjacent pixels.

2. The liquid crystal display device of claim 1, wherein when, in an input signal, each of the two adjacent pixels represents an achromatic color at the certain grayscale level, the red subpixels included in the two adjacent pixels have equal luminances, and the green subpixels included in the two adjacent pixels have equal luminances.

3. The liquid crystal display device of claim 1 wherein, when at least one of the red subpixels and the green subpixels of the two adjacent pixels is unlit while at least one of the blue subpixels of the two adjacent pixels is lit, the blue subpixels included in the two adjacent pixels have equal luminances.

4. The liquid crystal display device of claim 1, wherein the input signal or a signal converted from the input signal represents a grayscale level of the plurality of subpixels included in each of the plurality of pixels, and a grayscale level of the blue subpixels included in the two adjacent pixels which is represented by the input signal or the signal converted from the input signal is corrected according to a saturation of the two adjacent pixels which is represented by the input signal.

5. The liquid crystal display device of claim 1, wherein the input signal or a signal converted from the input signal represents a grayscale level of the plurality of subpixels included in each of the plurality of pixels, and a grayscale level of the blue subpixels included in the two adjacent pixels which is represented by the input signal or the signal converted from the input signal is corrected according to a saturation of the two adjacent pixels which is represented by the input signal and a difference in grayscale level between the blue subpixels included in the two adjacent pixels which is represented by the input signal.

6. The liquid crystal display device of claim 1, wherein when, in an input signal, one of the two adjacent pixels represents a first achromatic color and the other of the two adjacent pixels represents the first achromatic color or a second achromatic color which has a different lightness from that of the first achromatic color, a luminance of each of the blue subpixels included in the two adjacent pixels is different from a luminance which corresponds to a grayscale level represented by the input signal or a signal converted from the input signal, and when, in an input signal, one of the two adjacent pixels represents the first achromatic color and the other of the two adjacent pixels represents a third achromatic color, a difference in lightness between third achromatic color and the first achromatic color being greater than a difference in lightness between the second achromatic color and the first achromatic color, a luminance of each of the blue subpixels included in the two adjacent pixels is generally equal to a luminance which corresponds to a grayscale level represented by the input signal or a signal converted from the input signal.

7. The liquid crystal display device of claim 1, wherein the plurality of subpixels further include a yellow subpixel.

8. The liquid crystal display device of claim 1, wherein the plurality of subpixels further include a cyan subpixel.

9. The liquid crystal display device of claim 1, wherein the plurality of subpixels further include a magenta subpixel.

10. The liquid crystal display device of claim 1, wherein the plurality of subpixels further include another red subpixel which is different from the aforesaid red subpixel.

* * * * *